US008432349B2

(12) United States Patent
Sasaki et al.

(10) Patent No.: US 8,432,349 B2
(45) Date of Patent: Apr. 30, 2013

(54) LIQUID CRYSTAL DISPLAY DEVICE

(75) Inventors: Tohru Sasaki, Mobara (JP); Takahiro Ochiai, Chiba (JP); Toshio Miyazawa, Chiba (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 835 days.

(21) Appl. No.: 12/511,114

(22) Filed: Jul. 29, 2009

(65) Prior Publication Data

US 2010/0026615 A1 Feb. 4, 2010

(30) Foreign Application Priority Data

Jul. 31, 2008 (JP) ..... 2008-197754

(51) Int. Cl.
*G09G 3/36* (2006.01)

(52) U.S. Cl.
USPC ..... 345/100; 345/92

(58) Field of Classification Search ..... 345/87, 345/92, 100, 204, 690
See application file for complete search history.

(56) References Cited

U.S. PATENT DOCUMENTS

| | | | | |
|---|---|---|---|---|
| 7,808,493 | B2 | 10/2010 | Hashimoto et al. | |
| 2003/0011696 | A1 * | 1/2003 | Yamazaki | 348/312 |
| 2008/0158129 | A1 * | 7/2008 | Murakami et al. | 345/98 |

FOREIGN PATENT DOCUMENTS

| | | | |
|---|---|---|---|
| JP | 2002-372955 | | 12/2002 |
| JP | WO2006/040977 | * | 4/2006 |
| JP | 2007-310234 | | 11/2007 |

* cited by examiner

*Primary Examiner* — Quan-Zhen Wang
*Assistant Examiner* — Calvin C Ma
(74) *Attorney, Agent, or Firm* — Antonelli, Terry, Stout & Kraus, LLP.

(57) ABSTRACT

A liquid crystal display device includes plural video signal lines, plural video signal input terminals less in number than the video signal lines, and a switch circuit interposed between the video signal input terminals and the video signal lines. The switch circuit has plural switch elements and plural switching wires, wherein each of the video signal lines is connected to one of the video signal input terminals via one of the switch elements, and each of the video signal input terminals is connected to a plurality of the video signal lines. Further, switching wires, to which are connected the switch elements connected one to each of the plural video signal lines, differ from one another.

12 Claims, 50 Drawing Sheets

LIQUID CRYSTAL DISPLAY DEVICE

The present application claims priority from Japanese applications JP2008-197754 filed on Jul. 31, 2008, the content of which is hereby incorporated by reference into this application.

BACKGROUND OF THE INVENTION

The present invention relates to a liquid crystal display device, and particularly to a technology which is effective by being applied to a liquid crystal display device used in a portable electronic instrument.

To date, a liquid crystal display device (which may also be called a liquid crystal display module) is used in a display of a portable electronic instrument, such as a portable telephone terminal or a PDA.

The liquid crystal display device has a liquid crystal display panel having a liquid crystal material enclosed between a pair of substrates. The display area of the liquid crystal display panel is configured of a collection of pixels, each of which has a TFT element, a pixel electrode, a common electrode, and a liquid crystal material. At this time, the luminance (gradation) of each pixel is controlled by changing the orientation of liquid crystal molecules in the liquid crystal material by means of an electric field whose intensity varies depending on a potential difference between the pixel electrode and common electrode.

Also, when displaying a video or image on the liquid crystal display device, a deterioration in image quality is prevented by, for example, reversing a relationship in each pixel between the potential of the pixel electrode and the potential of the common electrode for each frame period.

Furthermore, when displaying a video or image on the liquid crystal display device, a deterioration in image quality is prevented by, for example, mixing a pixel in which the potential of the pixel electrode is made higher than the potential of the common electrode, and a pixel in which the potential of the pixel electrode is made lower than the potential of the common electrode, for one frame period.

As a method of providing the pixel in which the potential of the pixel electrode is made higher than the potential of the common electrode, and the pixel in which the potential of the pixel electrode is made lower than the potential of the common electrode, there are, for example, a drive method called a line inversion drive, and a drive method called a dot inversion drive. The line inversion drive is a drive method such that, for one frame period, in pixels aligned in a direction of extension of video signal lines, the relationship between the pixel electrode potential and common electrode potential is the same, and in two pixels adjacent to each other across a video signal line, the relationships between the pixel electrode potential and common electrode potential are opposite ones. Also, the dot inversion drive is a drive method such that, for one frame period, in two pixels adjacent to each other in the direction of extension of the video signal lines, as well as in two pixels adjacent to each other across a video signal line, the relationships between the pixel electrode potential and common electrode potential are opposite ones.

Meanwhile, with a heretofore known liquid crystal display device, in general, the number of terminals of a driver IC which applies video signals to video signal lines is equal to the number of video signal lines. However, as a recent liquid crystal display device, for example, one has been proposed in which the number of video signal input terminals on a liquid crystal display panel is made less than the number of video signal lines disposed in a display area, and a switch circuit is interposed between the video signal input terminals and video signal lines (refer to, for example, JP-A-2002-372955).

With this kind of liquid crystal display device, one video signal input terminal being connected to, for example, each of three adjacent video signal lines via switch elements, signals applied to each of the three video signal lines are applied to the one video signal input terminal for a period for which one scan signal line is being selected. Then, by activating and deactivating the switch elements for the period for which one scan signal line is being selected, video signals applied to the one video signal input terminal are applied, distributed, to the three video signal lines. With this kind of liquid crystal display device, it is possible to reduce the number of output terminals of the driver IC to one third, even with the same resolution as that of the heretofore known one. For this reason, it is possible to hope for an enhancement in resolution (an enhancement in definition) of a compact liquid crystal display device used in the display of the portable electronic instrument.

SUMMARY OF THE INVENTION

Without being limited to the liquid crystal display device used in the display of the portable electronic instrument, with the recent liquid crystal display device, it is often the case that the dot inversion drive is employed, for example, in order to improve a moving image display performance.

However, in a case of applying the dot inversion drive to the heretofore known liquid crystal display device, it is necessary to reverse the polarity of video signals (gradation voltages) generated in the driver IC for each video signal applied to one pixel electrode. For this reason, there is a problem in that the power consumption of the driver IC increases, and a problem in that the heating value of the driver IC increases, and a failure, a malfunction, or the like will be likely to occur.

Also, as the portable electronic instrument is generally operated on a battery, a reduction in power consumption of the liquid crystal display device is desired.

An object of the invention is to provide a technology capable of balancing an enhancement in image quality, and a reduction in power consumption, of a liquid crystal display device.

The heretofore described and other objects, and a novel feature, of the invention will be made clear by the description and accompanying drawings of this specification.

To describe an outline of typical ones, from among aspects of the invention disclosed in this application, it is as follows.

1. A liquid crystal display device comprising: a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals. The switch circuit has a plurality of switch elements and a plurality of switching wires which carry out an activation and deactivation of the switch elements, each of the plurality of switch elements is connected to one of the plurality of switching wires, each of the plurality of video signal lines is connected to one of the plurality of video signal input terminals via one of the plurality of switch elements, each of the plurality of video signal input terminals is connected to a plurality of the plurality of video signal lines, the switching wires, to which are connected the switch elements connected one to each of the plurality of the plurality of video signal lines, differ from one another, each of the plurality of switching wires is connected to a plurality of the plurality of switch elements, and among the video signal lines connected one to each of the plurality of the plurality of switch elements, there exist two or more kinds of number of other video signal lines disposed between two adjacent video signal lines.

2. A liquid crystal display device includes a plurality of scan signal lines; a plurality of video signal lines three-dimensionally intersecting the scan signal lines via an insulating layer; a plurality of TFT elements disposed one in each of vicinities of positions in which the video signal lines three-dimensionally intersect the scan signal lines; a plurality of electrodes connected one to a source or drain of each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals. The switch circuit has a plurality of switch elements and a plurality of switching wires which carry out an activation and deactivation of the switch elements, each of the plurality of switch elements is connected to one of the plurality of switching wires, each of the plurality of video signal lines is connected to one video signal input terminal via one switch element, a plurality of switch elements connected to one of the video signal input terminals are connected to differing switching wires, and a plurality of the video signal lines connected to a first video signal input terminal, and a plurality of the video signal lines connected to a second video signal input terminal, are alternately disposed.

3. In the liquid crystal display device according to the aspect 1 or 2, the video signal input terminals include a first video signal input terminal and a second video signal input terminal adjacent to the first video signal input terminal, the video signal lines include a first video signal line, a second video signal line, a third video signal line, a fourth video signal line, a fifth video signal line, and a sixth video signal line which are formed aligned in the order named, the switching wires include a first switching wire, a second switching wire, and a third switching wire, the first video signal input terminal is connected to the first video signal line, second video signal line, and third video signal line, the second video signal input terminal is connected to the fourth video signal line, fifth video signal line, and sixth video signal line, the switch element connected to the first video signal line, and the switch element connected to the sixth video signal line, are connected to the first switching wire, the switch element connected to the second video signal line, and the switch element connected to the fifth video signal line, are connected to the second switching wire, and the switch element connected to the third video signal line, and the switch element connected to the fourth video signal line, are connected to the third switching wire.

4. In the liquid crystal display device according to the aspect 1 or 2, each of the pixel electrodes is connected to one of a source electrode and drain electrode of each of the TFT elements, and one of the video signal lines is connected to the other, a plurality of the TFT elements are connected to the one video signal line, and all of the plurality of the TFT elements connected to the one video signal line are formed on one of two sides adjacent to the one video signal line.

5. In the liquid crystal display device according to the aspect 1 or 2, each of the pixel electrodes is connected to one of a source electrode and drain electrode of each of the TFT elements, and one of the video signal lines is connected to the other, a plurality of the TFT elements are connected to the one video signal line, and adjacent ones of the plurality of the TFT elements connected to the one video signal line are formed on either of two sides adjacent to the one video signal line.

6. In the liquid crystal display device according to the aspect 5, two video signal lines, from among the plurality of video signal lines, disposed on the outermost side are electrically connected.

7. In the liquid crystal display device according to the aspect 1 or 2, the positions of two adjacent pixel electrodes, from among a plurality of pixel electrodes disposed between the two adjacent video signal lines, are displaced from one another in a direction in which the scan signal lines extend, and the positions of two pixel electrodes, from among the plurality of pixel electrodes, disposed across one pixel electrode, are the same as each other in the direction in which the scan signal lines extend.

8. In the liquid crystal display device according to the aspect 1 or 2, the switch elements being TFT elements, gate electrodes of the TFT elements and the switching wires are connected.

9. A liquid crystal display device includes a plurality of scan signal lines; a plurality of video signal lines three-dimensionally intersecting the scan signal lines via an insulating layer; a plurality of TFT elements disposed one in each of vicinities of positions in which the video signal lines three-dimensionally intersect the scan signal lines; a plurality of electrodes connected one to a source or drain of each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals. The switch circuit has a plurality of switch elements and a plurality of switching wires which carry out an activation and deactivation of the switch elements, each of the plurality of switch elements is connected to one of the plurality of switching wires, each of the plurality of video signal lines is connected to the plurality of video signal input terminals via one switch element, a plurality of switch elements connected to one of the video signal input terminals are connected to differing switching wires, a plurality of video signal lines connected to one of the video signal input terminals via the switch elements are successively disposed in parallel, and the positional relationship of a plurality of TFT elements connected to one video signal line in relation to the video signal line connected to the TFT elements, as seen in a direction of disposition of the plurality of video signal lines, are in a reversed relationship for each number of TFT elements set in advance.

10. In the liquid crystal display device according to the aspect 9, two video signal lines, from among the plurality of video signal lines, disposed on the outermost side are electrically connected.

11. In the liquid crystal display device according to the aspect 9, the switch elements being TFT elements, gate electrodes of the TFT elements and the switching wires are connected.

12. A liquid crystal display device includes a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals. The switch circuit has a plurality of switch elements and a plurality of switching wires which carry out an activation and deactivation of the switch elements, each of the plurality of switch elements is connected to one of the plurality of switching wires, the video signal input terminals have a plurality of units, each of which is formed of a first video signal input terminal and a second video signal input terminal, the plurality of switch elements have a plurality of first switch elements and a plurality of second switch elements, each of the plurality of video signal lines is connected to the first video signal input terminal via one of the plurality of first switch elements, and connected to the second video signal input terminal of the same unit as that of the first video signal input terminal, via one of the plurality of second switch elements, the switching wires, to which are connected the first switch element and second switch element connected to one of the video signal lines, differ from one another, a plurality of the video signal lines are connected to each of the plurality of units, and the first switch element and second switch element being connected to each of the plurality of the video signal lines, one combination of a switching wire to which the first switch element is connected, and a switching wire to which the second switch element is connected, differs from another combination.

13. A liquid crystal display device includes a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals. The switch circuit has a plurality of switch elements and a plurality of switching wires which carry out an activation and deactivation of the switch elements, each of the plurality of switch elements is connected to one of the plurality of switching wires, the video signal input terminals have a plurality of units, each of which is formed of a first video signal input terminal and a second video signal input terminal, the plurality of switch elements have a plurality of first switch elements, a plurality of second switch elements, and a plurality of third switch elements, each of the plurality of video signal lines is connected to the first video signal input terminal via one of the plurality of first switch elements and one of the plurality of second switch elements, and connected to the second video signal input terminal of the same unit as that of the first video signal input terminal, via one of the plurality of first switch elements and one of the plurality of third switch elements, a first video signal line group formed of a plurality of the video signal lines, and a second video signal line group formed of a plurality of the video signal lines, are connected to each of the plurality of units, the switching wires, to which are connected the first switch elements connected one to each of the video signal lines of the first video signal line group, differ from one another, the second switch elements connected one to each of the video signal lines of the first video signal line group are connected to a first switching wire, the third switch elements connected one to each of the video signal lines of the first video signal line group are connected to a second switching wire differing from the first switching wire, the second switch elements connected one to each of the video signal lines of the second video signal line group are connected to the second switching wire, and the third switch elements connected one to each of the video signal lines of the second video signal line group are connected to the first switching wire.

14. In the liquid crystal display device according to the aspect 13, each of the video signal lines of the first video signal line group is connected to one identical second switch element and one identical third switch element, and each of the video signal lines of the first video signal line group is connected to another identical second switch element and another identical third switch element.

15. In the liquid crystal display device according to the aspect 12 or 13, each of the pixel electrodes is connected to one of a source electrode and drain electrode of each of the TFT elements, and one of the video signal lines is connected to the other, a plurality of the TFT elements are connected to the one video signal line, and all of the plurality of the TFT elements connected to the one video signal line are formed on one of two sides adjacent to the one video signal line.

16. In the liquid crystal display device according to the aspect 12 or 13, the positions of two adjacent pixel electrodes, from among a plurality of pixel electrodes disposed between the two adjacent video signal lines, are displaced from one another in a direction in which the scan signal lines extend, and the positions of two pixel electrodes, from among the plurality of pixel electrodes, disposed across one pixel electrode, are the same as each other in the direction in which the scan signal lines extend.

17. In the liquid crystal display device according to the aspect 12 or 13, the switch elements being TFT elements, gate electrodes of the TFT elements and the switching wires are connected.

According to some aspects of the invention, it is possible to balance the enhancement in image quality and reduction in power consumption of the liquid crystal display device.

DESCRIPTION OF THE PREFERRED EMBODIMENTS

Figure 1A:
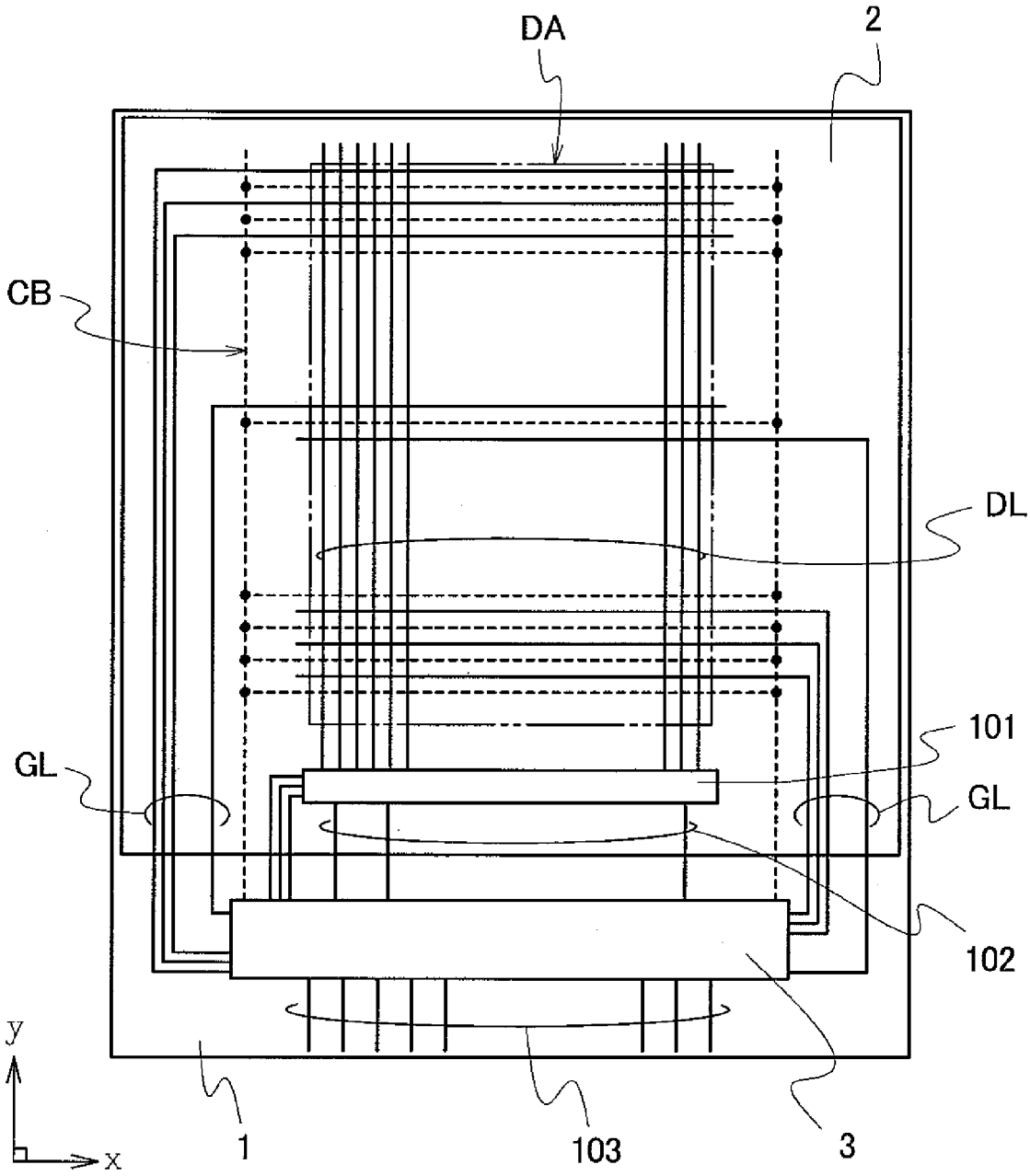
FIG. 1A is a schematic plan view showing one example of a planar configuration of a liquid crystal display device according to some aspects of the invention.

Hereafter, a detailed description will be given, referring to the drawings, of the invention along with embodiments. In all of the drawings for illustrating the embodiments, components having identical functions being given identical reference numerals and characters, a repeated description thereof will be omitted.

Figure 1B:
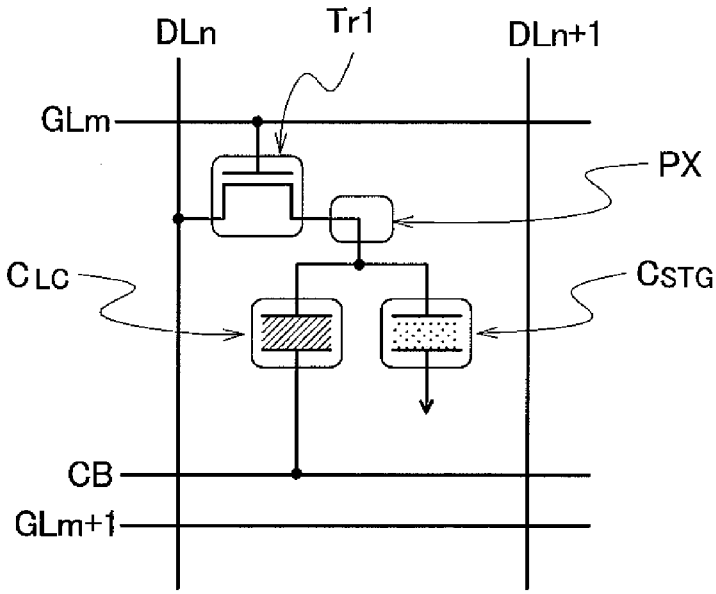
FIG. 1B is a schematic circuit diagram showing one example of a circuit configuration of one pixel in a display area.
Figure 1C:
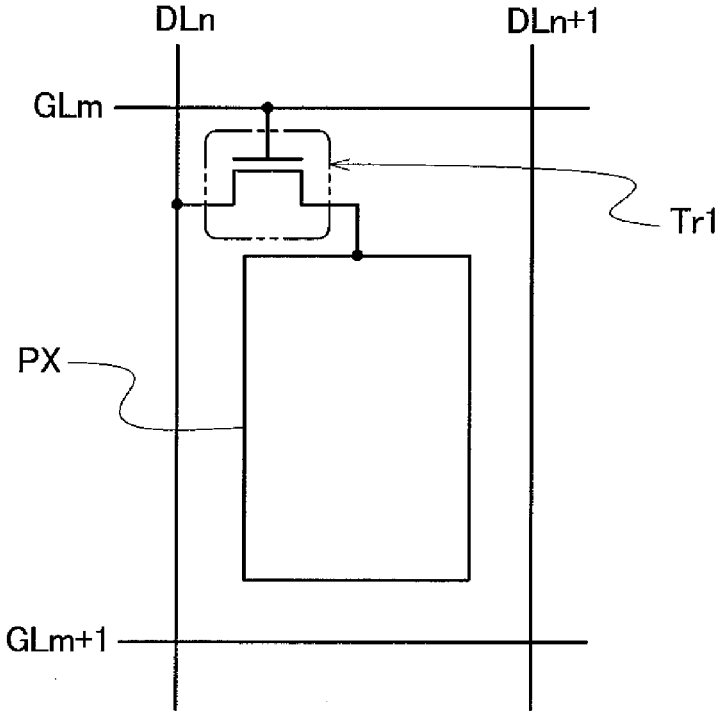
FIG. 1C is a schematic circuit diagram showing one example of another representation of the circuit configuration of one pixel.

FIG. 1A is a schematic plan view showing one example of a planar configuration of a liquid crystal display device according to some aspects of the invention. FIG. 1B is a schematic circuit diagram showing one example of a circuit configuration of one pixel in a display area. FIG. 1C is a schematic circuit diagram showing one example of another representation of the circuit configuration of one pixel.

The invention is applied to, for example, a liquid crystal display device having a liquid crystal display panel with the kind of configuration shown in FIG. 1A to 1C. The liquid crystal display panel is a display panel having a liquid crystal material enclosed between a pair of substrates, a TFT substrate 1 and an opposite substrate 2. At this time, in a case in which the liquid crystal display panel is of an in-plane switching type, the TFT substrate 1 has, for example, a plurality of scan signal lines GL, a plurality of video signal lines DL, a common feeder wire CB, a switch circuit 101, a video signal input line 102, and an external signal input line 103. Also, a drive circuit 3 which drives the liquid crystal display panel is mounted on the TFT substrate 1.

Each of the plurality of scan signal lines GL having a portion passing through a display area DA, the portions passing through the display area DA are extended in an x direction, and disposed in parallel in a y direction. The scan signal lines GL are connected to the drive circuit 3.

Each of the plurality of video signal lines DL having a portion passing through the display area DA, the portions passing through the display area DA are extended in the y direction, and disposed in parallel in the x direction. The video signal lines DL are connected to the video signal input line 102 via the switch circuit 101, and the video signal input line 102 is connected to the drive circuit 3.

The display area DA of the liquid crystal display panel being configured of a plurality of pixels disposed in a matrix form, an area of one pixel corresponds to an area surrounded by two adjacent scan signal lines GL and two adjacent video signal lines DL. At this time, as shown in FIG. 1B, one pixel has a TFT element Tr1, a pixel electrode PX connected to the TFT element Tr1, and an opposite electrode (not shown) connected to the common feeder wire CB. Also, at this time, one pixel has a pixel capacitor $C_{LC}$ formed of the pixel electrode PX, opposite electrode, and liquid crystal material, and a retention capacitor $C_{STG}$ formed of a conductive layer separate from the pixel electrode PX and opposite electrode, and an insulating layer.

There may be a case in which the retention capacitor $C_{STG}$ is formed of, for example, a pixel electrode, an opposite electrode, and an insulating layer, and there may also be a case in which it is not provided.

Also, in FIG. 1B, among two scan signal lines $GL_m$ and $GL_{m+1}$, the gate of the TFT element Tr1 is connected to the upper scan signal line $GL_m$ but, without being limited to this, it is also acceptable that it is connected to the lower scan signal line $GL_{m-1}$. In the same way, in FIG. 1B, among two video signal lines $DL_n$ and $DL_{n+1}$, the drain of the TFT element Tr1 is connected to the left video signal line $DL_n$ but, without being limited to this, it is also acceptable that it is connected to the right video signal line $DL_{n+1}$.

Also, the source electrode and drain electrode of the TFT element Tr1 switch according to the polarity of an applied voltage, and it may happen that an electrode connected to the pixel electrode PX is the drain electrode but, in this specification, an electrode connected to the pixel electrode PX is referred to as the source electrode.

Furthermore, the configuration of one pixel may be shown by only the TFT element Tr1 and pixel electrode PX, as shown in, for example, FIG. 1C. In the drawings to be referred to in the following description of the specification, the pixel configuration will be shown by the kind of simplified method in FIG. 1C.

Figure 2A:
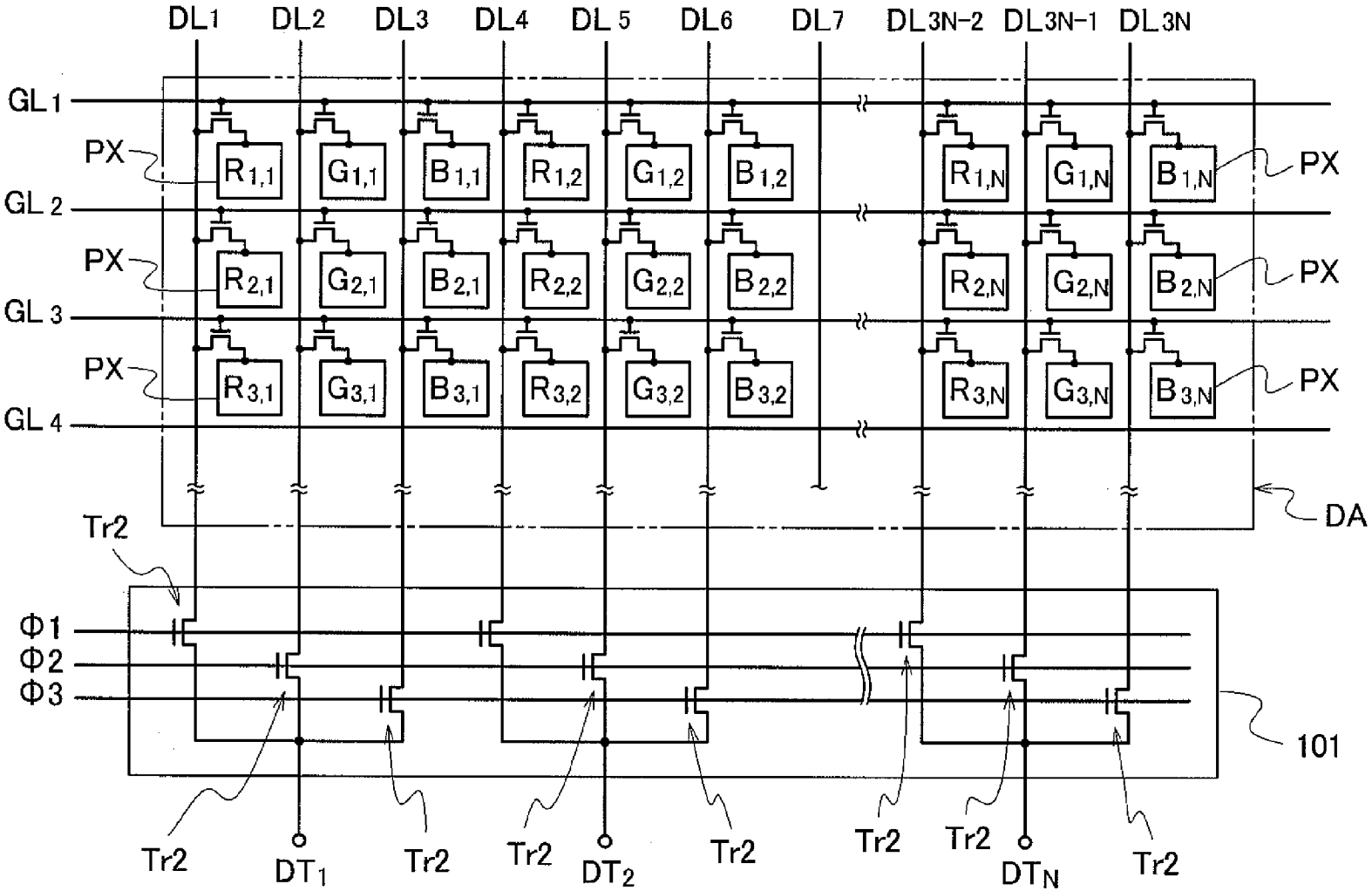
FIG. 2A PRIOR ART
FIG. 2A is a schematic circuit diagram showing one example of an outline configuration of a heretofore known liquid crystal display panel.
Figure 2B:
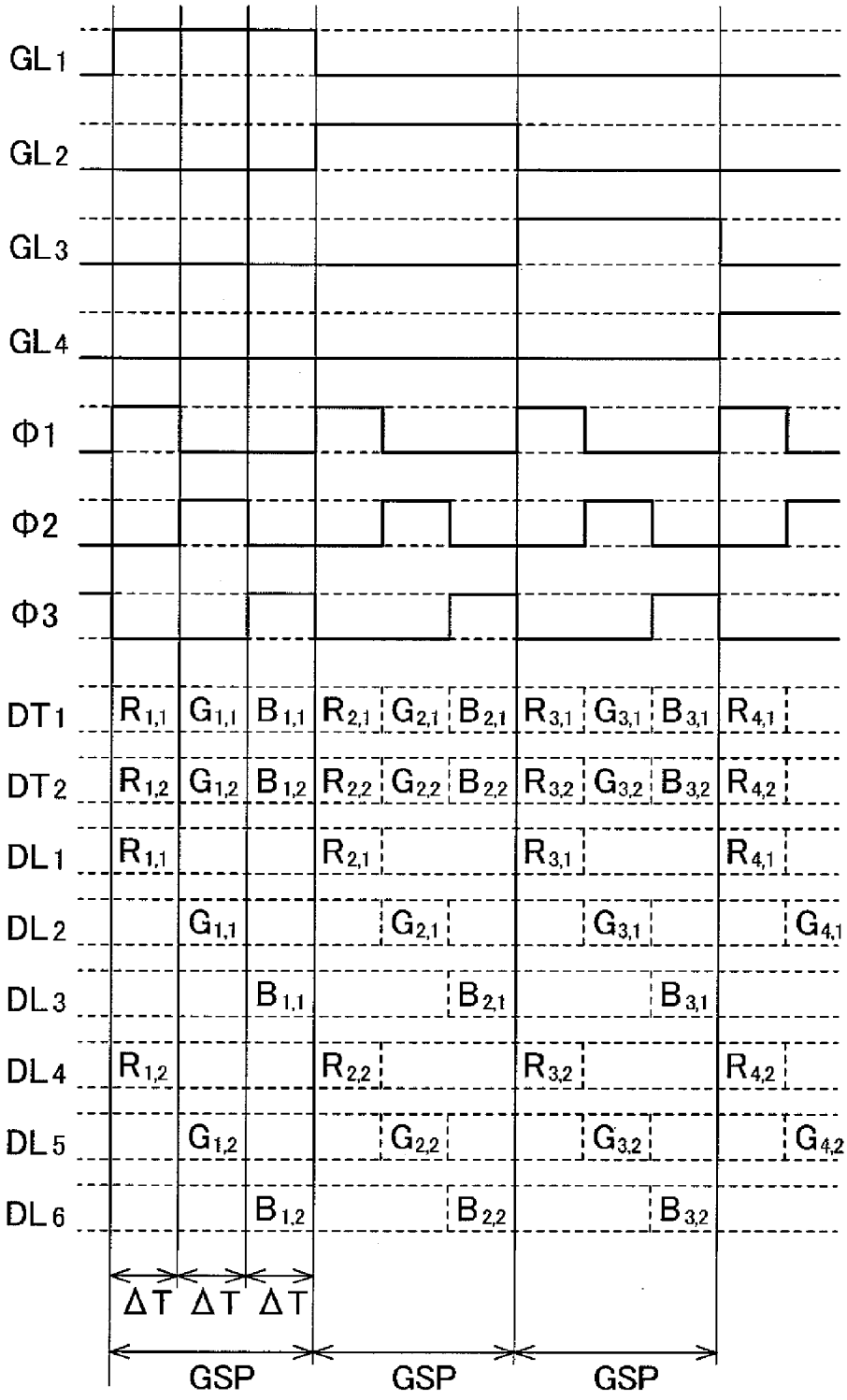
FIG. 2B PRIOR ART
FIG. 2B is a schematic diagram showing one example of a method of driving the liquid crystal display panel shown in FIG. 2A.

FIGS. 2A and 2B are schematic diagrams showing examples of an outline configuration of, and a method of driving, a heretofore known liquid crystal display panel.

A switch circuit in the heretofore known liquid crystal display panel, as shown in FIG. 2A, has a plurality of TFT elements Tr2 (hereafter called switch elements) and three switching wires ϕ1, ϕ2, and ϕ3. At this time, the gate of each switch element Tr2 is connected to one of the three switching wires ϕ1, ϕ2, and ϕ3.

Also, one video signal line $DL_n$ (n=1, 2, 3, . . . , 3N) is connected to one video signal input terminal $DT_q$ (q=1, 2, 3, . . . , N) via one switch element Tr2. Also, three adjacent video signal lines $DL_{3q-2}$, $DL_{3q-1}$, and $DL_{3q}$ are connected to one video signal input terminal $DT_q$. Furthermore, switching wires, to which are connected the gates of three switch elements Tr2 connected to one video signal input terminal $DT_q$, differ from one another. Each video signal input terminal $DT_q$ is connected to the drive circuit 3. In a case in which the drive circuit 3 is an electronic part such as a semiconductor package (an IC chip), each video signal input terminal $DT_q$ is connected to a video signal output terminal of the drive circuit 3.

In FIG. 2A, $R_{m,q}$, $G_{m,q}$, and $B_{m,q}$ (m=1, 2, 3, . . . , M, and q=1, 2, 3, . . . , N) described one in each pixel electrode PX inside the display area DA are gradation voltages (video signals) applied one to each pixel electrode PX. One unit pixel of a video or image is formed by three pixels having pixel electrodes to which are applied gradation voltages $R_{m,q}$, $G_{m,q}$, and $B_{m,q}$ having the same combination of m and q (for example, three pixels having pixel electrodes to which $R_{1,1}$, $G_{1,1}$, and $B_{1,1}$ are applied).

When driving this kind of liquid crystal display panel, signals applied to each scan signal line $GL_m$, each switching wire ϕ1, ϕ2, and ϕ3, and each video signal input terminal $DT_q$ are switched at the timing shown in FIG. 2B.

A scan signal applied to each scan signal line $GL_m$, being a signal with one frame period as one cycle, is a signal which attains an H level for only one horizontal selection period GSP of one frame period, and an L level for the remaining period. For one horizontal selection period GSP, only a scan signal applied to one scan signal line GL attains the H level. Also, the H level of the scan signal is a potential at which the TFT element Tr1 is activated, and the L level is a potential at which the TFT element Tr1 is deactivated.

A switching signal applied to each switching wire ϕ1, ϕ2, and ϕ3, being a signal with one horizontal selection period GSP as one cycle, is a signal which attains the H level for only one selection period ΔT of one horizontal selection period GSP, and attains the L level for the remaining period. For one selection period ΔT, only a switching signal applied to one switching wire attains the H level. Also, the H level of the switching signal is a potential at which the switch elements Tr2 is activated, and the L level is a potential at which the switch elements Tr2 is deactivated.

At this time, on gradation voltages being input into a video signal input terminal $DT_1$ and a video signal input terminal $DT_2$ in the kind of order shown in FIG. 2B, the individual gradation voltages are distributed to predetermined video signal lines $DL_1$, $DL_2$, $DL_3$, $DL_4$, $DL_5$, and $DL_6$, and applied to predetermined pixel electrodes PX.

Consequently, with a liquid crystal display device having this kind of switch circuit 101, it is possible to reduce the number of video signal input terminals $DT_q$, and the number of video signal output terminals of the drive circuit 3, enabling a miniaturization of the drive circuit 3.

Figure 3A:
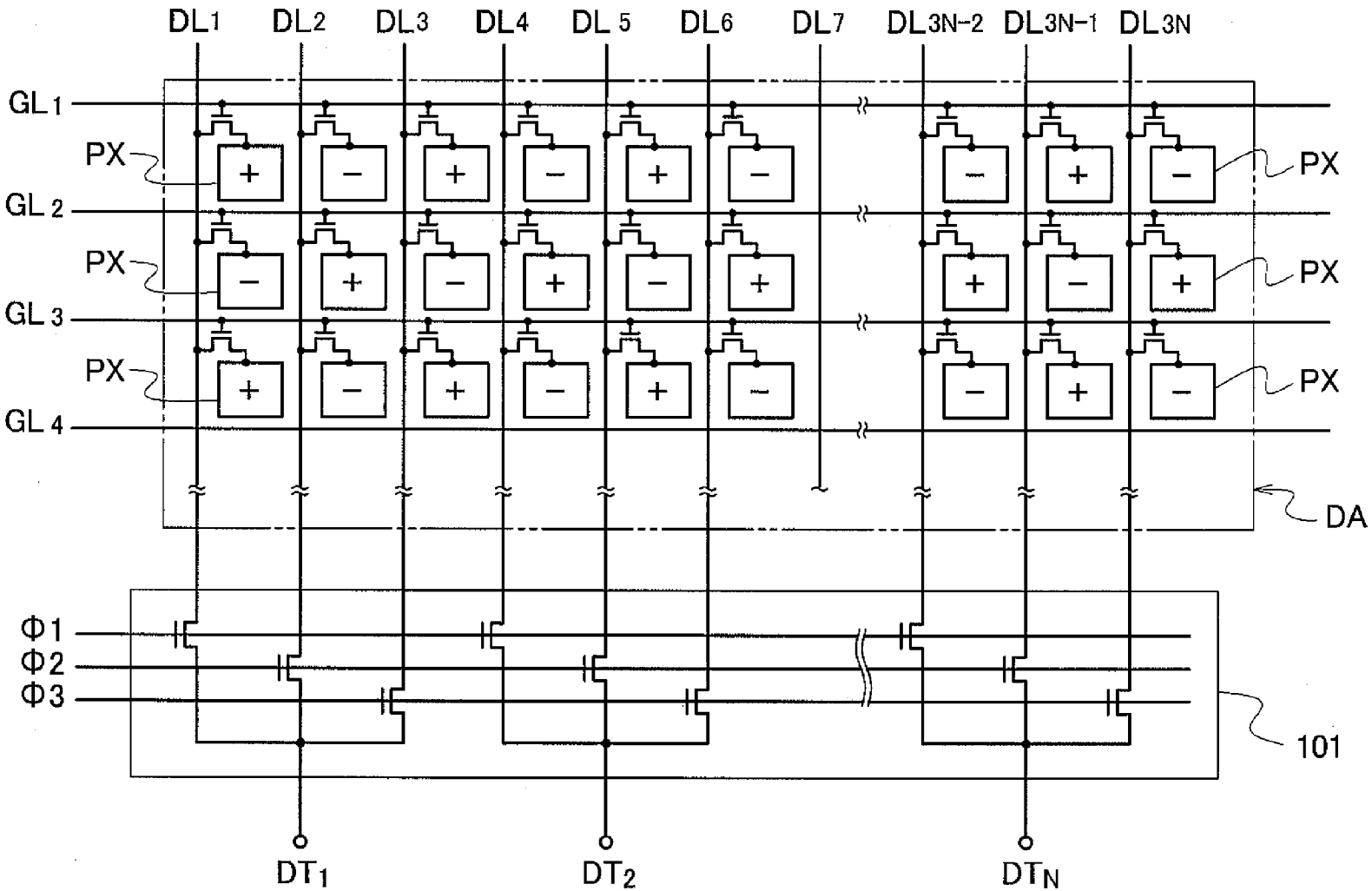
FIG. 3A PRIOR ART
FIG. 3A is a schematic diagram showing a principle of a drive method called a dot inversion drive.
Figure 3B:
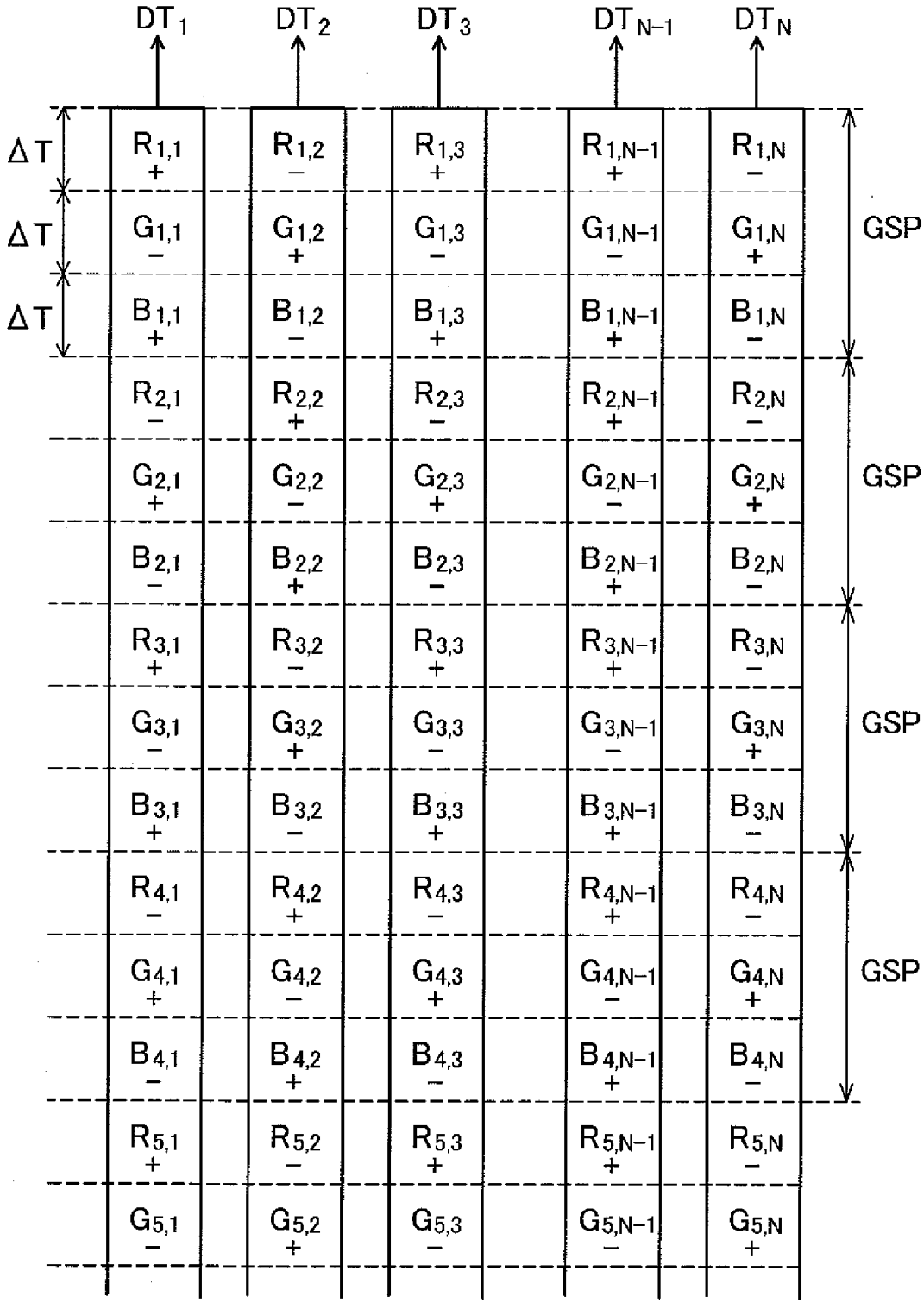
FIG. 3B PRIOR ART
FIG. 3B is a schematic diagram showing a method of inputting gradation voltages when carrying out the dot inversion drive.

FIGS. 3A and 3B are schematic diagrams showing one example of the method of driving the heretofore known liquid crystal display panel from another point of view.

When driving the liquid crystal display device (liquid crystal display panel), the intensity of an electric field applied to liquid crystal molecules in the liquid crystal material is controlled based on a potential difference between the pixel electrode PX and opposite electrode, controlling a light transmittance or reflectance. At this time, as the electric field applied to the liquid crystal molecules, there being an electric field applied with the potential of the pixel electrode PX made higher than the potential of the opposite electrode, and an electric field applied with the potential of the pixel electrode made lower than the potential of the opposite electrode, the two electric fields are reversed for each period set in advance (for example, for each frame period). In general, the polarity of the electric field applied in the case of making the potential of the pixel electrode PX higher than the potential of the opposite electrode is referred to as a positive polarity, while the polarity of the electric field applied in the case of making the potential of the pixel electrode PX lower than the potential of the opposite electrode is referred to as a negative polarity.

Also, when driving the liquid crystal display device (liquid crystal display panel), it is desirable to reverse the polarity using a dot inversion drive, rather than giving the same polarity to all the pixel electrodes for one frame period. With the dot inversion drive, as shown in FIG. 3A, the polarity of each pixel electrode for one frame period is such that the polarities of two pixel electrodes adjacent to each other in a direction of extension of the scan signal lines GL, and the polarities of two pixel electrodes adjacent to each other in a direction of extension of the video signal lines DL, are both in a reversed relationship. In FIG. 3A, the symbol + shown in each pixel electrode PX means the positive polarity, and the symbol − means the negative polarity. Also, the positive polarity + and negative polarity − of each pixel electrode are reversed for the next frame period.

Gradation voltage applied to each pixel in the kind of order shown in FIG. 3B is input into each video signal input terminal $DT_q$ of the liquid crystal display panel with the configuration shown in FIG. 3A. Consequently, there is a problem in that the frequency of reversing the polarities of gradation voltages input into one video signal input terminal from the drive circuit 3 increases, increasing the power consumption of the drive circuit 3.

Figure 4A:
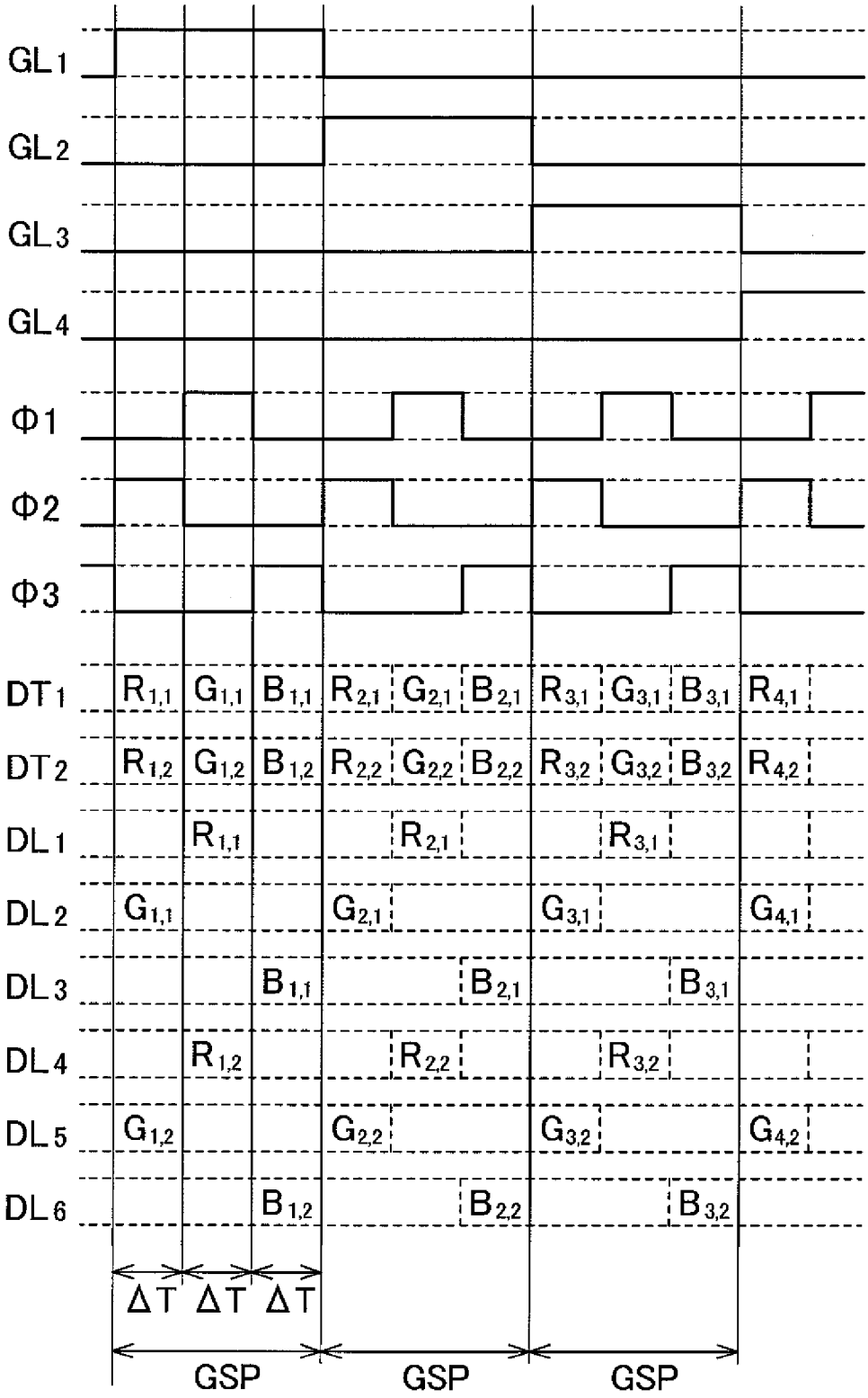
FIG. 4A is a schematic diagram showing one example of a method of driving a liquid crystal display panel of Reference Example 1.
Figure 4B:
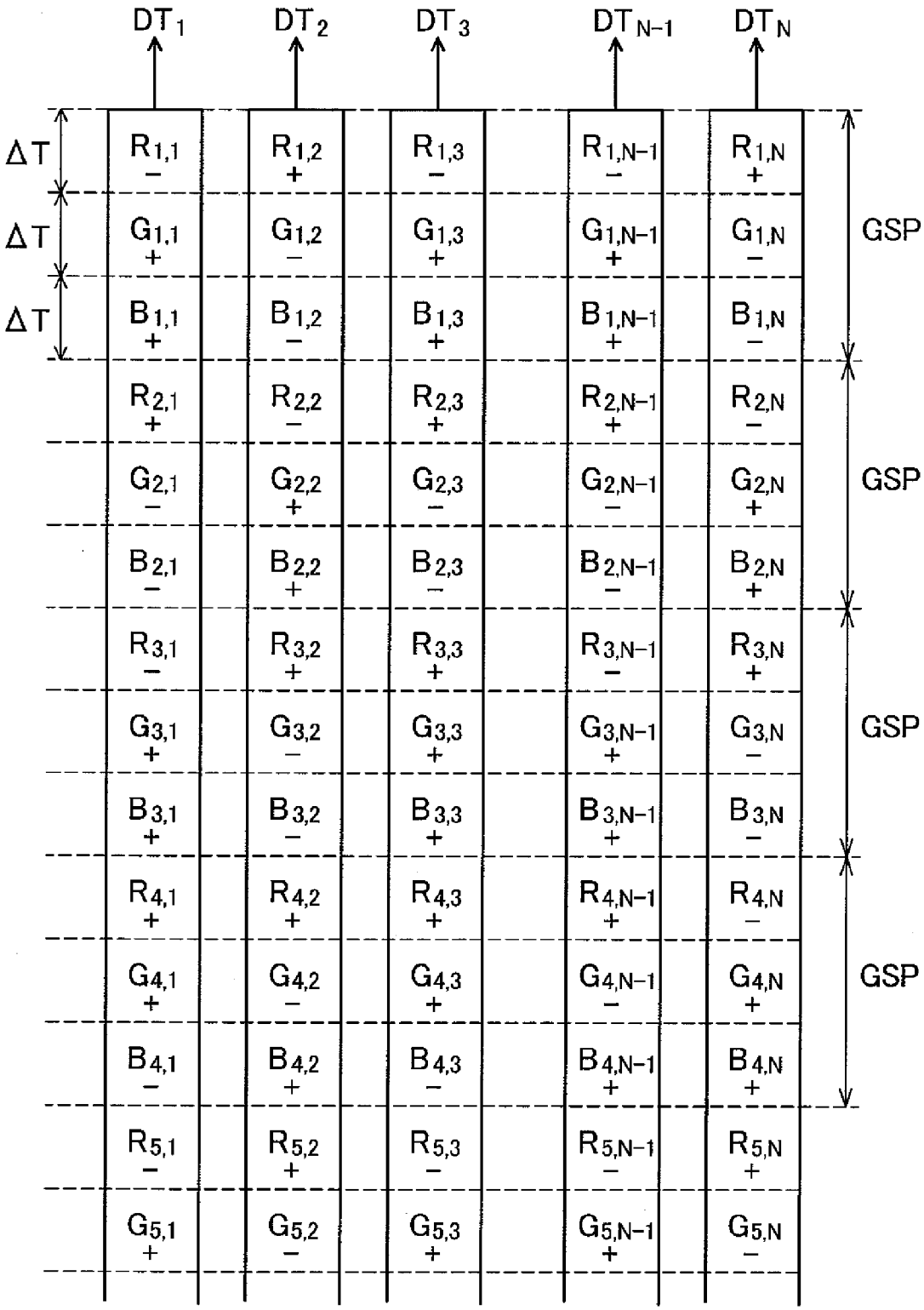
FIG. 4B is a schematic diagram showing one example of gradation voltages applied to video signal input terminals and their polarities.

FIG. 4A is a schematic diagram showing one example of a method of driving a liquid crystal display panel of Reference Example 1. FIG. 4B is a schematic diagram showing one example of video signals applied to video signal input terminals and their polarities.

In a case of applying the dot inversion drive to the liquid crystal display panel with the configuration shown in FIG. 2A, as shown in FIG. 4A, it is possible to change an order in which a switching signal applied to each switching wire $\phi$1, $\phi$2, and $\phi$3 attains the H level. In the example shown in FIG. 4A, an arrangement is such that the switching signals attain the H level in the order of $\phi$2, $\phi$1, and $\phi$3 for one cycle (one horizontal selection period). In the case in which the switching signals applied to the individual switching wires $\phi$1, $\phi$2, and $\phi$3 are switched at the kind of timing shown in FIG. 4A, the order of gradation voltages input into each video signal input terminal $DT_q$ is changed to the kinds of order shown in FIGS. 4A and 4B.

By changing the order of gradation voltages input into one video signal input terminal $DT_q$ in this way, it is possible to seriate gradation voltages of the same polarity. For this reason, in comparison with the input method of FIG. 3B, with the input method of FIG. 4B, it being possible to reduce the frequency with which the polarities of gradation voltages are reversed, it is possible to reduce the power consumption of the drive circuit 3.

Figure 5:
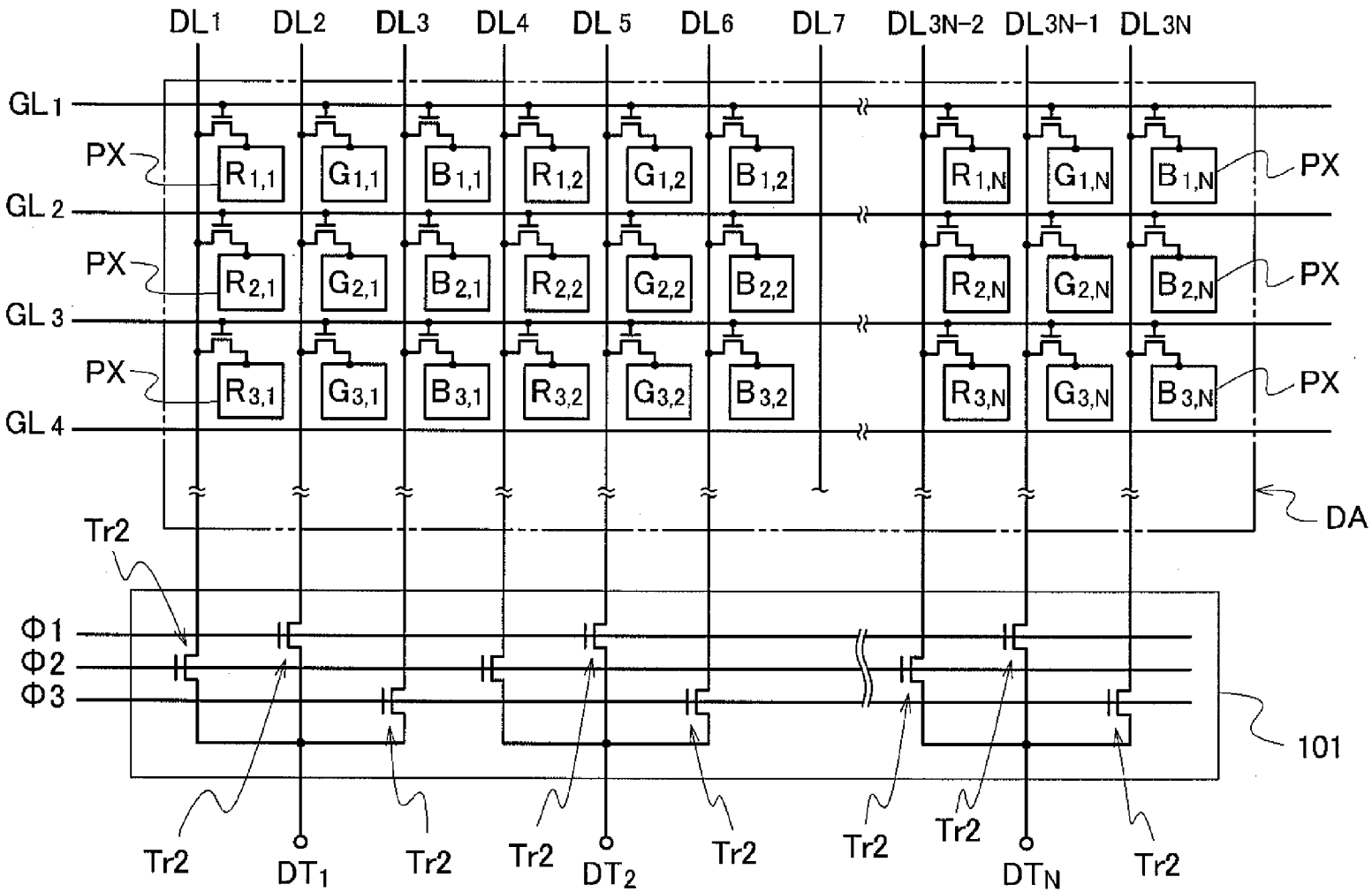
FIG. 5 is a schematic diagram showing one example of an outline configuration of a liquid crystal display panel of Reference Example 2.
Figure 6:
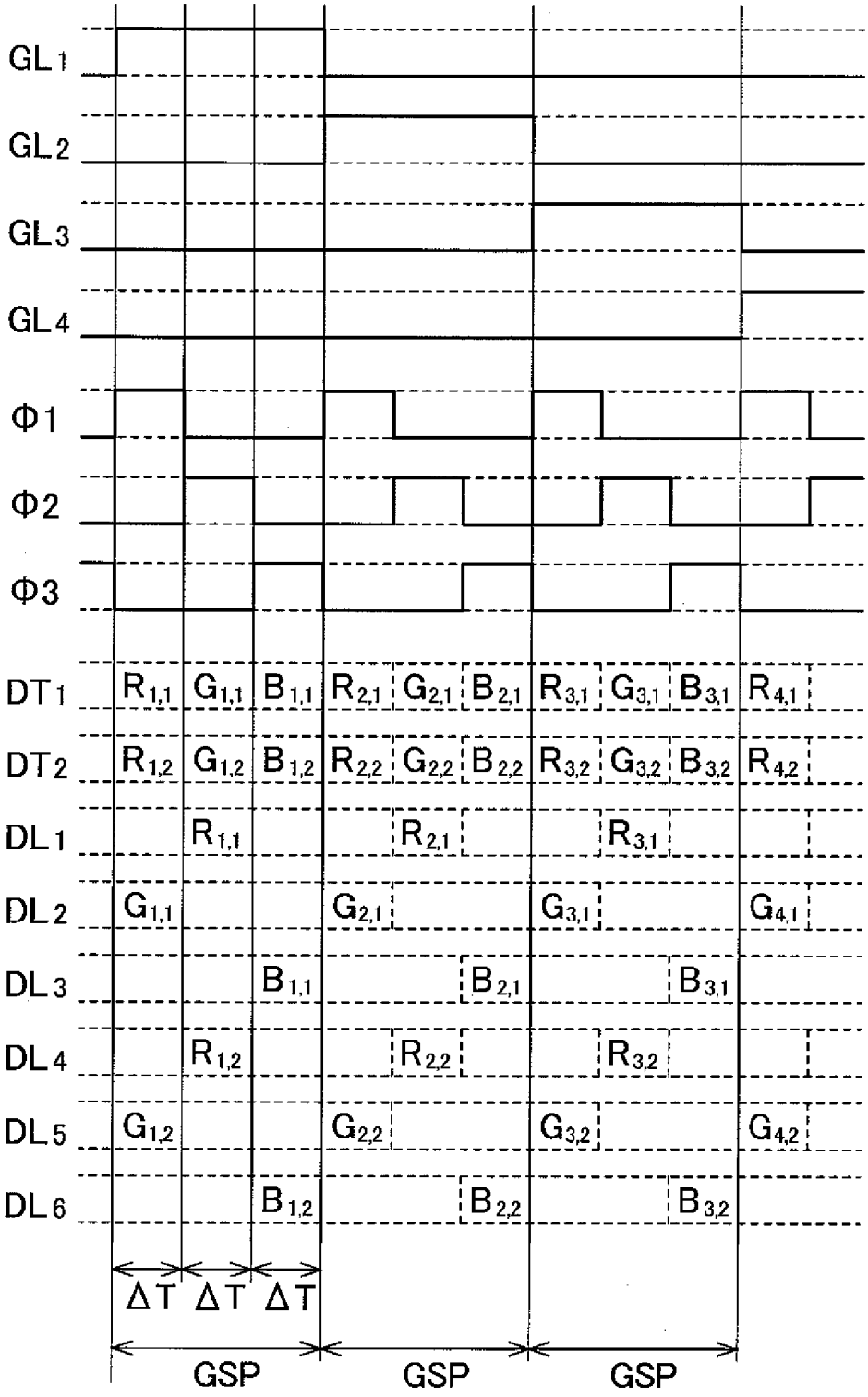
FIG. 6 is a schematic diagram showing one example of a method of driving the liquid crystal display panel of Reference Example 2.

FIG. 5 is a schematic diagram showing one example of an outline configuration of a liquid crystal display panel of Reference Example 2. FIG. 6 is a schematic diagram showing one example of a method of driving the liquid crystal display panel of Reference Example 2.

In a case of providing a switch circuit 101 in the liquid crystal display panel, as the switch circuit 101, it is also possible to adopt the kind of configuration shown in FIG. 5. When driving this kind of liquid crystal display panel, signals applied to each scan signal line $GL_m$, each switching wire $\phi$1, $\phi$2, and $\phi$3, and each video signal input terminal $DT_q$ are switched at the kind of timing shown in FIG. 6. At this time, the switching signals applied to the individual switching wires $\phi$1, $\phi$2, and $\phi$3, with one horizontal selection period as one cycle in the same way as in the example shown in FIG. 2B, attain the H level in the order of $\phi$1, $\phi$2, and $\phi$3 for the one cycle. However, the order of gradation voltages input into each video signal input terminal $DT_q$ is changed to the kind of order shown in FIG. 4B. Consequently, in comparison with the input method shown in FIG. 3B, with the input method in FIG. 6, it being possible to reduce the frequency with which the polarities of gradation voltages input into one video signal input terminal $DT_q$ are reversed, it is possible to reduce the power consumption of the drive circuit 3.

With the liquid crystal display device according to some aspects of the invention, an enhancement in image quality, and a reduction in power consumption, of the liquid crystal display device are balanced by developing the heretofore described configurations and drive methods of Reference Example 1 and Reference Example 2.

Embodiment 1

Figure 7:
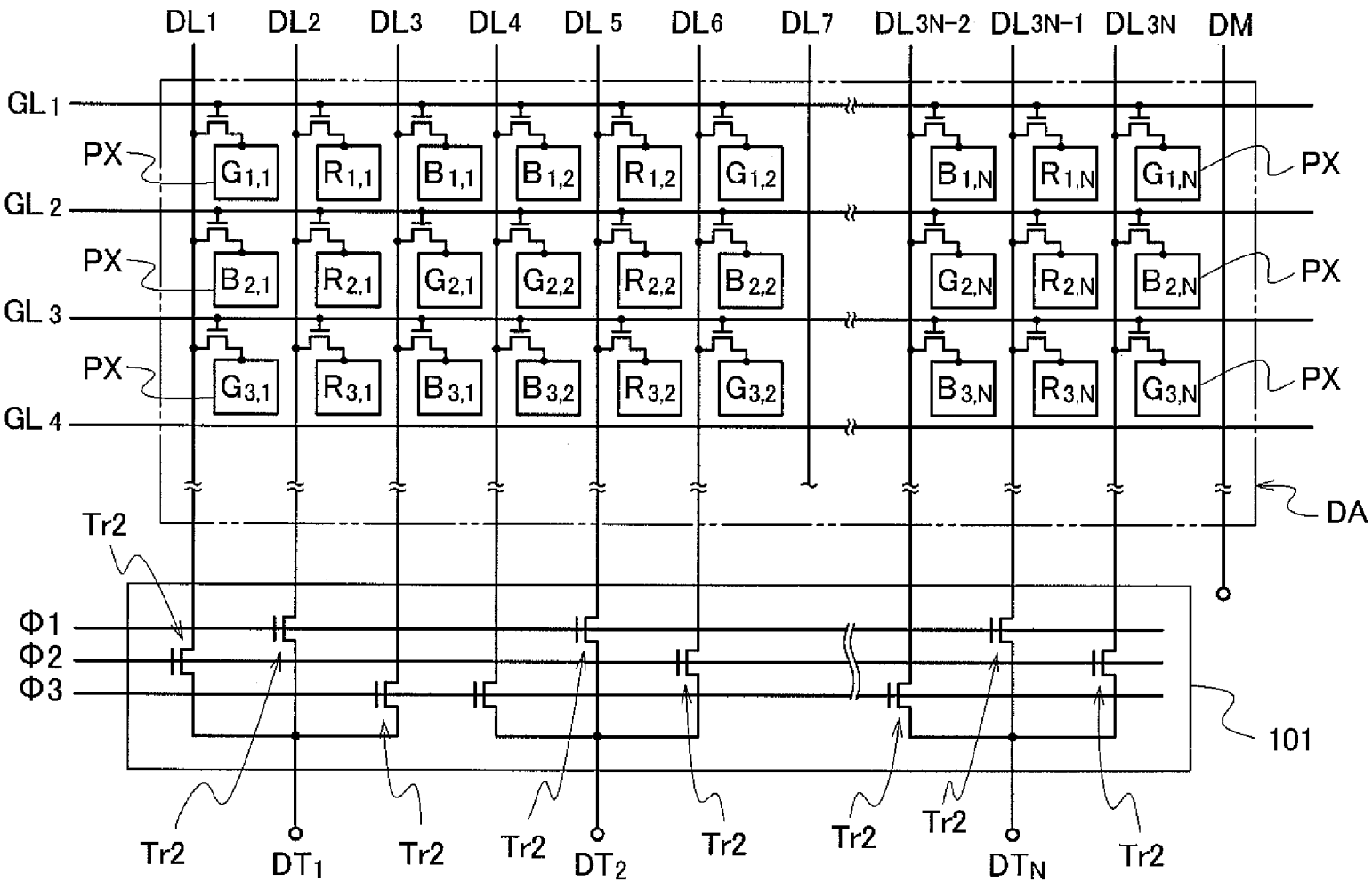
FIG. 7 is a schematic diagram showing an outline configuration of a liquid crystal display panel of Embodiment 1 of the invention.

FIG. 7 is a schematic diagram showing an outline of a liquid crystal display panel of Embodiment 1 of the invention.

The liquid crystal display panel of Embodiment 1 being one which carries out a color display, one unit pixel of a video or image is formed by three pixels seriated in a direction of extension of scan signal lines GL.

At this time, 3N video signal lines $DL_1$ to $DL_{3N}$ and one dummy video signal line DM pass through a display area DA.

With the liquid crystal display panel of Embodiment 1, as shown in FIG. 7, all TFT elements Tr1 disposed between two adjacent video signal lines DL, in a direction of extension of the video signal lines DL, are connected to the same video signal line DL.

Also, the arrangement shown in FIG. 7 is employed as the arrangement of R, G, and B of pixels inside the display area DA.

Also, N video signal input terminals $DT_q$ being provided in the liquid crystal display panel, one video signal input terminal $DT_q$ is connected to three successive video signal lines $DL_{3q-2}$, $DL_{3q-1}$, and $DL_{3q}$ via a switch circuit 101.

At this time, the switch circuit 101 having 3N switch elements Tr2 and three switching wires $\phi$1, $\phi$2, and $\phi$3, the gate of each switch element Tr2 is connected to one of the three switching wires $\phi$1, $\phi$2, and $\phi$3. Also, the gates of three switch elements Tr2 connected to one video signal input terminal $DT_q$ are connected to differing switching wires.

Three switch elements Tr2 connected to one video signal input terminal $DT_1$ are a switch element whose gate is connected to the switching wire $\phi$1, a switch element whose gate is connected to the switching wire $\phi$2, and a switch element whose gate is connected to the switching wire $\phi$3. At this time, the switch element whose gate is connected to the switching wire $\phi 1$ is connected to a video signal line $DL_2$. Also, the switch element whose gate is connected to the switching wire $\phi 2$ is connected to a video signal line $DL_1$, and the switch element whose gate is connected to the switching wire $\phi 3$ is connected to a video signal line $DL_3$.

Also, among three switch elements connected to another video signal input terminal $DT_2$, the switch element whose gate is connected to the switching wire $\phi 1$ is connected to a video signal line $DL_5$. Also, the switch element whose gate is connected to the switching wire $\phi 2$ is connected to a video signal line $DL_6$, and the switch element whose gate is connected to the switching wire $\phi 3$ is connected to a video signal line $DL_4$.

Then, the mode of connection of the two video signal input terminals $DT_1$ and $DT_2$, and six video signal lines $DL_1$ to $DL_6$, forms one unit, and this is repeated.

Figure 8A:
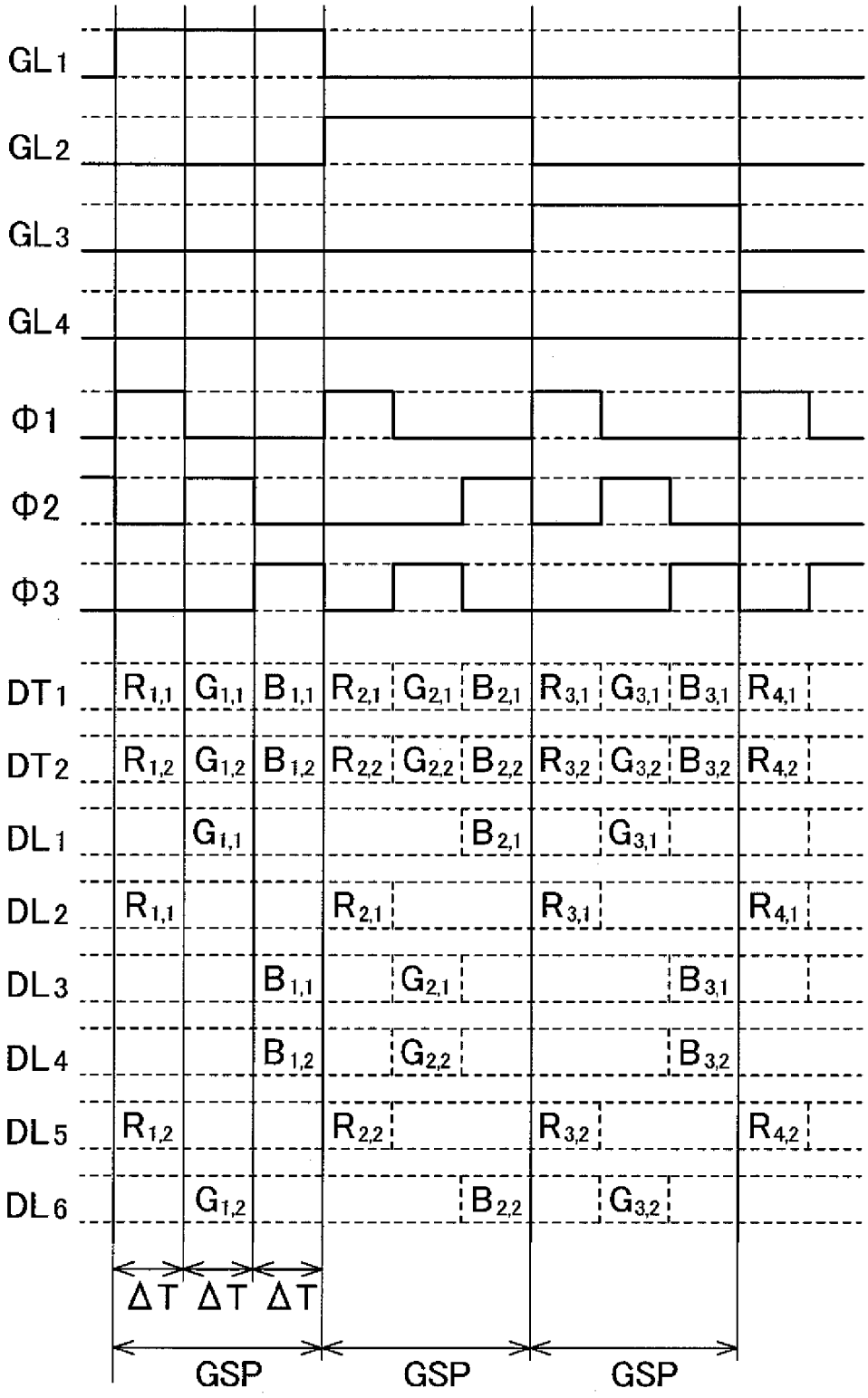
FIG. 8A is a schematic diagram showing one example of a method of driving the liquid crystal display panel of Embodiment 1.
Figure 8B:
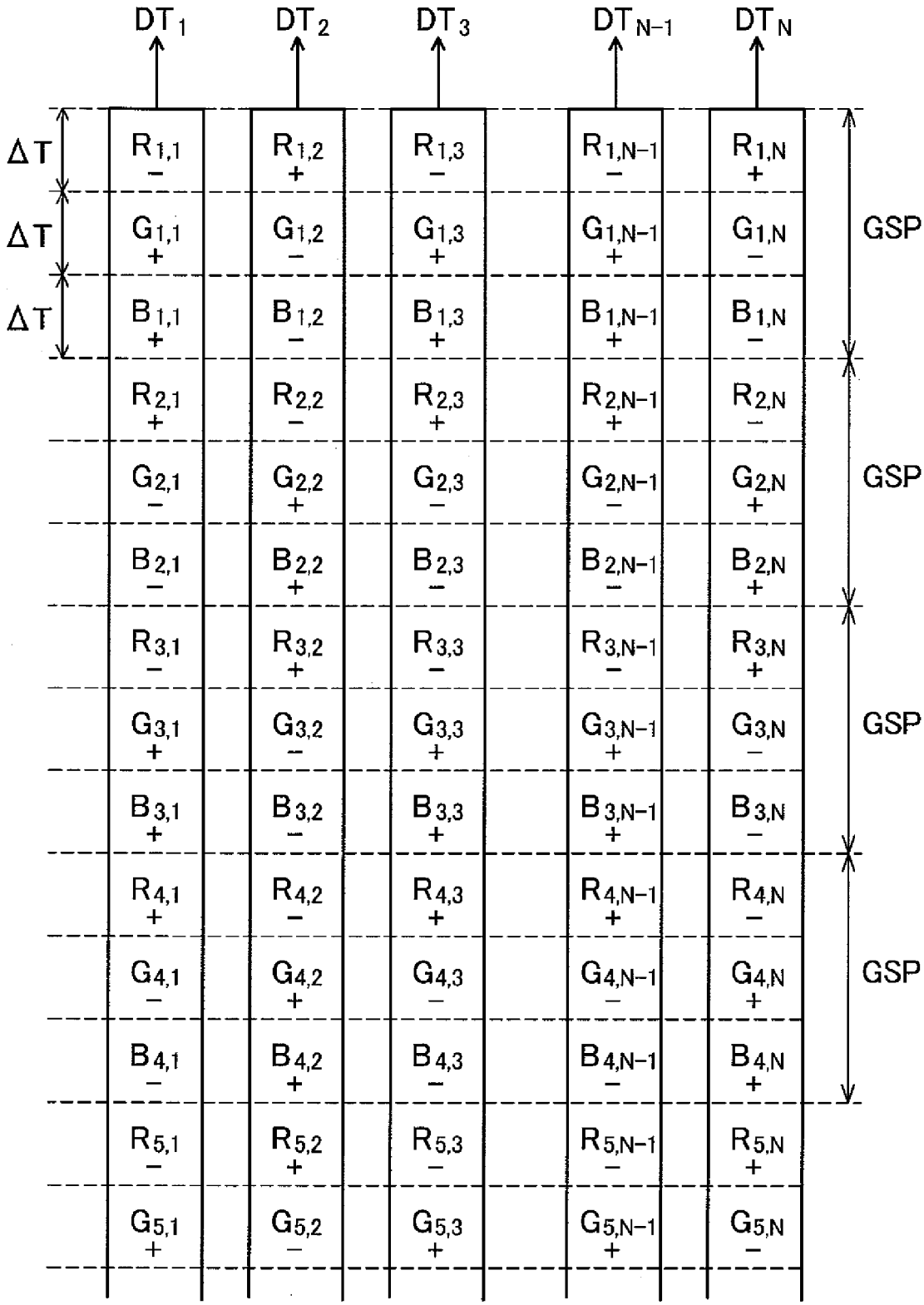
FIG. 8B is a schematic diagram showing one example of video signals applied to video signal input terminals and their polarities.

FIGS. 8A and 8B are schematic diagrams showing one example of a method of driving the liquid crystal display panel of Embodiment 1.

With the liquid crystal display panel of Embodiment 1, signals applied to each scan signal line $GL_m$, each switching wire $\phi 1$, $\phi 2$, and $\phi 3$, and each video signal input terminals $DT_q$, are switched at the kind of timing shown in FIG. 8A. At this time, a configuration is such that a switching signal applied to each switching wire $\phi 1$, $\phi 2$, and $\phi 3$, with two horizontal selection periods as one cycle, attains the H level in the order of $\phi 1$, $\phi 2$, $\phi 3$, $\phi 1$, $\phi 3$, and $\phi 2$ for the one cycle.

One video signal input terminal $DT_1$ and three video signal lines $DL_1$, $DL_2$, and $DL_3$ are connected in the order of $DL_2$, $DL_1$, $DL_3$, $DL_2$, $DL_3$, and $DL_1$ for one cycle (two horizontal selection periods). Also, the video signal input terminal $DT_2$ and three video signal lines $DL_4$, $DL_5$, and $DL_6$ are connected in the order of $DL_5$, $DL_6$, $DL_4$, $DL_5$, $DL_4$, and $DL_6$ for one cycle (two horizontal selection periods). Consequently, gradation voltages are input into each of the video signal input terminals $DL_1$ and $DL_2$ in the kind of order shown in FIG. 8A.

Also, although not shown, gradation voltages are also input into each of the remaining video signal input terminals $DL_3$ to $DL_N$ in the same kind of order.

At this time, the polarities of gradation voltages input into each video signal input terminal $DT_q$ are shown in FIG. 8B. As shown in FIG. 8B, it being possible to reduce the frequency of polarity reversal of gradation voltages applied to one video signal input terminal $DT_q$ to one third of the reversal frequency in the heretofore known drive method shown in FIG. 3B, it is possible to reduce the power consumption of the drive circuit 3. Consequently, with a liquid crystal display device having the liquid crystal display panel of Embodiment 1, it is possible to balance the enhancement in image quality and the reduction in power consumption.

Embodiment 2

Figure 9:
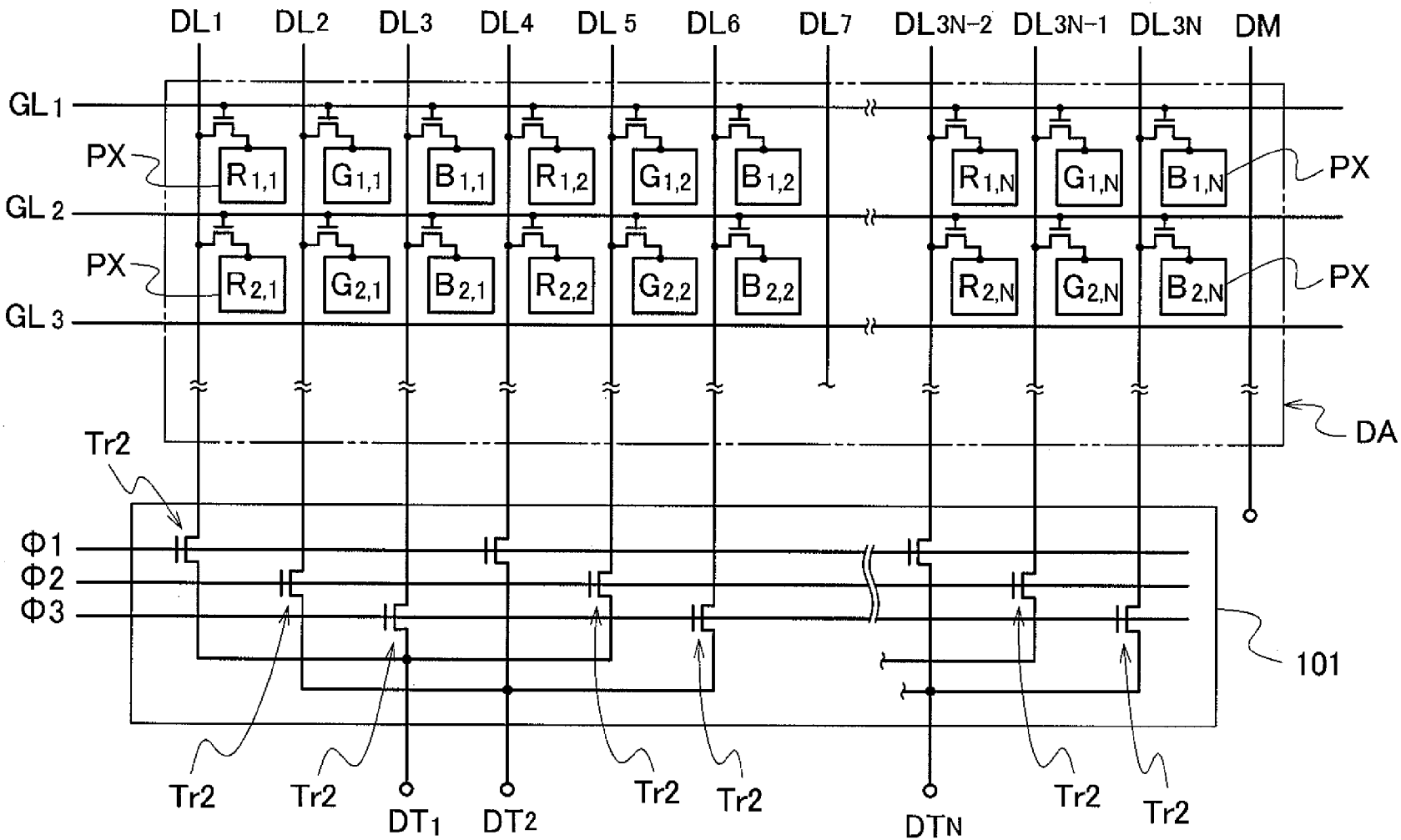
FIG. 9 is a schematic diagram showing one example of an outline configuration of a liquid crystal display panel of Embodiment 2 of the invention.

FIG. 9 is a schematic diagram showing one example of an outline configuration of a liquid crystal display panel of Embodiment 2 of the invention.

With the liquid crystal display panel of Embodiment 2, the configuration of a display area DA is the same as the configuration of that of a heretofore known liquid crystal display panel (for example, the configuration shown in FIG. 2A).

As opposed to this, with the configuration of a switch circuit 101 in the liquid crystal display panel of Embodiment 2, as shown in FIG. 9, three video signal lines $DL_1$, $DL_3$, and $DL_5$ connected to one video signal input terminal $DT_1$, and three video signal lines $DL_2$, $DL_4$, and $DL_6$ connected to another video signal input terminal $DT_2$, are alternated.

At this time, the gates of switch elements connected to the three video signal lines $DL_1$, $DL_3$, and $DL_5$ are connected to switch wires $\phi 1$, $\phi 3$, and $\phi 2$, respectively. Also, at this time, the gates of switch elements connected to the three video signal lines $DL_2$, $DL_4$, and $DL_6$ are connected to switch wires $\phi 2$, $\phi 1$, and $\phi 3$, respectively. Then, with the liquid crystal display panel of Embodiment 2, the mode of connection of the two video signal input terminals $DT_1$ and $DT_2$, and six video signal lines $DL_1$ to $DL_6$, forms one unit, and this is repeated.

Figure 10A:
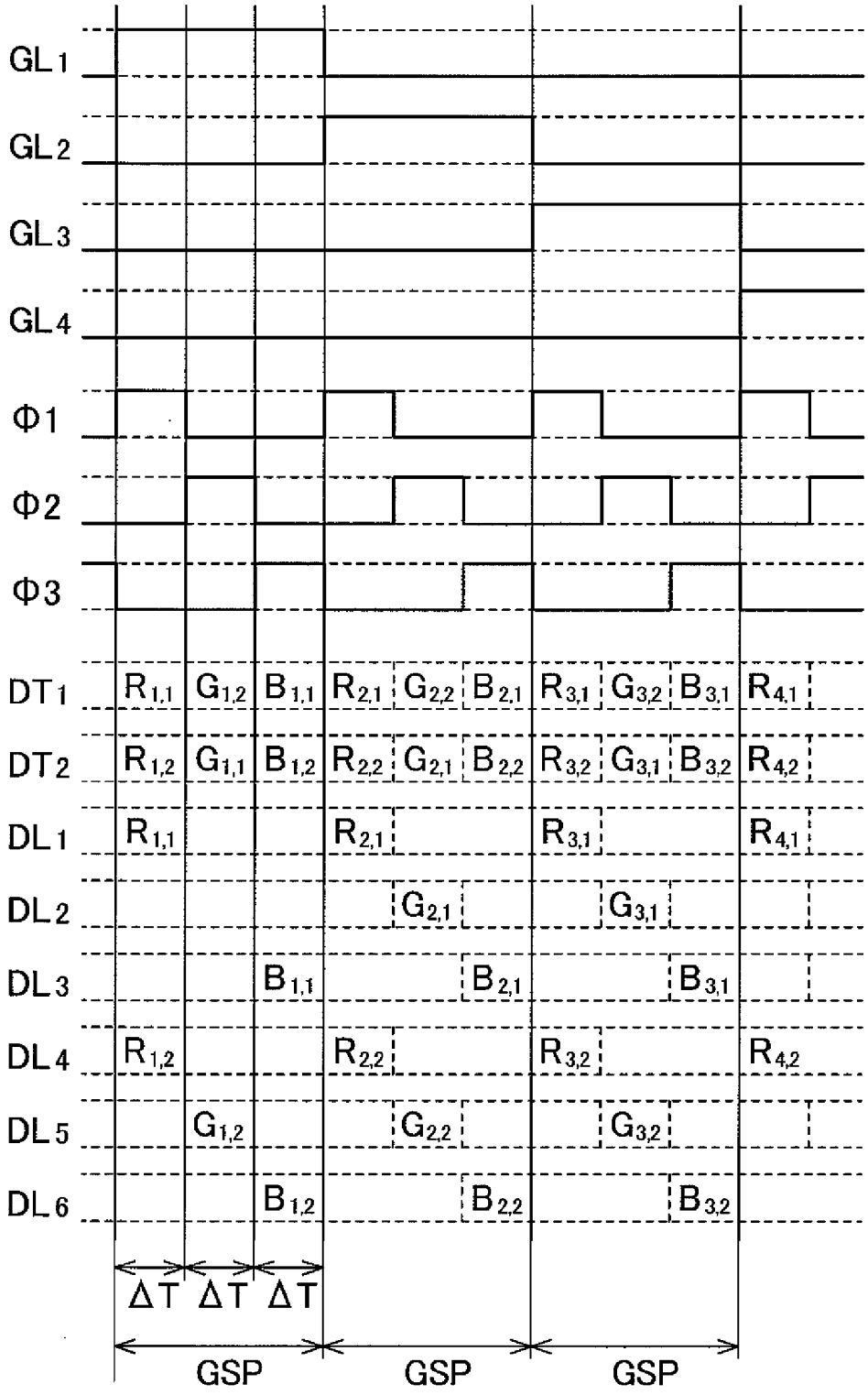
FIG. 10A is a schematic diagram showing one example of a method of driving the liquid crystal display panel of Embodiment 2.
Figure 10B:
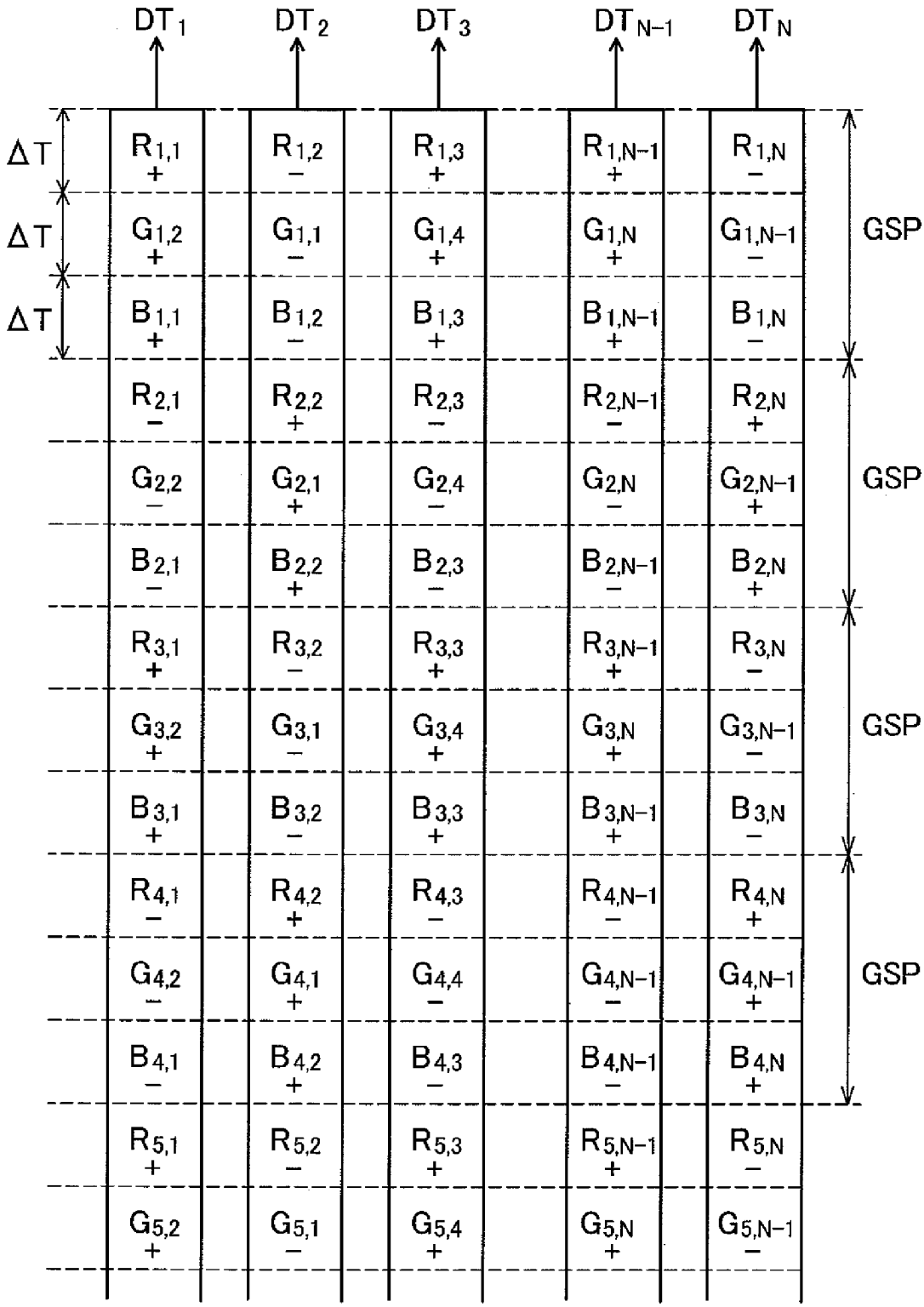
FIG. 10B is a schematic diagram showing one example of gradation voltages applied to video signal input terminals and their polarities.

FIG. 10A is a schematic diagram showing one example of a method of driving the liquid crystal display panel of Embodiment 2. FIG. 10B is a schematic diagram showing one example of gradation voltages applied to video signal input terminals and their polarities.

When driving the liquid crystal display panel of Embodiment 2, signals applied to each scan signal line $GL_m$, each switching wire $\phi 1$, $\phi 2$, and $\phi 3$, and each video signal input terminal $DT_q$ are switched at the kind of timing shown in FIG. 10A.

At this time, one video signal input terminal $DT_1$ and three video signal lines $DL_1$, $DL_3$, and $DL_5$ are connected in the order of $DL_1$, $DL_5$, and $DL_3$ for one cycle (one horizontal selection period). Also, at this time, another video signal input terminal $DT_2$ and three video signal lines $DL_2$, $DL_4$, and $DL_6$ are connected in the order of $DL_4$, $DL_2$, and $DL_6$ for one cycle (one horizontal selection period). Consequently, gradation voltages are input into each of the video signal input terminals $DT_1$ and $DT_2$ in the kind of order shown in FIG. 10A.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are shown in FIG. 10B. As shown in FIG. 10B, it being possible to reduce the frequency of polarity reversal of gradation voltages applied to one video signal input terminal $DT_q$ to one third of the reversal frequency in the heretofore known drive method shown in FIG. 3B, it is possible to reduce the power consumption of the drive circuit 3. Consequently, with a liquid crystal display device having the liquid crystal display panel of Embodiment 2, it is possible to balance the enhancement in image quality and the reduction in power consumption.

Figure 11:
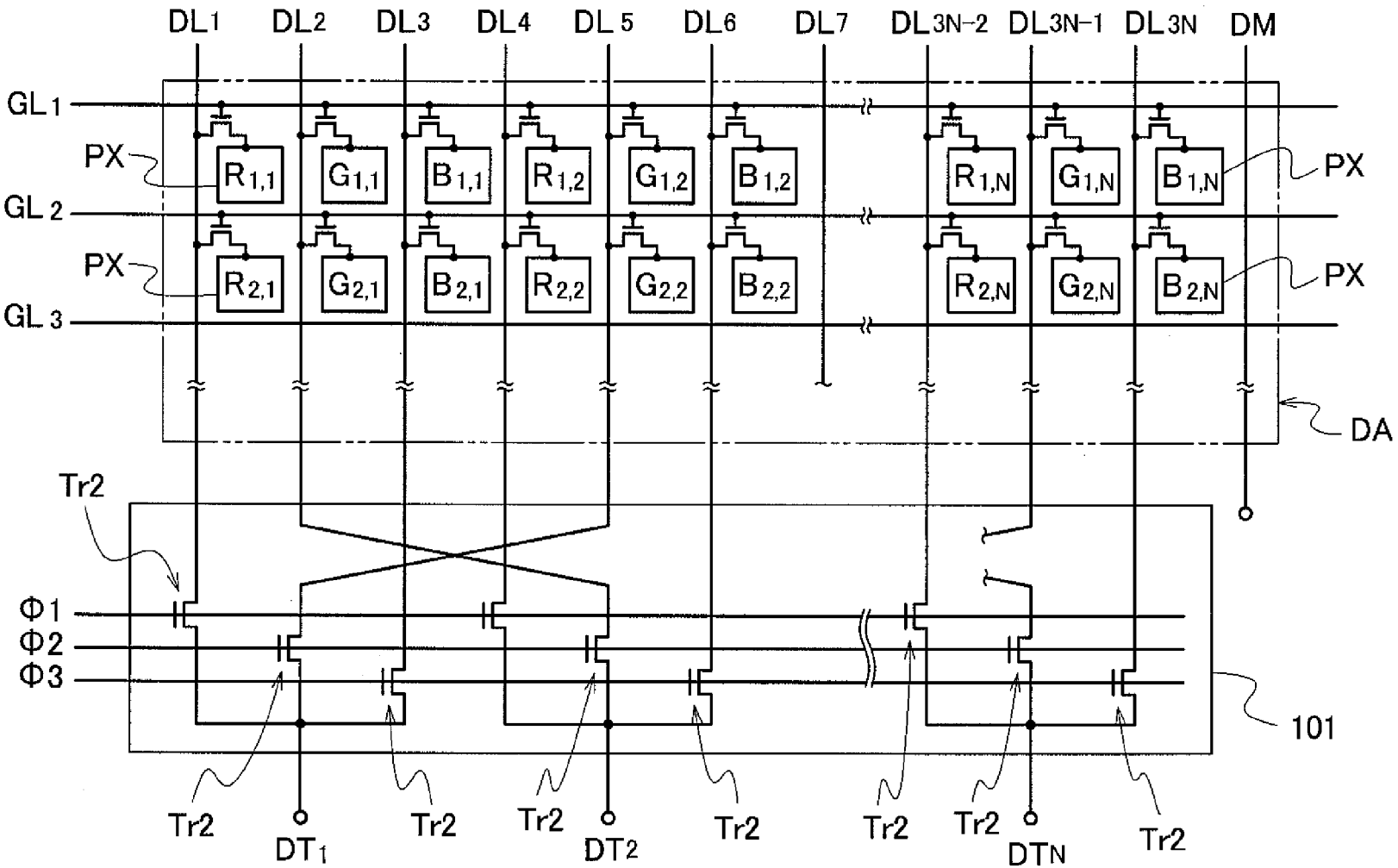
FIG. 11 is a schematic diagram showing one example of a modification example of the liquid crystal display panel of Embodiment 2.

FIG. 11 is a schematic diagram showing one example of a modification example of the liquid crystal display panel of Embodiment 2.

In the example shown in FIG. 9, video signal input lines between switch elements Tr2 and video signal input terminals $DT_q$ are intersected but, in the liquid crystal display panel of Embodiment 2, this not being limiting, needless to say, it is also acceptable that, for example, as shown in FIG. 11, video signal lines DL are intersected.

Embodiment 3

Figure 12:
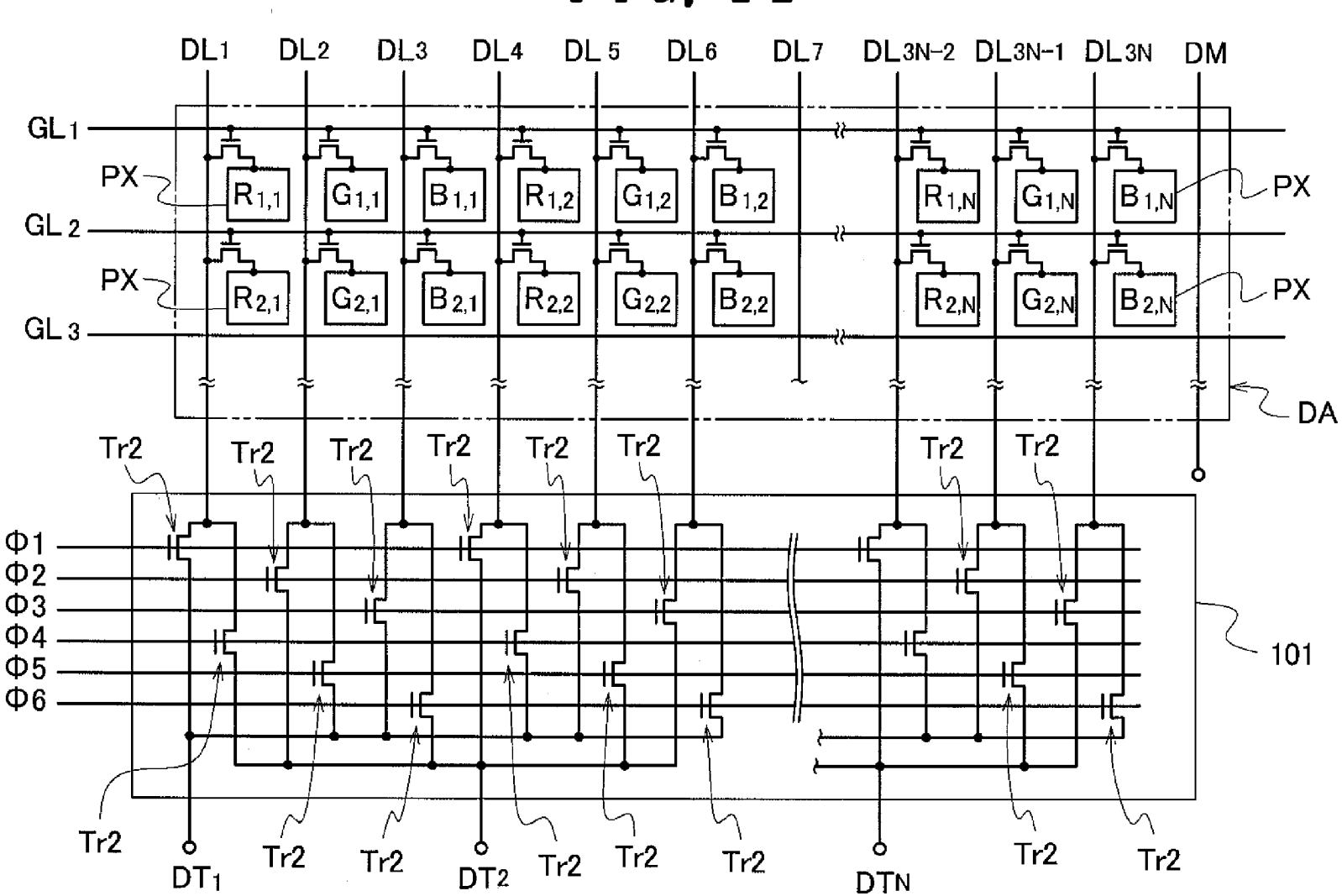
FIG. 12 is a schematic diagram showing one example of an outline configuration of a liquid crystal display panel of Embodiment 3 of the invention.

FIG. 12 is a schematic diagram showing one example of an outline configuration of a liquid crystal display panel of Embodiment 3.

With the configuration of a switch circuit 101 in the liquid crystal display panel of Embodiment 3, as shown in FIG. 12, six video signal lines $DL_1$ to $DL_6$ are connected to a first video signal input terminal $DT_1$ via switch elements Tr2, and connected to a second video signal input terminal $DT_2$ via other switch elements Tr2.

At this time, six switching wires $\phi 1$ to $\phi 6$ being provided in the switch circuit 101, the switching wires to which are connected the gates of the switch elements Tr2 connected to the video signal input terminal $DT_1$ differ from one another. In the same way, the switching wires to which are connected the gates of the second switch elements Tr2 connected to the video signal input terminal $DT_2$ differ from one another.

Then, with the liquid crystal display panel of Embodiment 3, the mode of connection of the two video signal input terminals $DT_1$ and $DT_2$, and six video signal lines $DL_1$ to $DL_6$, forms one unit, and this is repeated.

Figure 13A:
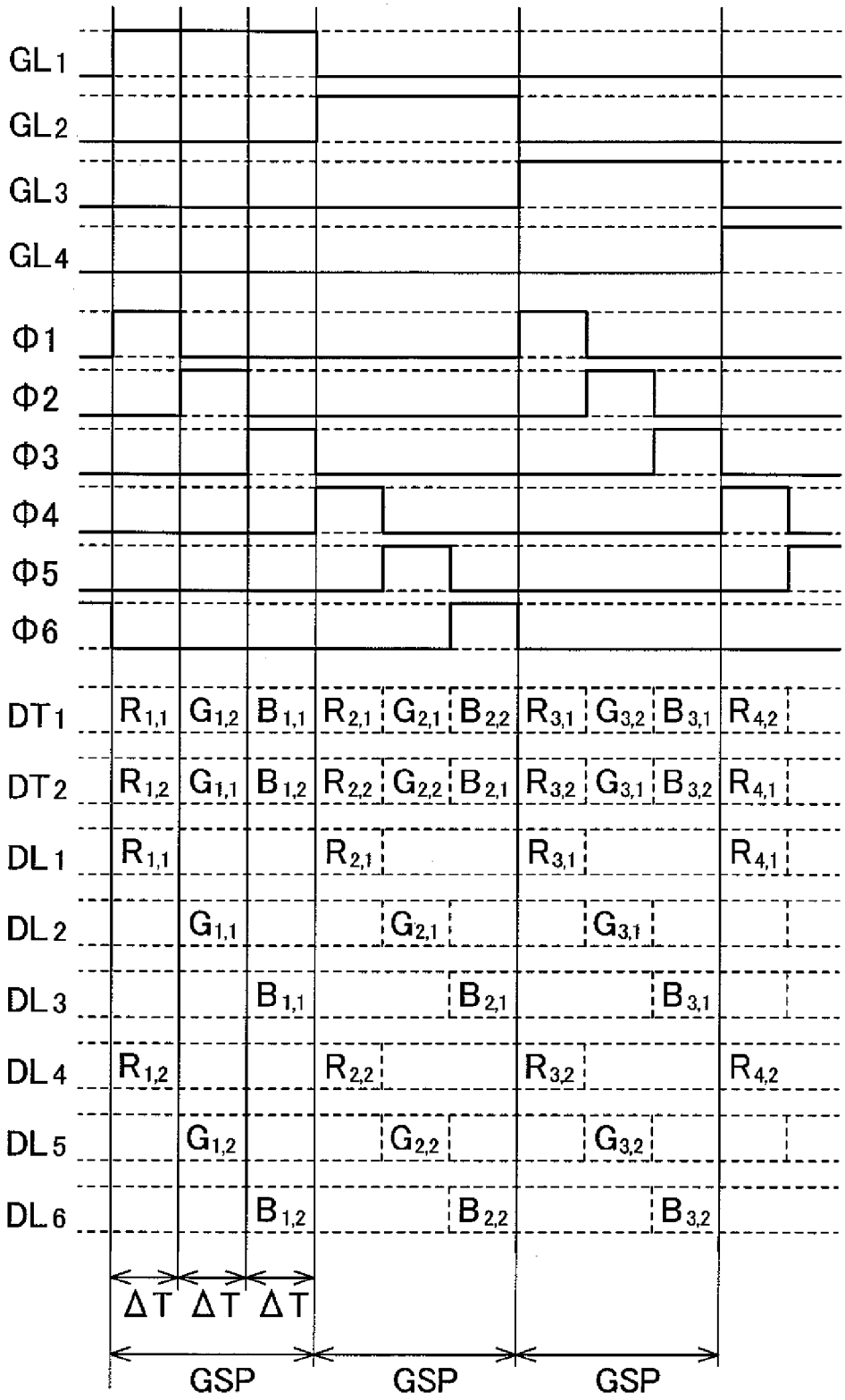
FIG. 13A is a schematic diagram showing one example of a method of driving the liquid crystal display panel of Embodiment 3.
Figure 13B:
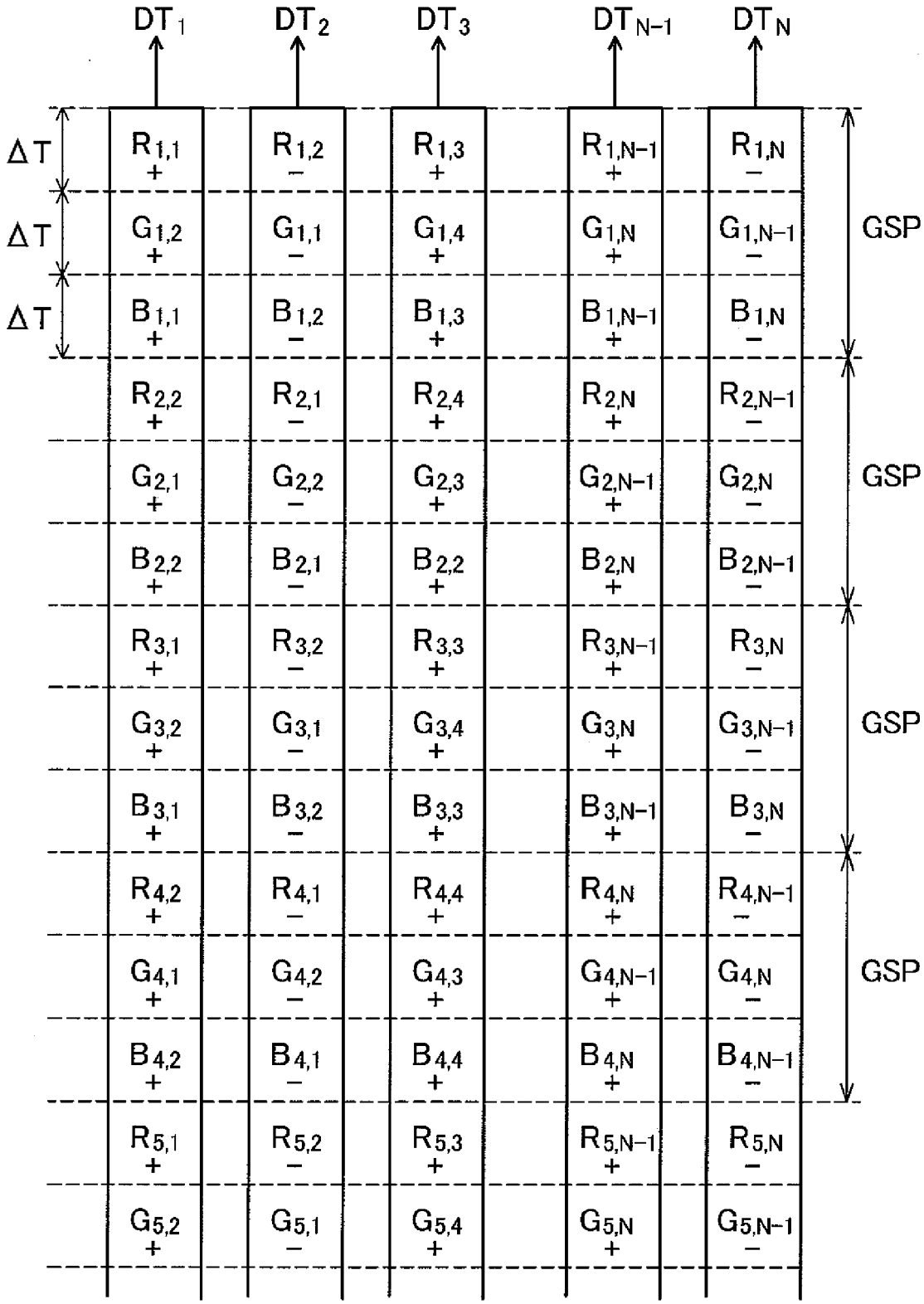
FIG. 13B is a schematic diagram showing one example of gradation voltages applied to video signal input terminals and their polarities.

FIG. 13A is a schematic diagram showing one example of a method of driving the liquid crystal display panel of Embodiment 3. FIG. 13B is a schematic diagram showing one example of gradation voltages applied to video signal input terminals and their polarities.

When driving the liquid crystal display panel of Embodiment 3, signals applied to each scan signal line $GL_m$, each switching wire $\phi$1 to $\phi$6, and each video signal input terminal $DT_q$ are switched in the kind of order shown in FIG. 13A. At this time, a configuration is such that a switching signal applied to each switching wire, with two horizontal selection periods as one cycle, attains the H level in the order of $\phi$1, $\phi$2, $\phi$3, $\phi$4, $\phi$5, and $\phi$6 for the one cycle.

At this time, the first video signal input terminal $DT_1$ and six video signal lines $DL_1$ to $DL_6$ are connected in the order of $DL_1$, $DL_5$, $DL_3$, $DL_4$, $DL_2$, and $DL_6$ for one cycle (two horizontal selection periods). Also, at this time, the second video signal input terminal $DT_2$ and six video signal lines $DL_1$ to $DL_6$ are connected in the order of $DL_4$, $DL_2$, $DL_6$, $DL_1$, $DL_5$, and $DL_3$ for one cycle (two horizontal selection periods). Consequently, gradation voltages are input into each of the video signal input terminals $DT_1$ and $DT_2$ in the kind of order shown in FIG. 13A.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are shown in FIG. 13B. As shown in FIG. 13B, it being possible to make all the polarities of gradation voltages input into one video signal input terminal $DT_q$ for one frame period the same polarity, it is possible to reduce the frequency of polarity reversal of gradation voltages applied to one video signal input terminal $DT_q$ to a rate of once per frame period. That is, with Embodiment 3, it is possible, in the drive circuit 3, to apply the dot inversion drive to the liquid crystal display panel while generating gradation voltages corresponding to a line inversion drive. Consequently, with a liquid crystal display device having the liquid crystal display panel of Embodiment 3, it is possible to balance the enhancement in image quality and the reduction in power consumption.

Embodiment 4

Figure 14:
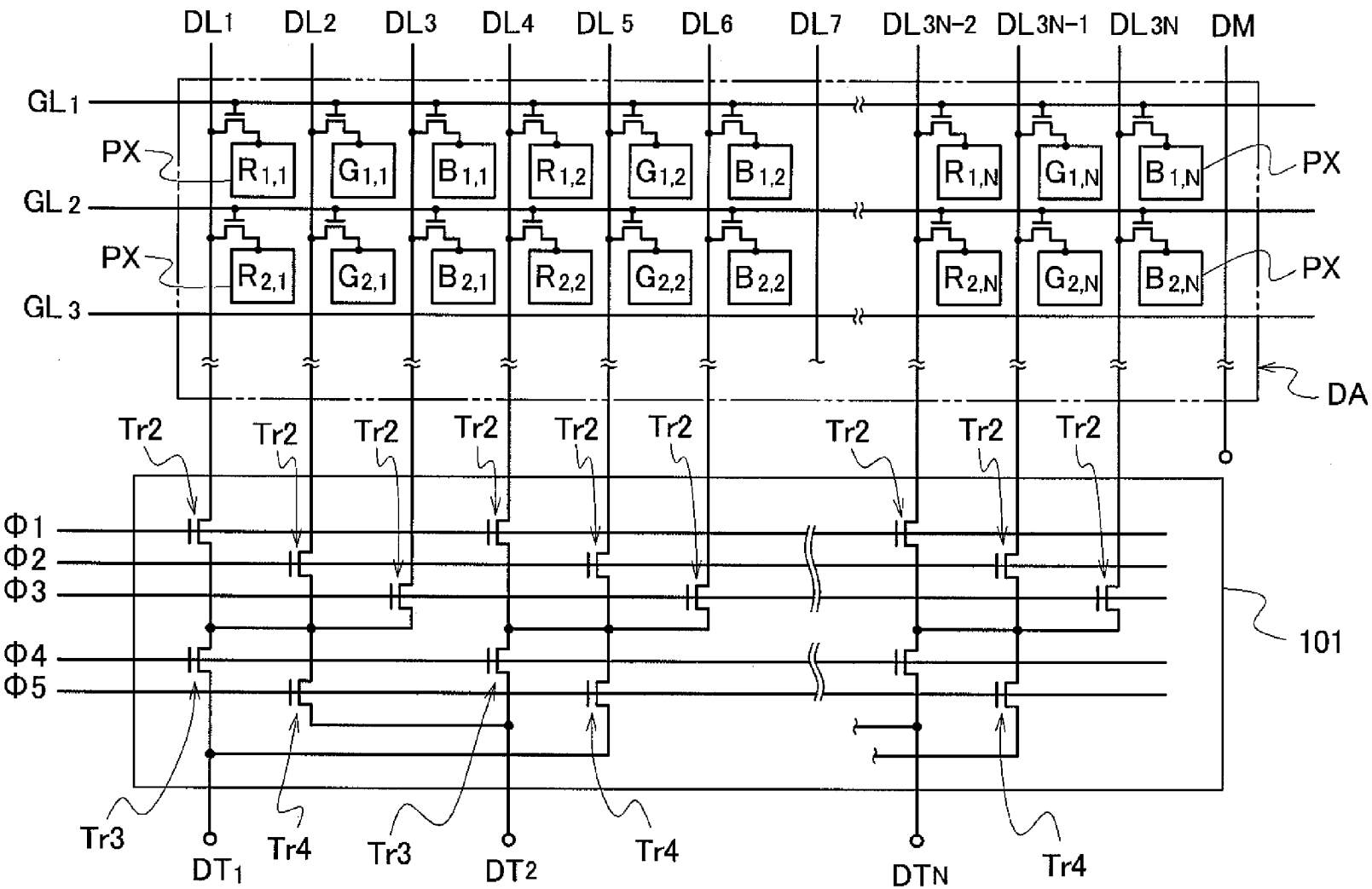
FIG. 14 is a schematic diagram showing one example of an outline configuration of a liquid crystal display panel of Embodiment 4 of the invention.

FIG. 14 is a schematic diagram showing one example of an outline configuration of a liquid crystal display panel of Embodiment 4 of the invention.

As the configuration of a switch circuit 101 in the liquid crystal display panel of Embodiment 4, as shown in FIG. 14, one video signal line $DL_n$ is connected to a first video signal input terminal $DT_1$ via a first switch element Tr2 and a second switch element Tr3, and connected to a second video signal input terminal $DT_2$ via the first switch element Tr2 and a third switch element Tr4.

The first switch elements Tr2 connected to six video signal lines $DL_1$ to $DL_6$ connected to the first video signal input terminal $DT_1$ and second video input terminal $DT_2$ are switch elements whose gates are connected one to each switching wire $\phi$1 to $\phi$3.

Also, the second switch elements Tr3 are switch elements whose gates are connected to a switching wire $\phi$4, and the third switch elements Tr4 are switch elements whose gates are connected to a switching wire $\phi$5.

At this time, the gates of three first switch elements Tr2 connected to a pair of a second switch element Tr3 and third switch element Tr4 are connected to differing switching wires (one to each of $\phi$1 to $\phi$3). Then, with the liquid crystal display panel of Embodiment 4, the mode of connection of the two video signal input terminals $DT_1$ and $DT_2$, and six video signal lines $DL_1$ to $DL_6$, forms one unit, and this is repeated.

Figure 15:
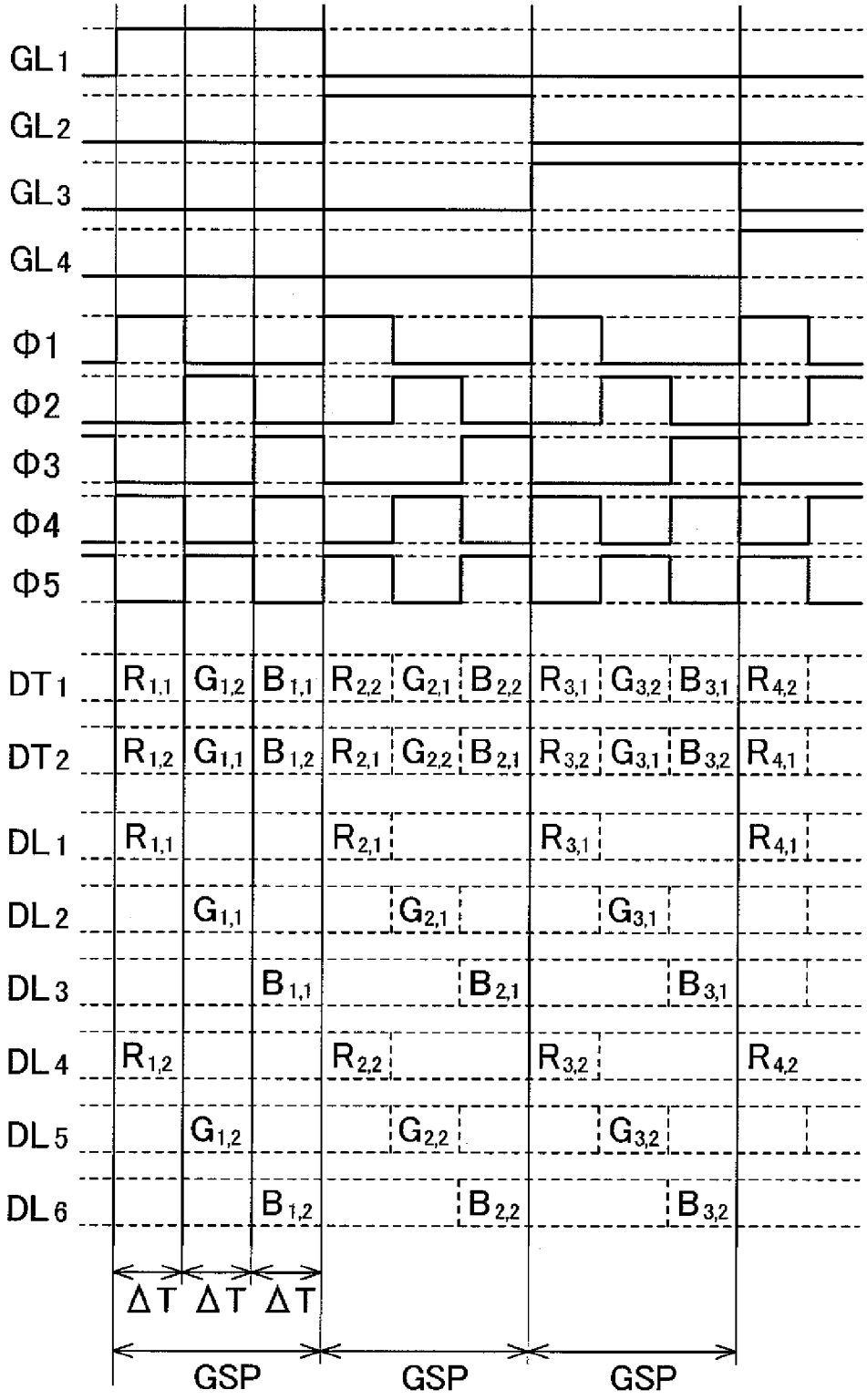
FIG. 15 is a schematic diagram showing one example of a method of driving the liquid crystal display panel of Embodiment 4.

FIG. 15 is a schematic diagram showing one example of a method of driving the liquid crystal display panel of Embodiment 4.

When driving the liquid crystal display panel of Embodiment 4, signals applied to each scan signal line $GL_m$, each switching wire $\phi$1 to $\phi$5, and each video signal input terminal $DL_q$ are switched at the kind of timing shown in FIG. 15. At this time, a configuration is such that, a switching signal applied to each switching wire $\phi$1 to $\phi$5 having two horizontal selection periods as one cycle, the switching signals applied to the switching wires $\phi$1, $\phi$2, and $\phi$3 attain the H level in the order of $\phi$1, $\phi$2, $\phi$3, $\phi$1, $\phi$2, and $\phi$3 for the one cycle. Also, a configuration is such that the switching signals applied to the switching wires $\phi$4 and $\phi$5 attain the H level in the order of $\phi$4, $\phi$5, $\phi$4, $\phi$5, $\phi$4, and $\phi$5 for one cycle (two horizontal selection periods).

At this time, the first video signal input terminal $DT_1$ and six video signal lines $DL_1$ to $DL_6$ are connected in the order of $DL_1$, $DL_5$, $DL_3$, $DL_4$, $DL_2$, and $DL_6$ for one cycle (two horizontal selection periods). Also, at this time, the second video signal input terminal $DT_2$ and six video signal lines $DL_1$ to $DL_6$ are connected in the order of $DL_4$, $DL_2$, $DL_6$, $DL_1$, $DL_5$, and $DL_3$ for one cycle (two horizontal selection periods). Consequently, gradation voltages are input into each of the video signal input terminals $DT_1$ and $DT_2$ in the kind of order shown in FIG. 15.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are made the polarities shown in FIG. 13B. By this means, with Embodiment 4, it is possible to make all the polarities of gradation voltages input into one video signal input terminal $DT_q$ for one frame period the same polarity. Consequently, with Embodiment 4, in the same way as with Embodiment 3, it is possible to balance the enhancement in image quality and the reduction in power consumption.

Figure 16:
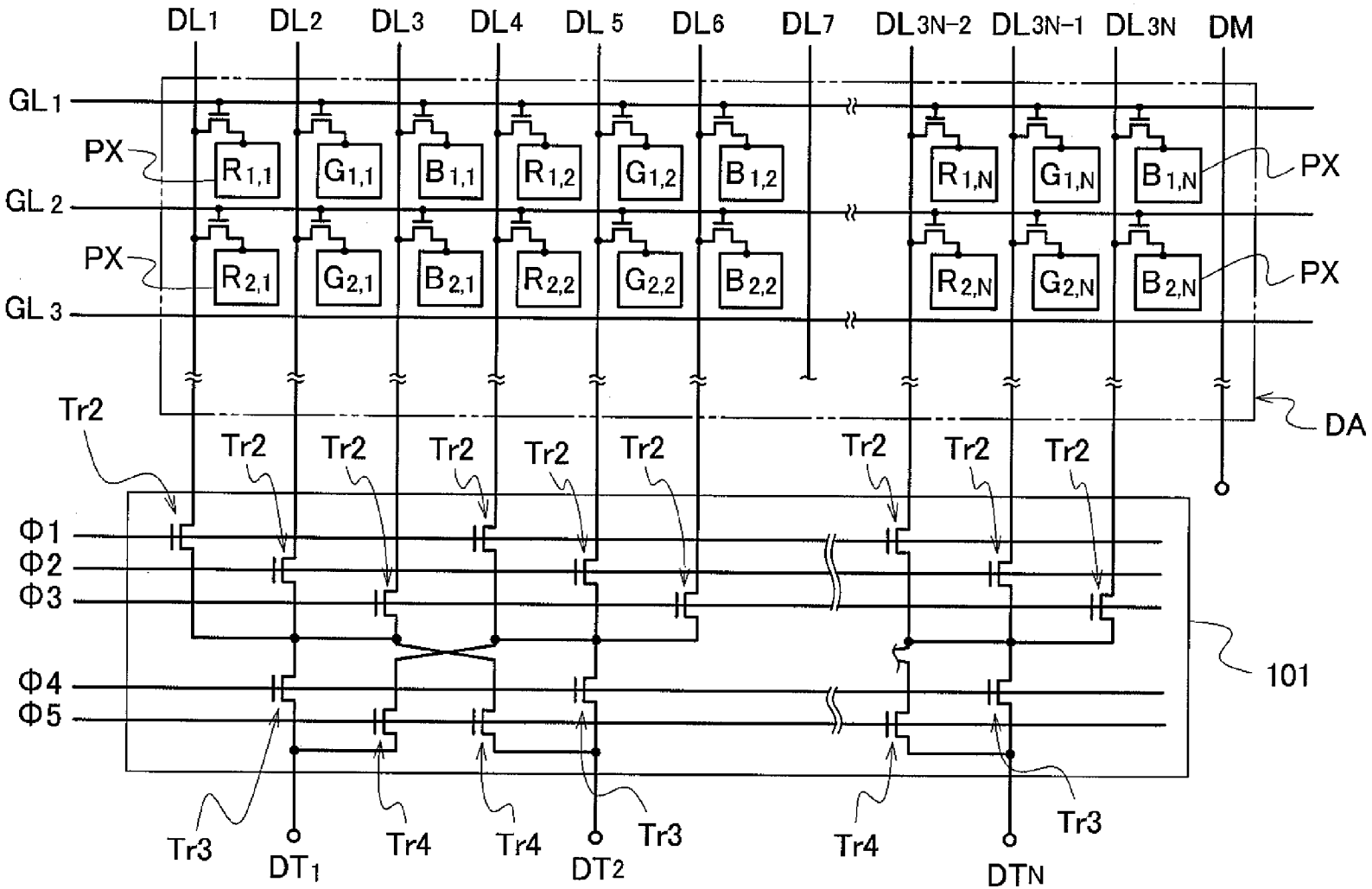
FIG. 16 is a schematic diagram showing one example of a modification example of the liquid crystal display panel of Embodiment 4.

FIG. 16 is a schematic diagram showing one example of a modification example of the liquid crystal display panel of Embodiment 4.

In the example shown in FIG. 14, video signal input lines between one second switch element Tr3 and one third switch element Tr4, and one video signal input terminal $DT_q$, are intersected but, with the liquid crystal display panel of Embodiment 4, this not being limiting, it is also acceptable that, for example, as shown in FIG. 16, lines connecting first switch elements Tr2 and third switch elements Tr4 are intersected between the switching wire $\phi$3 and switching wire $\phi$4.

Embodiment 5

Figure 17:
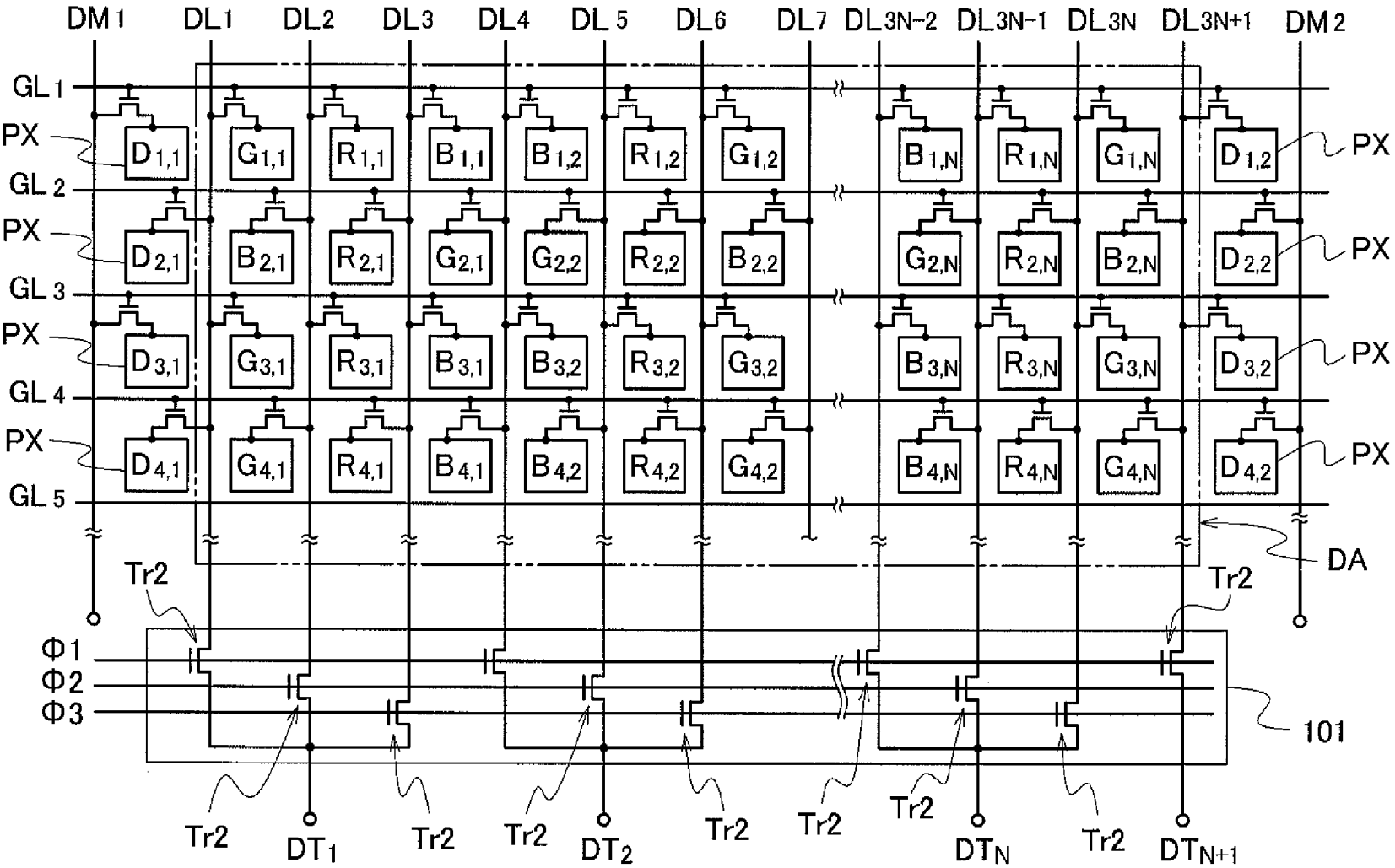
FIG. 17 is a schematic diagram showing one example of an outline configuration of a liquid crystal display panel of Embodiment 5 of the invention.

FIG. 17 is a schematic diagram showing one example of an outline configuration of a liquid crystal display panel of Embodiment 5 of the invention.

The invention can also be applied to a liquid crystal display panel with a configuration such that the disposition of TFT elements Tr1 of individual pixels is called a staggered disposition.

In the case of a configuration such that the disposition of TFT elements Tr1 is called the staggered disposition, as shown in FIG. 17, the positions of a plurality of TFT elements Tr1 connected to one video signal line $DL_n$ change alternately in relation to the one video signal line $DL_n$. That is, among a plurality of pixel electrodes PX aligned between two adjacent video signal lines DL in a direction of extension of the video signal lines DL, pixel electrodes PX connected to one of the two video signal lines DL, and pixel electrodes PX connected to the other video signal line DL, are alternated.

At this time, 3N+1 video signal lines $DL_1$ to $DL_{3N+1}$ pass through a display area DA, and two dummy video signal lines $DM_1$ and $DM_2$ pass in such a way as to sandwich the 3N+1 video signal lines.

Also, at this time, with a switch circuit 101, portions connecting video signal lines $DL_1$ to $DL_{3N}$ and video signal input terminals $DT_1$ to $DT_N$ are of the same configuration as the configuration shown in FIG. 2A, and three successive video signal lines $DL_{3q-2}$, $DL_{3q-1}$, and $DL_{3q}$ are connected to one video signal input terminal $DT_q$ (q=1, 2, 3, . . . , N). Also, a video signal line $DL_{3N+1}$ is connected to a video signal input terminal $DT_{N+1}$ by a switch element Tr2 whose gate is connected to a switching wire ϕ1.

Also, in the liquid crystal display panel of Embodiment 5, gradation voltages $D_{1,1}$, $D_{2,1}$, . . . applied to pixel electrodes PX disposed between the dummy video signal line $DM_1$ and video signal line $DL_1$, and gradation voltages $D_{1,1}$, $D_{2,1}$, . . . applied to pixel electrodes PX disposed between the video signal line $DL_{3N+1}$ and dummy video signal line $DM_2$, are dummy gradation voltages.

Figure 18A:
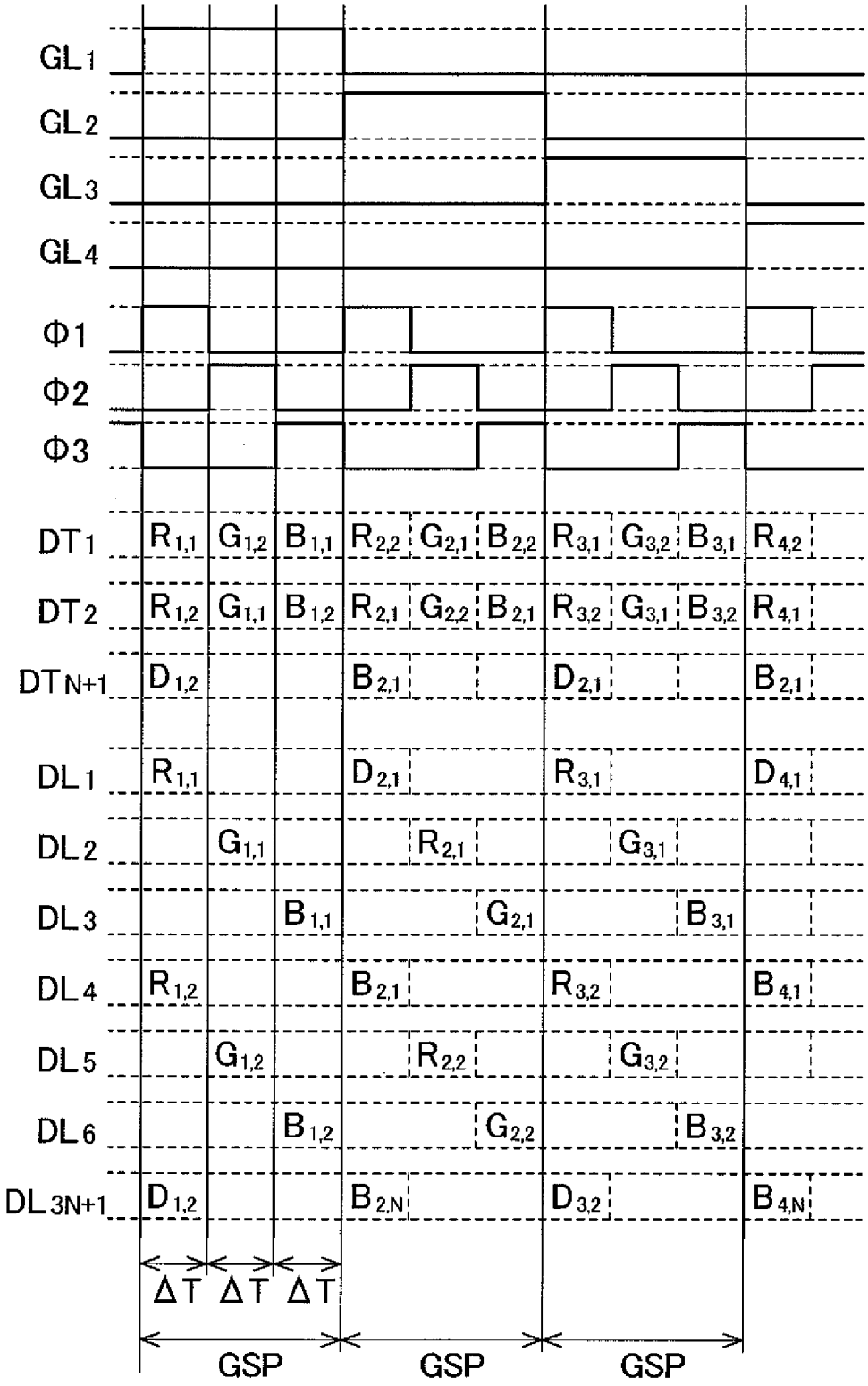
FIG. 18A is a schematic diagram showing one example of a method of driving the liquid crystal display panel of Embodiment 5.
Figure 18B:
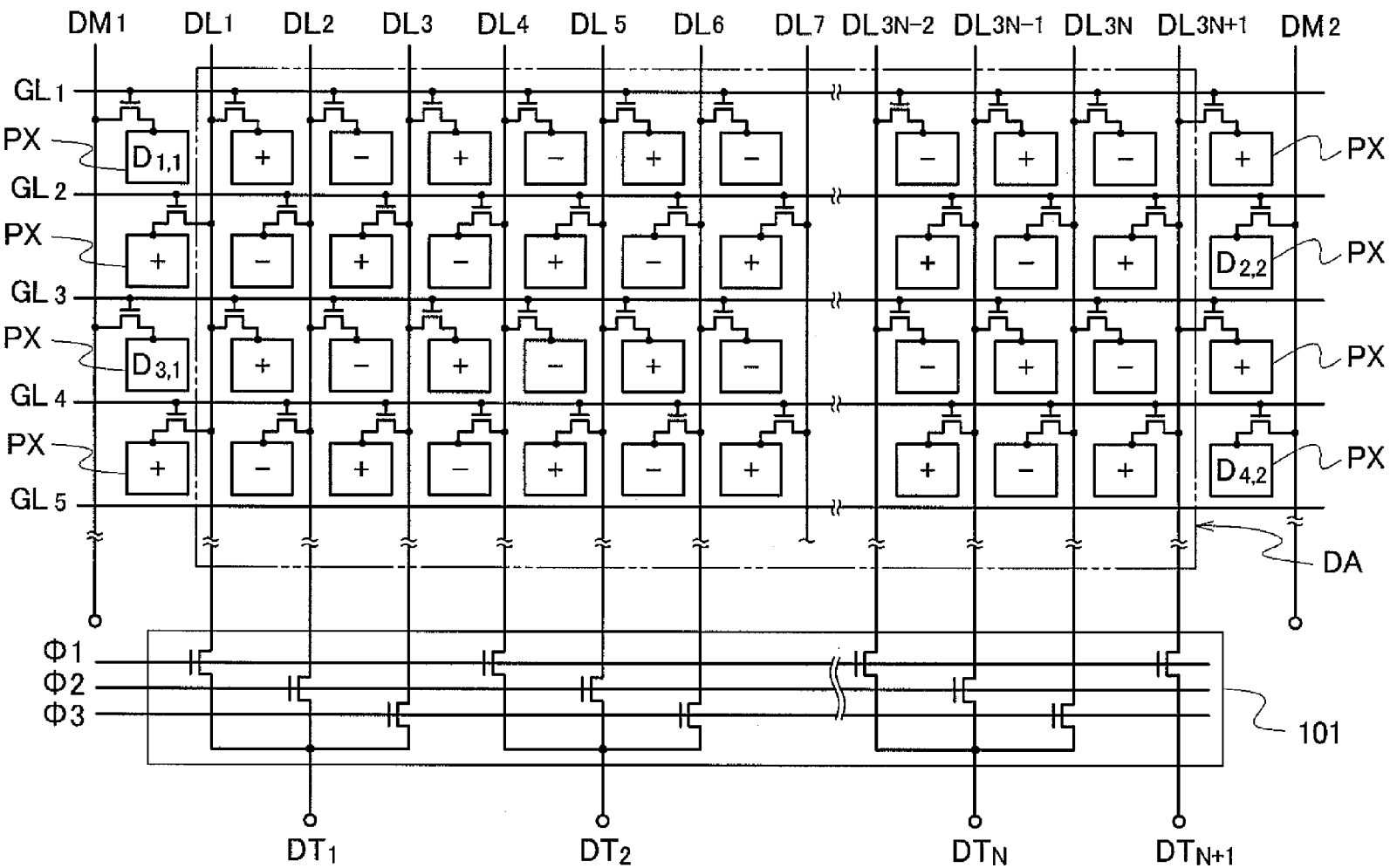
FIG. 18B is a schematic diagram showing one example of the polarities of individual pixel electrodes for one frame period.
Figure 18C:
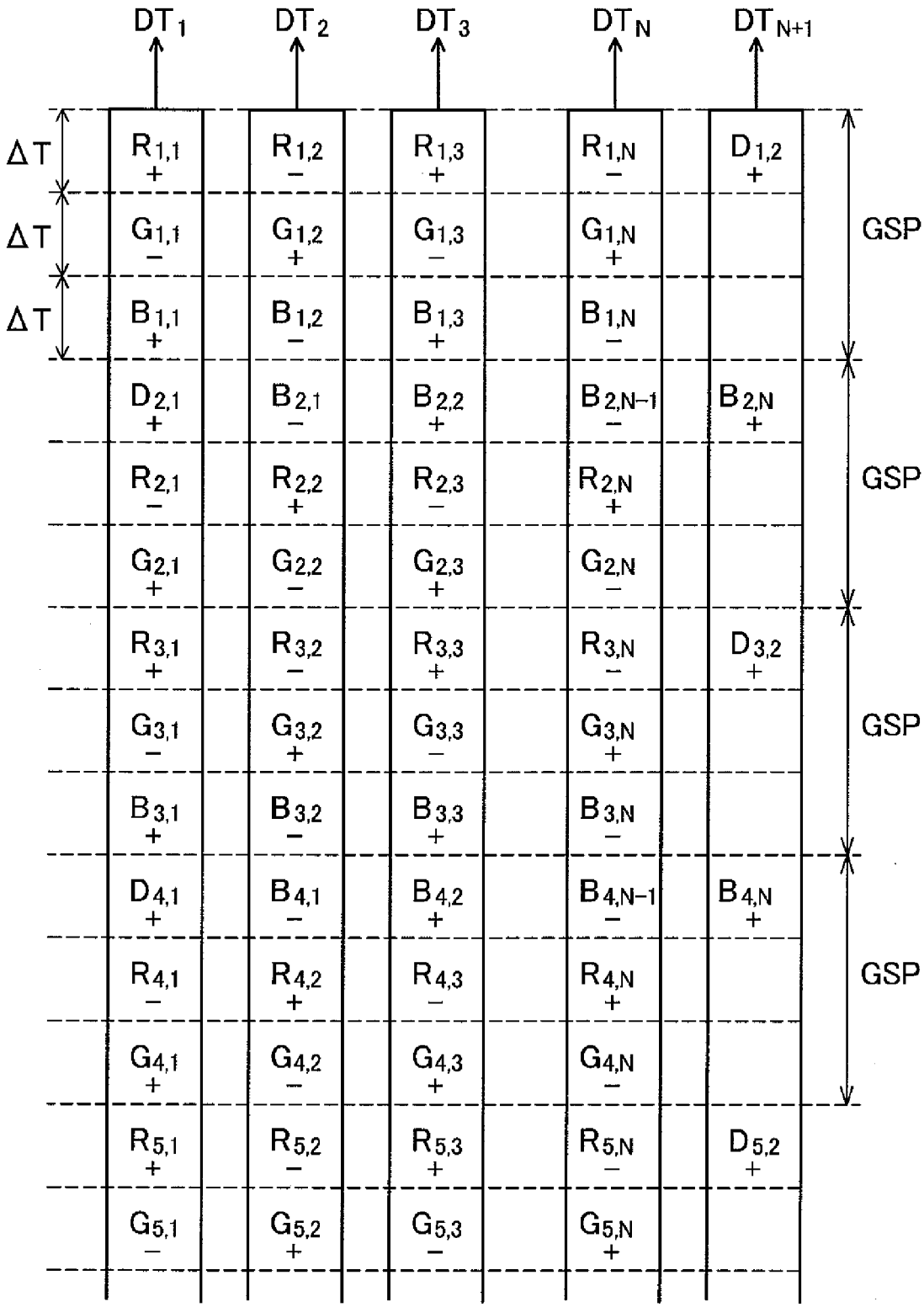
FIG. 18C is a schematic diagram showing one example of gradation voltages applied to video signal input terminals and their polarities.

FIG. 18A is a schematic diagram showing one example of a method of driving the liquid crystal display panel of Embodiment 5. FIG. 18B is a schematic diagram showing one example of the polarities of pixel electrodes for one frame period. FIG. 18C is a schematic diagram showing one example of gradation voltages applied to video signal input terminals and their polarities.

When driving the liquid crystal display panel of Embodiment 5, signals applied to each scan signal line $GL_m$, each switching wire ϕ1, ϕ2, and ϕ3, and each video signal input terminal $DT_q$ are switched at the kind of timing shown in FIG. 18A. At this time, a configuration is such that, a switching signal applied to each switching wire ϕ1, ϕ2, and ϕ3 having one horizontal selection period GSP as one cycle, the switching signals of the switching wires ϕ1, ϕ2, and ϕ3 attain the H level in the order of ϕ1, ϕ2, and ϕ3 for the one cycle.

At this time, one video signal input terminal $DT_1$ and three video signal lines $DL_1$, $DL_2$, and $DL_3$ are connected in the order of $DL_1$, $DL_2$, and $DL_3$ for one cycle (one horizontal selection period). Also, at this time, another video signal input terminal $DT_2$ and three other video signal lines $DL_4$, $DL_5$, and $DL_6$ are connected in the order of $DL_4$, $DL_5$, and $DL_6$ for one cycle. Consequently, gradation voltages are input into each of the video signal input terminals $DT_1$ and $DT_2$ in the kind of order shown in FIG. 18A.

Also, although not shown, gradation voltages are also input into each of the remaining video signal input terminals $DT_3$ to $DT_N$ in the same kind of order.

Also, at this time, a video signal input terminal $DT_{N+1}$ is connected to a video signal line $DL_{3N+1}$ for only a selection time, of one cycle (one horizontal selection period), for which the switching signal of the switching wire ϕ1 attains the H level. For this reason, gradation voltages are input into the video signal input terminal $DT_{N+1}$ for only the selection period for which, for example, the switching signal of the switching wire ϕ1 attains the H level.

At this time, the polarities of individual pixel electrodes PX are shown in FIG. 18B. At this time, the polarities of gradation voltages input into each video signal input terminal $DT_q$ are shown in FIG. 18C. As shown in FIG. 18C, it being possible to reduce the frequency of polarity reversal of gradation voltages applied to one video signal input terminal $DT_q$ to two thirds of the reversal frequency in the heretofore known drive method shown in FIG. 3B, it is possible to reduce the power consumption of the drive circuit 3. Consequently, with Embodiment 5, it is possible to balance the enhancement in image quality and the reduction in power consumption.

Figure 19A:
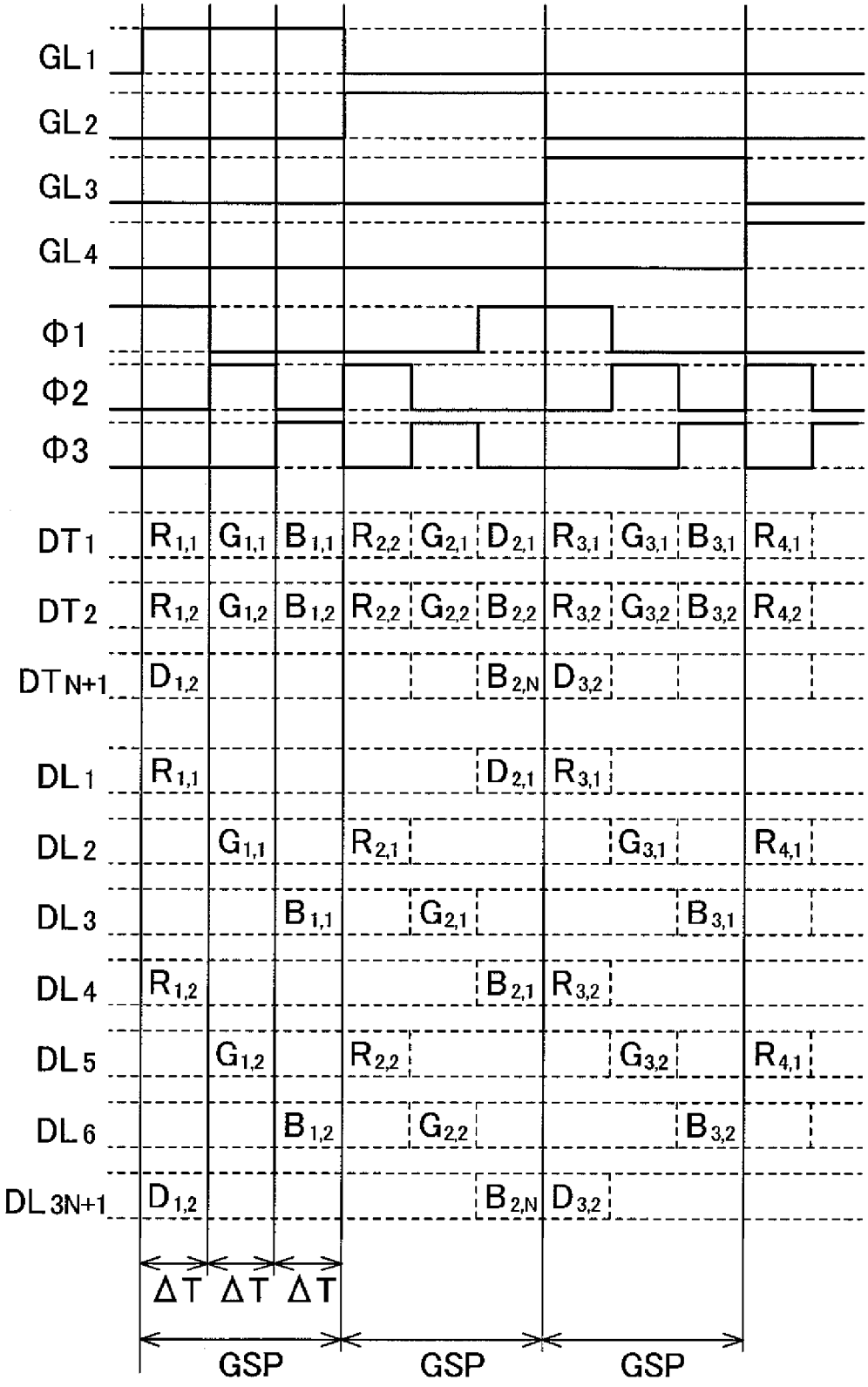
FIG. 19A is a schematic diagram showing one example of a method desirable as the method of driving the liquid crystal display panel of Embodiment 5.
Figure 19B:
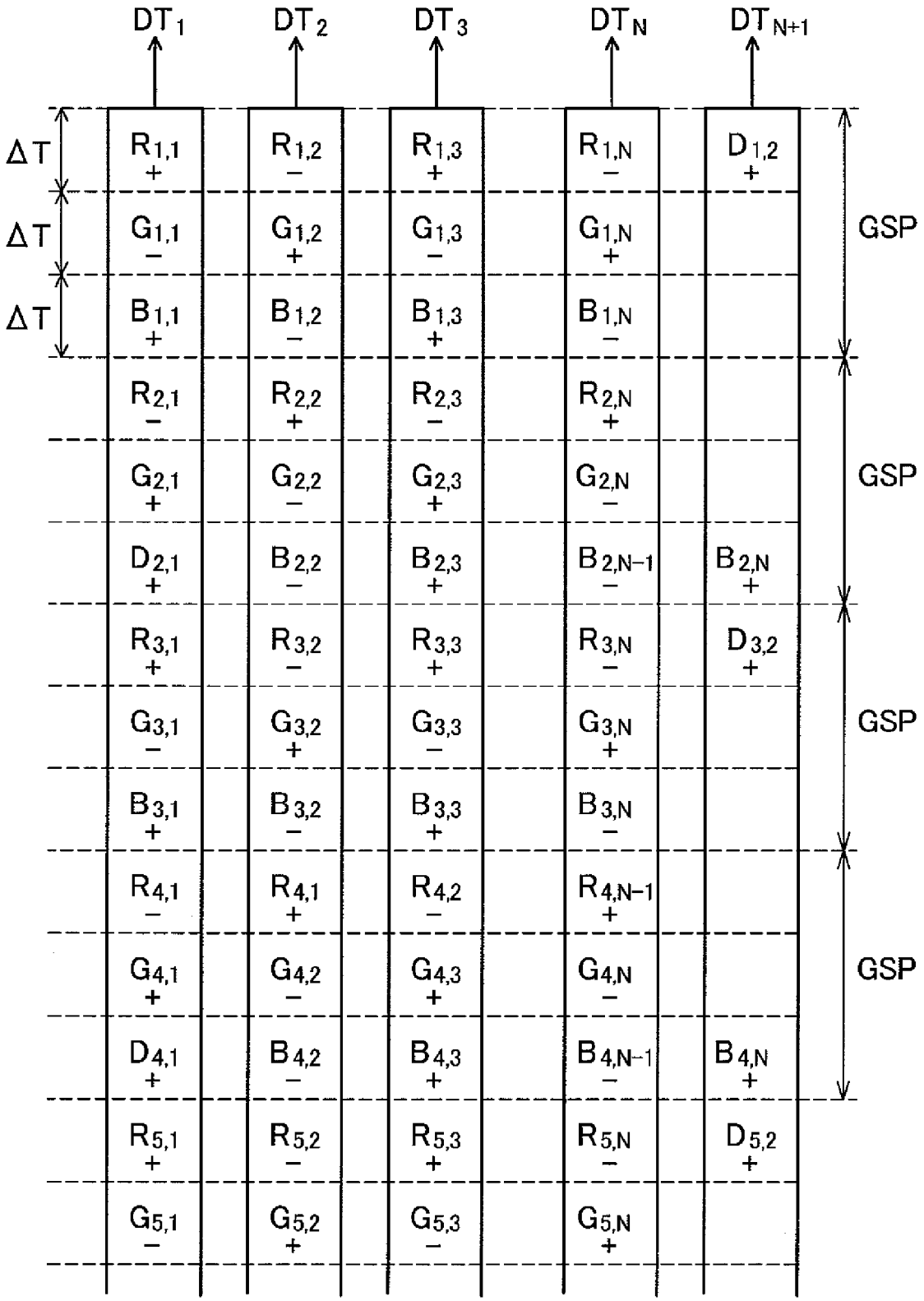
FIG. 19B is a schematic diagram showing one example of gradation voltages applied to video signal input terminals and their polarities.

FIGS. 19A and 19B are schematic diagrams showing one example of another method of driving the liquid crystal display panel of FIG. 17.

When driving the liquid crystal display panel of FIG. 17, it is desirable that signals applied to each scan signal line $GL_m$, each switching wire ϕ1, ϕ2, and ϕ3, and each video signal input terminal $DT_q$ are switched at the kind of timing shown in FIG. 19A. At this time, a configuration is such that, a switching signal applied to each switching wire ϕ1, ϕ2, and ϕ3 having two horizontal selection periods as one cycle, the switching signals of the switching wires ϕ1, ϕ2, and ϕ3 attain the H level in the order of ϕ1, ϕ2, ϕ3, ϕ2, ϕ3, and ϕ1 for the one cycle.

At this time, one video signal input terminal $DT_1$ and three video signal lines $DL_1$, $DL_2$, and $DL_3$ are connected in the order of $DL_1$, $DL_2$, $DL_3$, $DL_2$, $DL_3$, and $DL_1$ for one cycle (two horizontal selection periods). Also, at this time, another video signal input terminal $DT_2$ and three other video signal lines $DL_4$, $DL_5$, and $DL_6$ are connected in the order of $DL_4$, $DL_5$, $DL_6$, $DL_5$, $DL_6$, and $DL_4$ for one cycle. Consequently, gradation voltages are input into each of the video signal input terminals $DT_1$ and $DT_2$ in the kind of order shown in FIG. 19A.

Also, although not shown, gradation voltages are also input into each of the remaining video signal input terminals $DT_3$ to $DT_N$ in the same kind of order.

Also, at this time, a video signal input terminal $DT_{N+1}$ is connected to a video signal line $DL_{3N+1}$ for only a selection time, of one cycle (one horizontal selection period), for which the switching signal of the switching wire ϕ1 attains the H level. For this reason, gradation voltages are input into the video signal input terminal $DT_{N+1}$ for only the selection period for which, for example, the switching signal of the switching wire ϕ1 attains the H level.

At this time, the polarities of gradation voltages input into each video signal input terminal are shown in FIG. 19B. When the liquid crystal display panel is driven by the kind of method shown in FIGS. 19A and 19B, it is possible to reduce the frequency of polarity reversal of gradation voltages applied to one video signal input terminal to two thirds of the reversal frequency in the drive method shown in FIG. 3B. Consequently, with a liquid crystal display device having the liquid crystal display panel of FIG. 17, by driving the liquid crystal display panel by means of the kind of method shown in FIGS. 19A and 19B, it is possible to balance the enhancement in image quality and the reduction in power consumption.

Figure 20A:
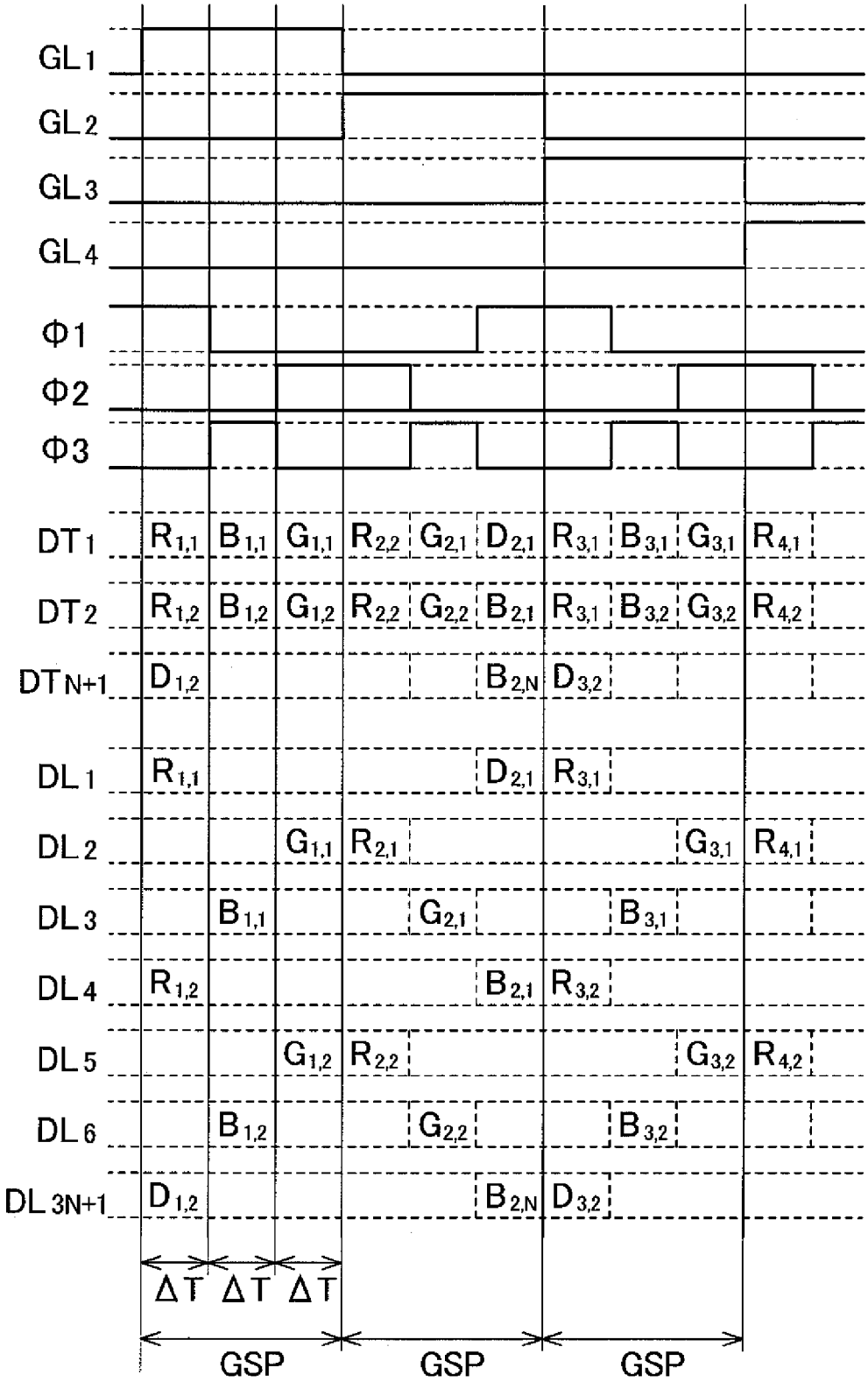
FIG. 20A is a schematic diagram showing a modification example of the method desirable as the method of driving the liquid crystal display panel of Embodiment 5.
Figure 20B:
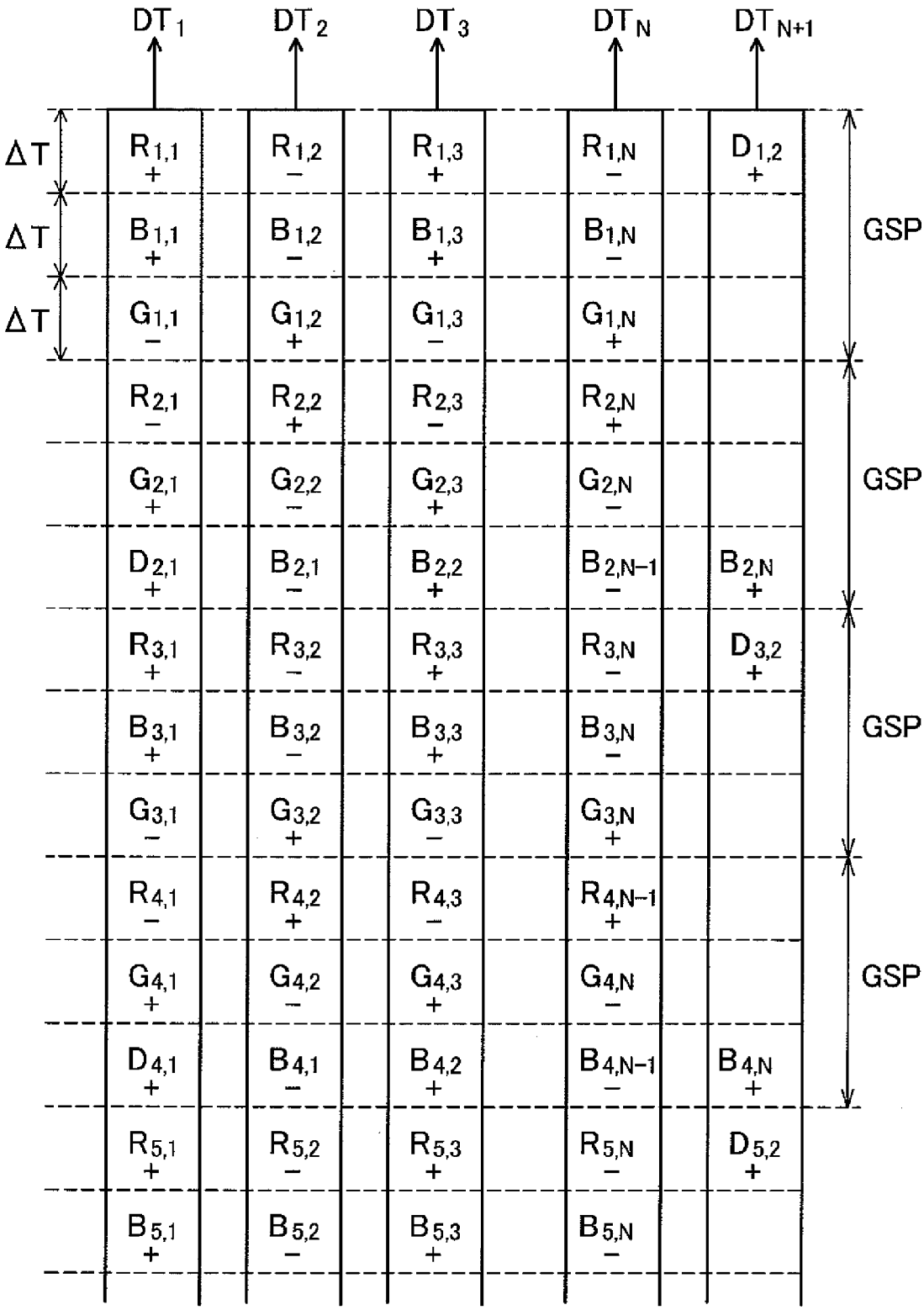
FIG. 20B is a schematic diagram showing one example of gradation voltages applied to video signal input terminals and their polarities.

FIGS. 20A and 20B are schematic diagrams showing one example of another method of driving the liquid crystal display panel of FIG. 17.

When driving the liquid crystal display panel of FIG. 17, it is also acceptable that signals applied to each scan signal line $GL_m$, each switching wire ϕ1, ϕ2, and ϕ3, and each video signal input terminal $DT_q$ are switched at the kind of timing shown in FIG. 20A. At this time, a configuration is such that, a switching signal applied to each switching wire ϕ1, ϕ2, and ϕ3 having two horizontal selection periods as one cycle, the switching signals of the switching wires ϕ1, ϕ2, and ϕ3 attain the H level in the order of ϕ1, ϕ3, ϕ2, ϕ2, ϕ3, and ϕ1 for the one cycle.

At this time, one video signal input terminal $DT_1$ and three video signal lines $DL_1$, $DL_2$, and $DL_3$ are connected in the order of $DL_1$, $DL_3$, $DL_2$, $DL_2$, $DL_3$, and $DL_1$ for one cycle (one horizontal selection period). Also, at this time, another video signal input terminal $DT_2$ and three other video signal lines $DL_4$, $DL_5$, and $DL_6$ are connected in the order of $DL_4$, $DL_6$, $DL_5$, $DL_5$, $DL_6$, and $DL_4$ for one cycle (one horizontal selection period). Consequently, gradation voltages are input into each of the video signal input terminals $DT_1$ and $DT_2$ in the kind of order shown in FIG. 20A.

Also, although not shown, gradation voltages are also input into each of the remaining video signal input terminals $DT_3$ to $DT_N$ in the same kind of order.

Also, at this time, a video signal input terminal $DT_{N+1}$ is connected to a video signal line $DL_{3N+1}$ for only a selection period, of one cycle (one horizontal selection period), for which the switching signal of the switching wire ϕ1 attains the H level. For this reason, gradation voltages are input into the video signal input terminal $DT_{N+1}$ for only the selection period for which, for example, the switching signal of the switching wire ϕ1 attains the H level.

At this time, the polarities of gradation voltages input into each video signal input terminal $DT_q$ are shown in FIG. 20B. When the liquid crystal display panel is driven by the kind of method shown in FIGS. 20A and 20B, it is possible to reduce the frequency of polarity reversal of gradation voltages applied to one video signal input terminal $DT_q$ to one third of the reversal frequency in the drive method shown in FIG. 3B. Consequently, it is possible to further reduce power consumption in comparison with the case in which the liquid crystal display panel is driven by the kind of method shown in FIGS. 19A and 19B.

Embodiment 6

Figure 21:
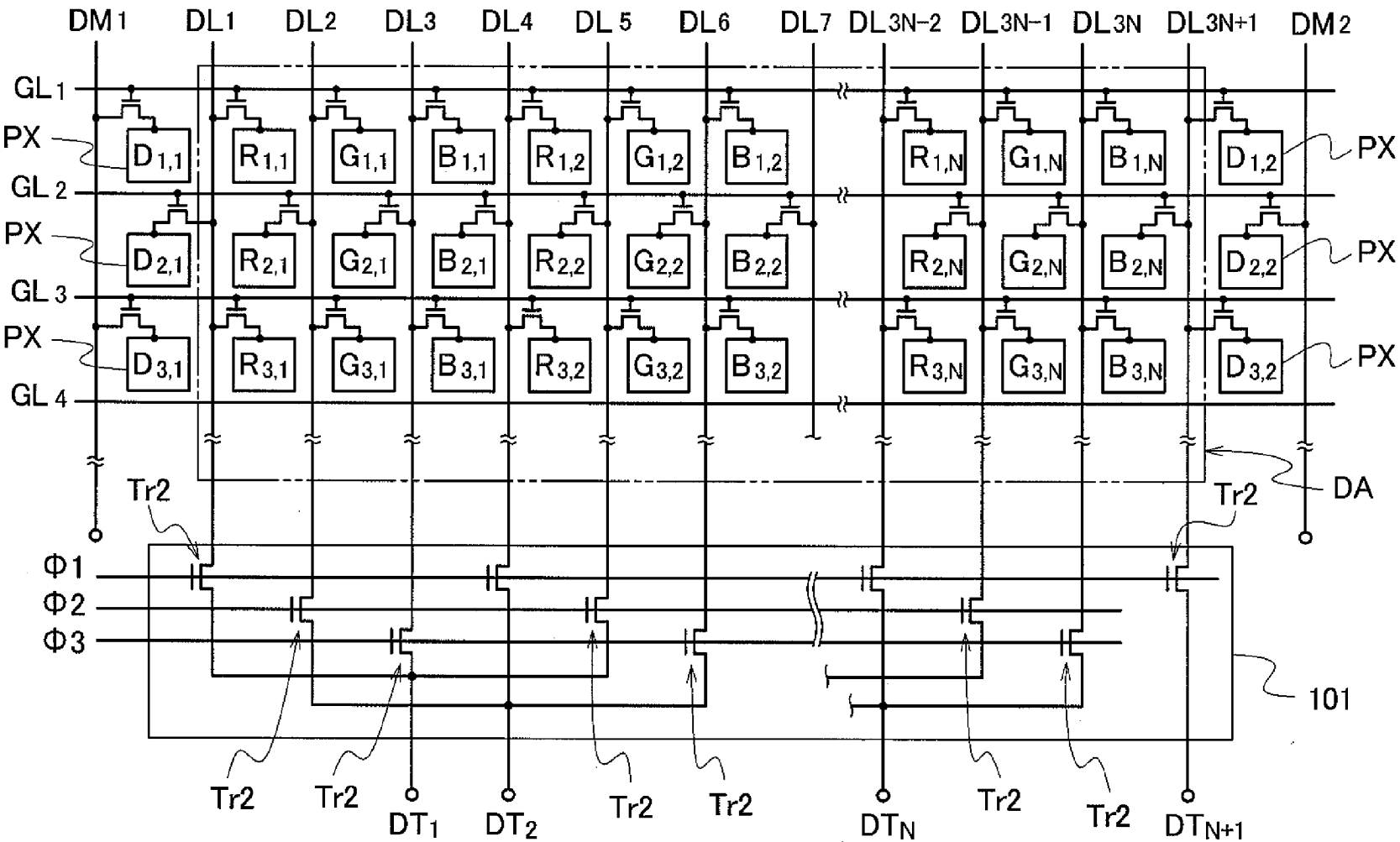
FIG. 21 is a schematic diagram showing one example of an outline configuration of a liquid crystal display panel of Embodiment 6 of the invention.

FIG. 21 is a schematic diagram showing one example of an outline configuration of a liquid crystal display panel of Embodiment 6 of the invention.

With the liquid crystal display panel of Embodiment 6, a display area DA is of the same configuration as that of Embodiment 5, and a switch circuit 101 is of the same configuration as that of Embodiment 2.

At this time, with the switch circuit 101, portions connecting video signal lines $DL_1$ to $DL_{3N}$ and video signal input terminals $DT_1$ to $DT_N$ are of the same configuration as the configuration shown in FIG. 9. Also, a video signal line $DL_{3N+1}$ is connected to a video signal input terminal $DT_{N+1}$ by a switch element whose gate is connected to a switching wire ϕ1.

Figure 22A:
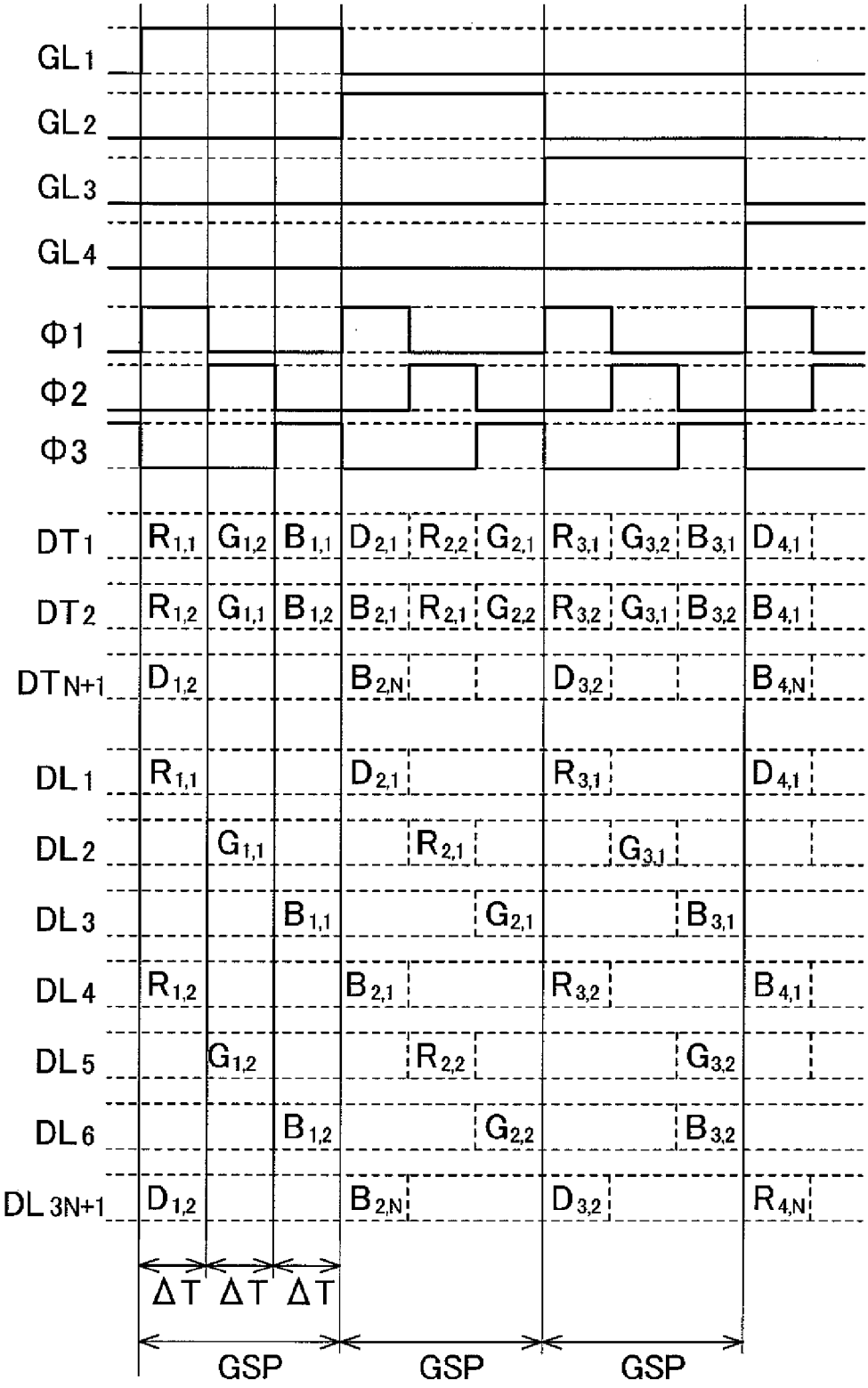
FIG. 22A is a schematic diagram showing one example of a method of driving the liquid crystal display panel of Embodiment 6.
Figure 22B:
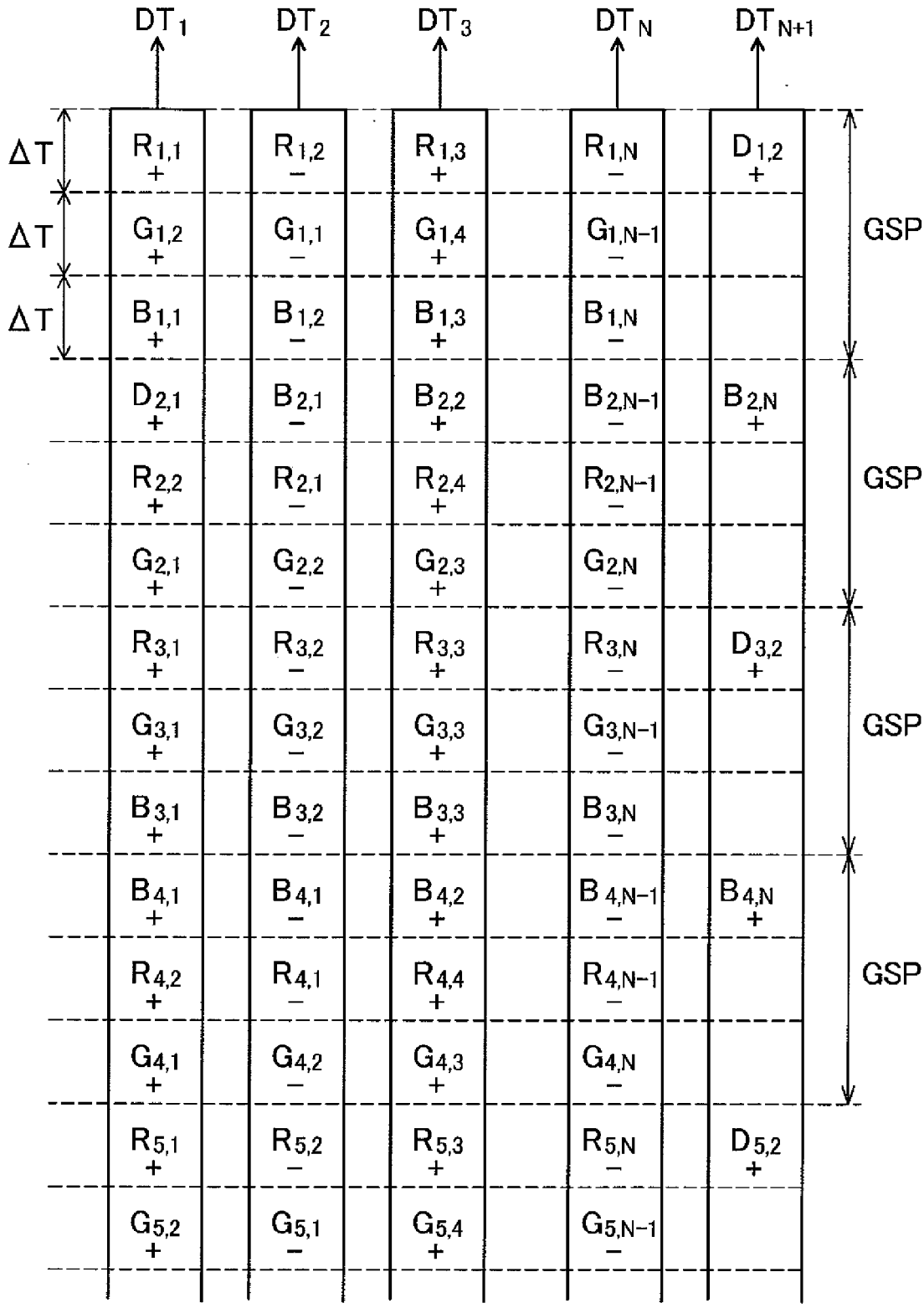
FIG. 22B is a schematic diagram showing one example of gradation voltages applied to video signal input terminals and their polarities.

FIG. 22A is a schematic diagram showing one example of a method of driving the liquid crystal display panel of Embodiment 6. FIG. 22B is a schematic diagram showing one example of gradation voltages applied to video signal input terminals and their polarities.

When driving the liquid crystal display panel of Embodiment 6, signals applied to each scan signal line $GL_m$, each switching wire ϕ1, ϕ2, and ϕ3, and each video signal input terminal $DT_q$ are switched at the kind of timing shown in FIG. 22A. At this time, a configuration is such that, a switching signal applied to each switching wire ϕ1, ϕ2, and ϕ3 having one horizontal selection period GSP as one cycle, the switching signals of the switching wires ϕ1, ϕ2, and ϕ3 attain the H level in the order of ϕ1, ϕ2, and ϕ3 for the one cycle.

At this time, one video signal input terminal $DT_1$ and three video signal lines $DL_1$, $DL_3$, and $DL_5$ are connected in the order of $DL_1$, $DL_5$, and $DL_3$ for one cycle (one horizontal selection period). Also, at this time, another video signal input terminal $DT_2$ and three other video signal lines $DL_2$, $DL_4$, and $DL_6$ are connected in the order of $DL_4$, $DL_2$, and $DL_6$ for one cycle. Consequently, gradation voltages are input into each of the video signal input terminals $DT_1$ and $DT_2$ in the kind of order shown in FIG. 22A.

Also, although not shown, gradation voltages are also input into each of the remaining video signal input terminals $DT_3$ to $DT_N$ in the same kind of order.

Also, at this time, a video signal input terminal $DT_{N+1}$ is connected to a video signal line $DL_{3N+1}$ for only a selection period, of one cycle (one horizontal selection period), for which the switching signal of the switching wire ϕ1 attains the H level. For this reason, gradation voltages are input into the video signal input terminal $DT_{N+1}$ for only the selection period for which, for example, the switching signal of the switching wire ϕ1 attains the H level.

At this time, the polarities of gradation voltages input into each video signal input terminal $DT_q$ are shown in FIG. 22B. When the liquid crystal display panel is driven by the kind of method shown in FIGS. 22A and 22B, it is possible to reduce the frequency of polarity reversal of gradation voltages applied to one video signal input terminal $DT_q$ to a rate of once per frame period. Consequently, with a liquid crystal display device having the liquid crystal display panel of Embodiment 6, it is possible to balance the enhancement in image quality and the reduction in power consumption.

Figure 23:
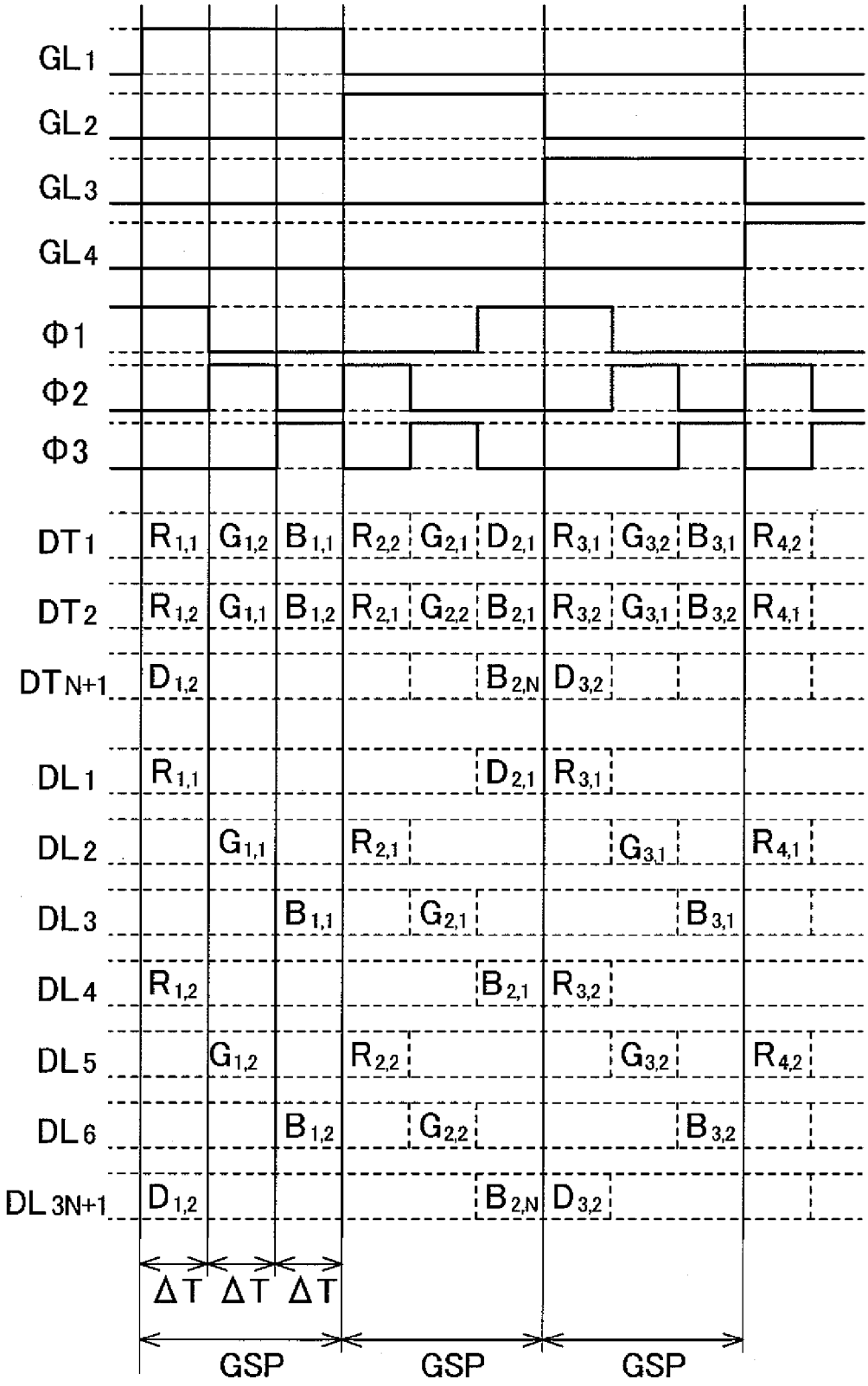
FIG. 23 is a schematic diagram showing a modification example of the method of driving the liquid crystal display panel of Embodiment 6.

FIG. 23 is a schematic diagram showing a modification example of the method of driving the liquid crystal display panel of Embodiment 6.

When driving the liquid crystal display panel of Embodiment 6, it is also acceptable that signals applied to each scan signal line, each switching wire, and each video signal input terminal are switched at the kind of timing shown in FIG. 23.

When driving the liquid crystal display panel of Embodiment 6, as all the polarities of gradation voltages input into one video signal input terminal $DT_q$ for one frame period are the same, even in the event of changing the order of the gradation voltages input into the one video signal input terminal $DT_q$, the polarity reversal frequency does not change. Consequently, with a liquid crystal display device having the liquid crystal display panel of Embodiment 6, even in the event of adopting the kind of drive method shown in FIG. 23, that is, a configuration such that switching signals applied to switching wires ϕ1, ϕ2, and ϕ3, with two horizontal selection periods as one cycle, attain the H level in the order of ϕ1, ϕ2, ϕ3, ϕ2, ϕ3, and ϕ1 for the one cycle, it is possible to balance the enhancement in image quality and the reduction in power consumption.

Embodiment 7

Figure 24:
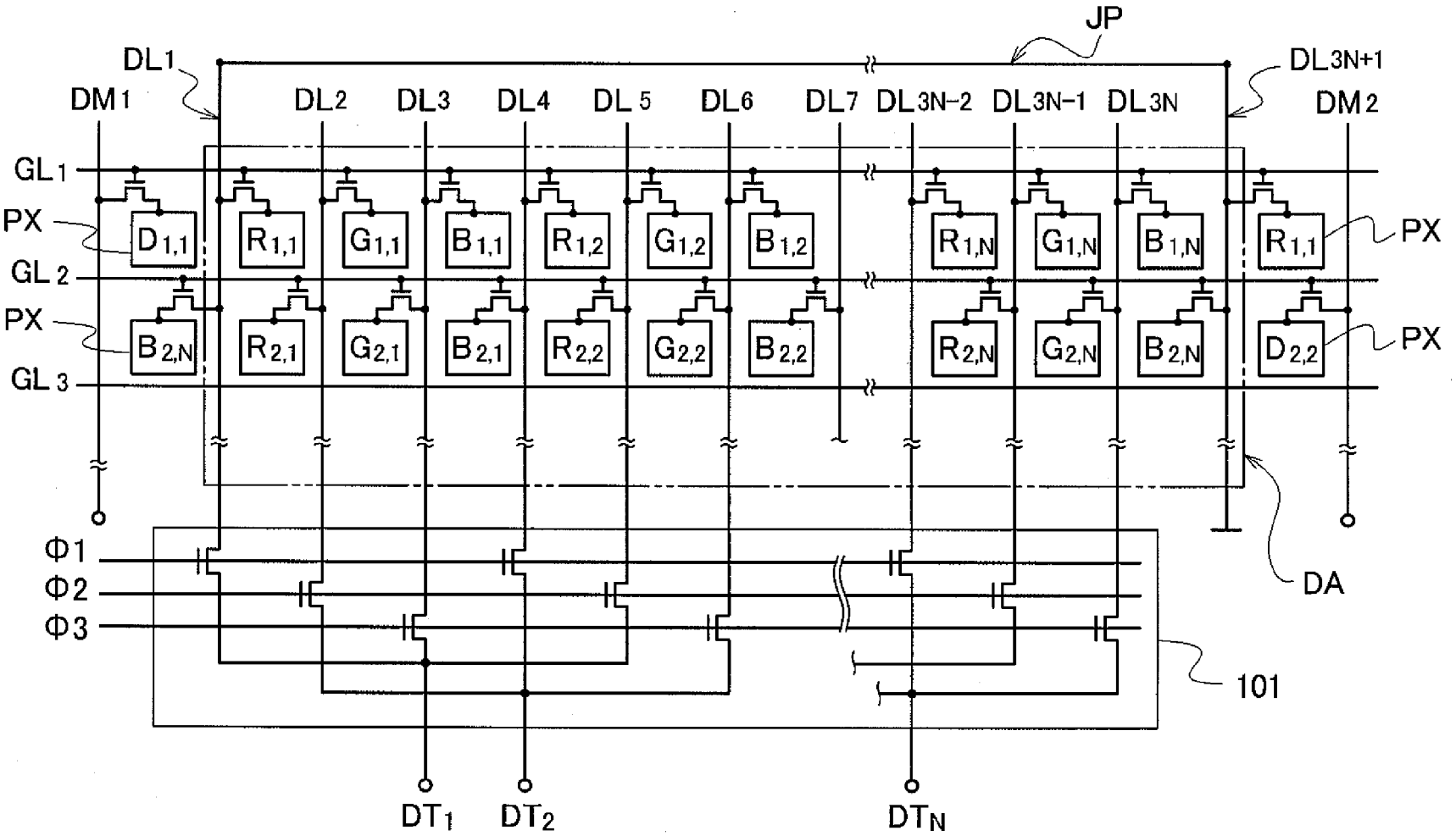
FIG. 24 is a schematic diagram showing one example of an outline configuration of a liquid crystal display panel of Embodiment 7 of the invention.

FIG. 24 is a schematic diagram showing one example of an outline configuration of a liquid crystal display panel of Embodiment 7 of the invention.

With the liquid crystal display panel of Embodiment 7, a display area DA is of the same configuration as that of Embodiment 5, and a switch circuit 101 is of the same configuration as that of Embodiment 2.

With the liquid crystal display panel of Embodiment 7, two video signal lines $DL_1$ and $DL_{3N+1}$ disposed on the outermost sides of a display area DA are connected by a wire JP passing outside the display area DA. At this time, the video signal line $DL_{3N+1}$ is connected to a video signal input terminal $DT_1$ via the wire JP, the video signal line $DL_1$, and a switch element. For this reason, gradation voltages applied to pixel electrodes connected to the video signal line $DL_1$ and pixel electrodes connected to the video signal line $DL_{3N+1}$ are input into the video signal input terminal $DT_1$.

Figure 25A:
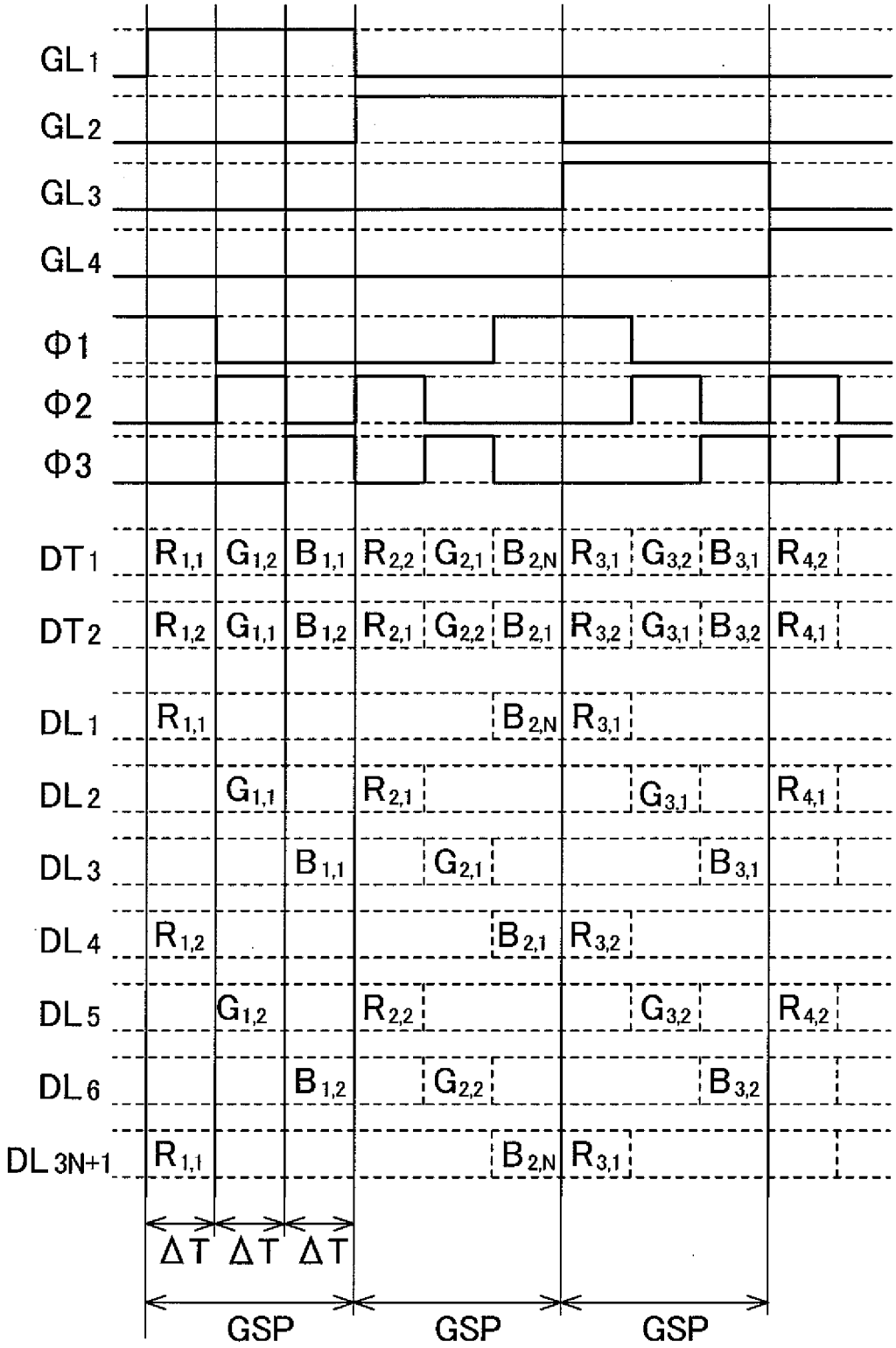
FIG. 25A is a schematic diagram showing one example of a method desirable as the method of driving the liquid crystal display panel of Embodiment 7.
Figure 25B:
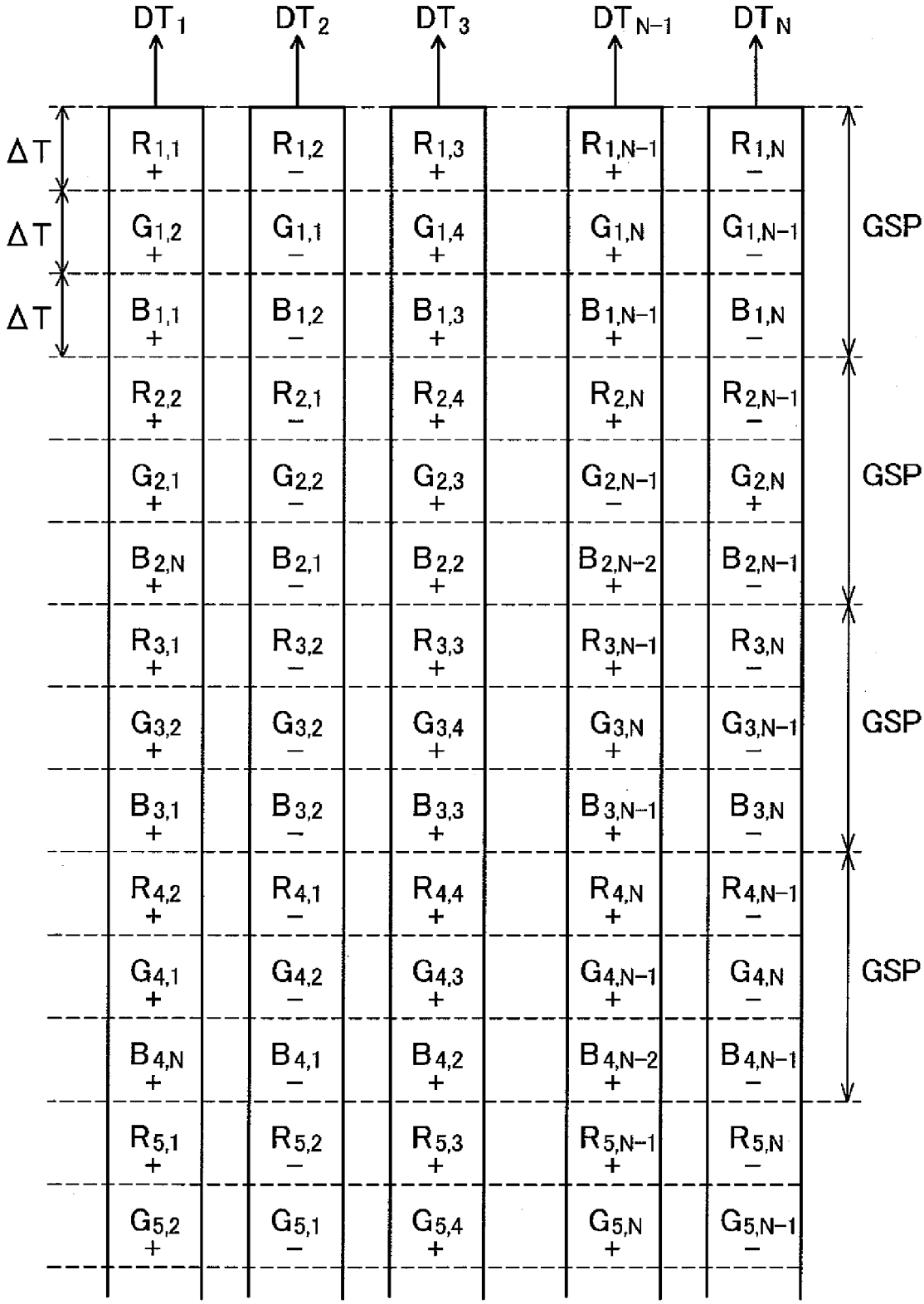
FIG. 25B is a schematic diagram showing one example of video signals applied to video signal input terminals and their polarities.

FIGS. 25A and 25B are schematic diagrams showing one example of a method of driving the liquid crystal display panel of Embodiment 7.

When driving the liquid crystal display panel of Embodiment 7, signals applied to each scan signal line $GL_m$, each switching wire ϕ1, ϕ2, and ϕ3, and each video signal input terminal $DT_q$ are switched at the kind of timing shown in FIG. 25A. At this time, a configuration is such that, a switching signal applied to each switching wire ϕ1, ϕ2, and ϕ3 having two horizontal selection periods as one cycle, the switching signals of the switching wires ϕ1, ϕ2, and ϕ3 attain the H level in the order of ϕ1, ϕ2, ϕ3, ϕ2, ϕ3, and ϕ1 for the one cycle.

At this time, one video signal input terminal $DT_1$ and three video signal lines $DL_1$, $DL_3$, and $DL_5$ are connected in the order of $DL_1$, $DL_5$, $DL_3$, $DL_5$, $DL_3$, and $DL_1$ for one cycle (one horizontal selection period). Also, at this time, gradation voltages applied to the video signal line $DL_1$ for the horizontal selection period, for which scan signals applied to the scan signal lines $GL_m$, where m is an odd number, are of the H level, are applied to pixel electrodes between the video signal line $DL_1$ and video signal line $DL_2$, and pixel electrodes between the video signal line $DL_{3N+1}$ and a dummy video signal line $DM_2$. In the same way, gradation voltages applied to the video signal line $DL_1$ for the horizontal selection period, for which scan signals applied to the scan signal lines $GL_m$, where m is an even number, are of the H level, are applied to pixel electrodes between a dummy video signal line $DM_1$ and the video signal line $DL_1$, and pixel electrodes between a video signal line $DL_{3N}$ and the video signal line $DL_{3N+1}$.

Pixel electrodes between a dummy video signal line and a video signal line are pixel electrodes of dummy pixels which do not contribute to the display of a video or image. For this reason, it is possible to apply an optional potential of gradation voltage to the pixel electrodes between the dummy video signal line and the video signal line.

Also, at this time, another video signal input terminal $DT_2$ and three other video signal lines $DL_2$, $DL_4$, and $DL_6$ are connected in the order of $DL_4$, $DL_2$, $DL_6$, $DL_2$, $DL_6$, and $DL_4$ for one cycle (one horizontal selection period).

Consequently, gradation voltages are input into each of the video signal input terminals $DT_1$ and $DT_2$ in the kind of order shown in FIG. 25A.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are shown in FIG. 25B. When the liquid crystal display panel is driven by the kind of method shown in FIGS. 25A and 25B, it is possible to reduce the frequency of polarity reversal of gradation voltages applied to one video signal input terminal $DT_q$ to a rate of once per frame period. Consequently, with a liquid crystal display device having the liquid crystal display panel of Embodiment 7, it is possible to balance the enhancement in image quality and the reduction in power consumption.

Also, with the liquid crystal display panel of Embodiment 7, it is possible to reduce the number of video signal input terminals by one in comparison with the liquid crystal display panels of Embodiment 5 and Embodiment 6.

Embodiment 8

Figure 26A:
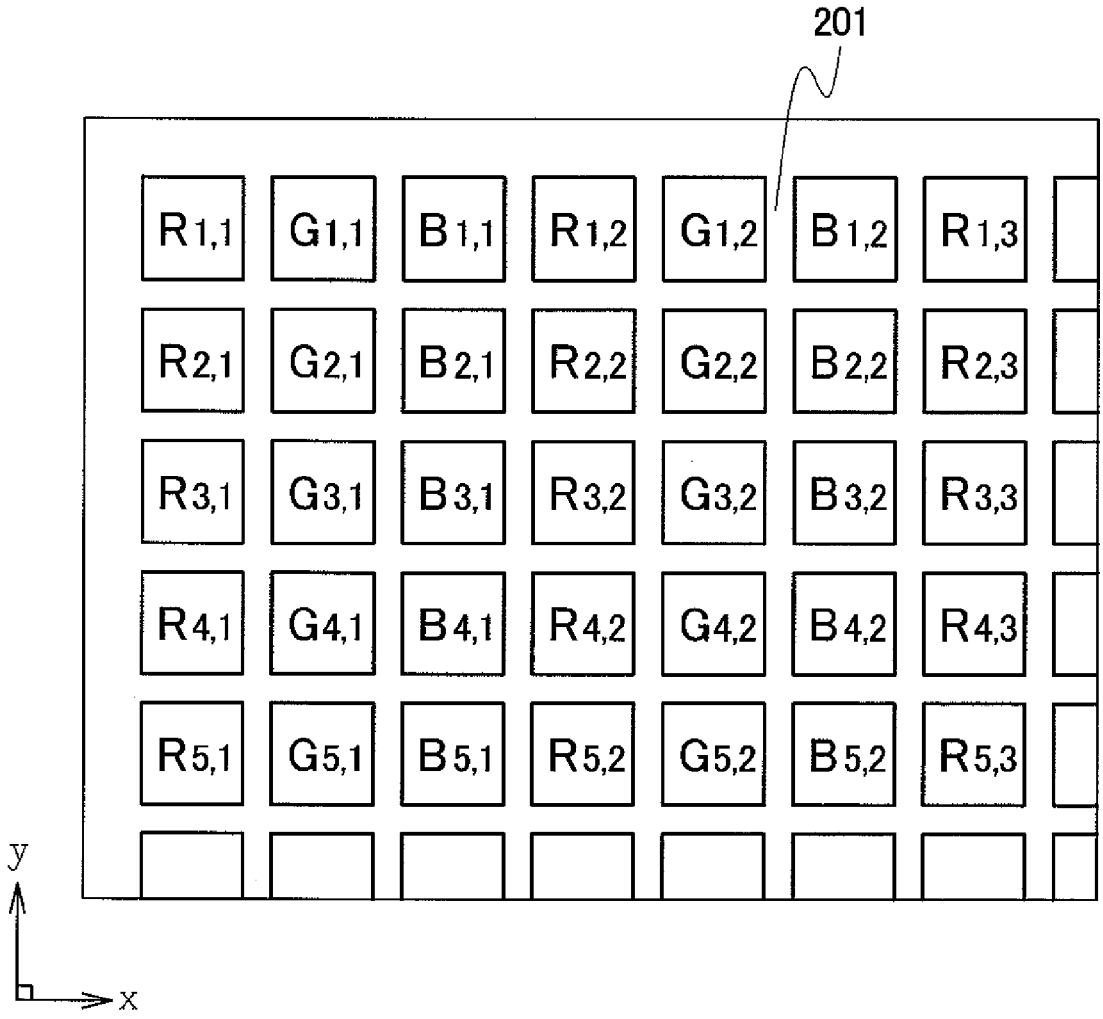
FIG. 26A PRIOR ART
FIG. 26A is a schematic diagram showing one example of a method of disposing pixels of the liquid crystal display panel.
Figure 26B:
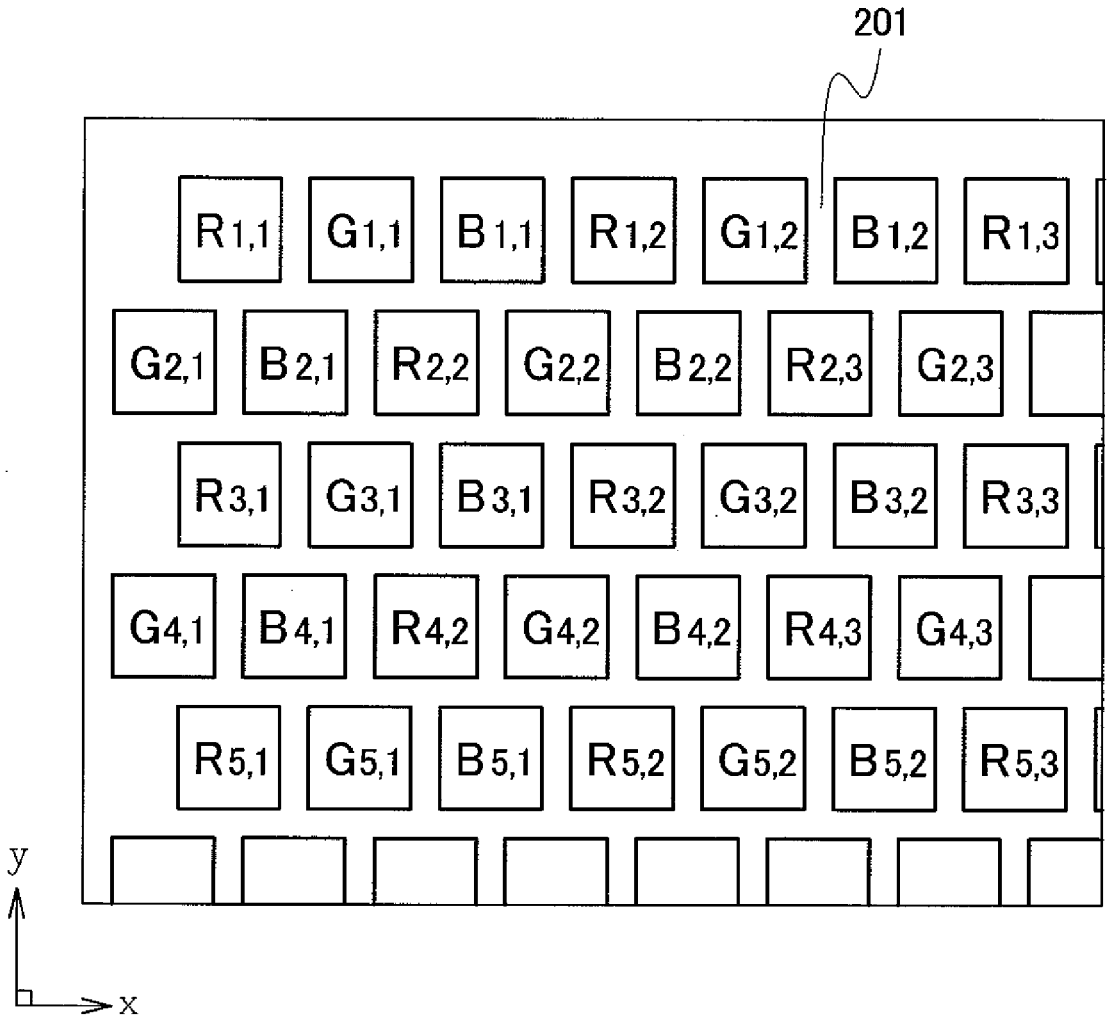
FIG. 26B PRIOR ART
FIG. 26B is a schematic diagram showing another example of the method of disposing the pixels of the liquid crystal display panel.

FIGS. 26A and 26B are schematic diagrams showing a method of disposing a liquid crystal display panel.

A display area of the liquid crystal display panel is set by a collection of a plurality of pixels disposed in a matrix form. At this time, the disposition of pixels on a general liquid crystal display panel being the kind of disposition shown in, for example, FIG. 26A, the positions of two pixels adjacent to each other in a direction of extension of video signal lines (a y direction) are aligned in a direction of extension of scan signal lines (an x direction). In FIG. 26A, 201 being a grid shaped light shielding film (a black matrix), individual rectangular areas divided by the light shielding film 201 correspond to opening areas of the pixels. Also, $R_{m,q}$, $G_{m,q}$, and $B_{m,q}$ written in the corresponding rectangular areas show gradation voltages applied to pixel electrodes included in the respective pixels.

This kind of disposition is applied to, for example, a liquid crystal display for a liquid crystal television or a PC.

Also, some liquid crystal display panels used in a liquid crystal display of a digital still camera are arranged to have a disposition such that, for example, as shown in FIG. 26B, the x direction positions of two pixels adjacent to each other in the y direction are displaced from one another, and the x direction positions of two pixels adjacent to each other across one pixel are aligned with each other (generally called a delta disposition). Also, at this time, gradation voltages applied to the pixel electrodes of the individual pixels are set in the kind of way shown in, for example, FIG. 26B. Then, the invention, not being limited to a liquid crystal display panel with the kind of disposition shown in FIG. 26A, can also be applied to a liquid crystal display panel with the kind of delta disposition shown in FIG. 26B.

Figure 27:
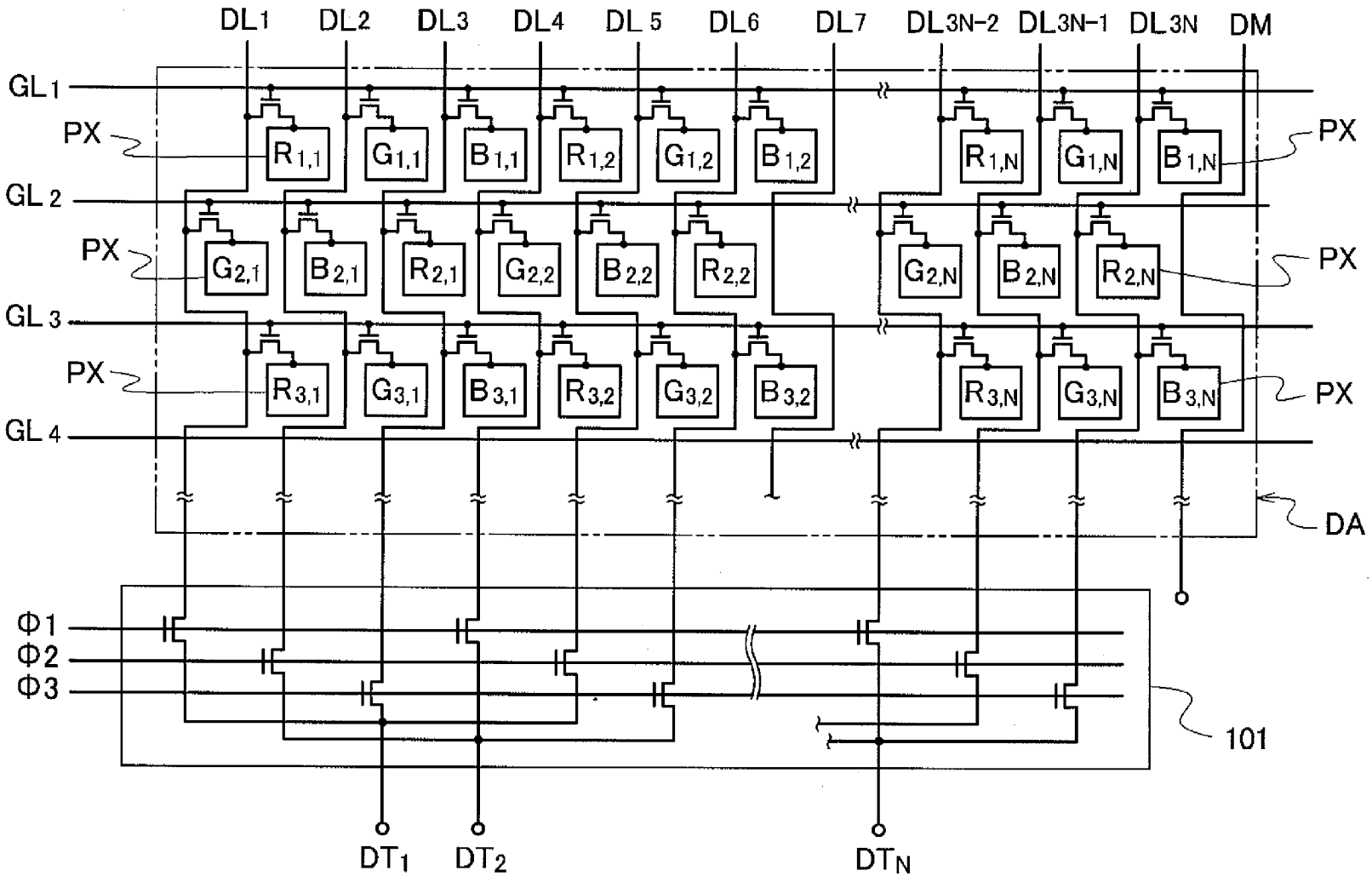
FIG. 27 is a schematic diagram showing one example of an outline configuration of a liquid crystal display panel of Embodiment 8 of the invention.

FIG. 27 is a schematic diagram showing one example of an outline configuration of a liquid crystal display panel of Embodiment 8 of the invention.

With the liquid crystal display panel of Embodiment 8, the basic configuration of a display area DA and the configuration of a switch circuit 101 are the same as those of the liquid crystal display panel of Embodiment 2. However, as the liquid crystal display panel of Embodiment 8 has the delta disposition as its pixel disposition, as shown in FIG. 27, regarding pixel electrodes PX disposed between two adjacent video signal lines DL, the x direction positions of two pixel electrodes PX adjacent to each other in the direction of extension of video signal lines DL are displaced from one another, and the x direction positions of two pixel electrodes PX adjacent to each other across one pixel electrode PX are aligned with each other.

Figure 28A:
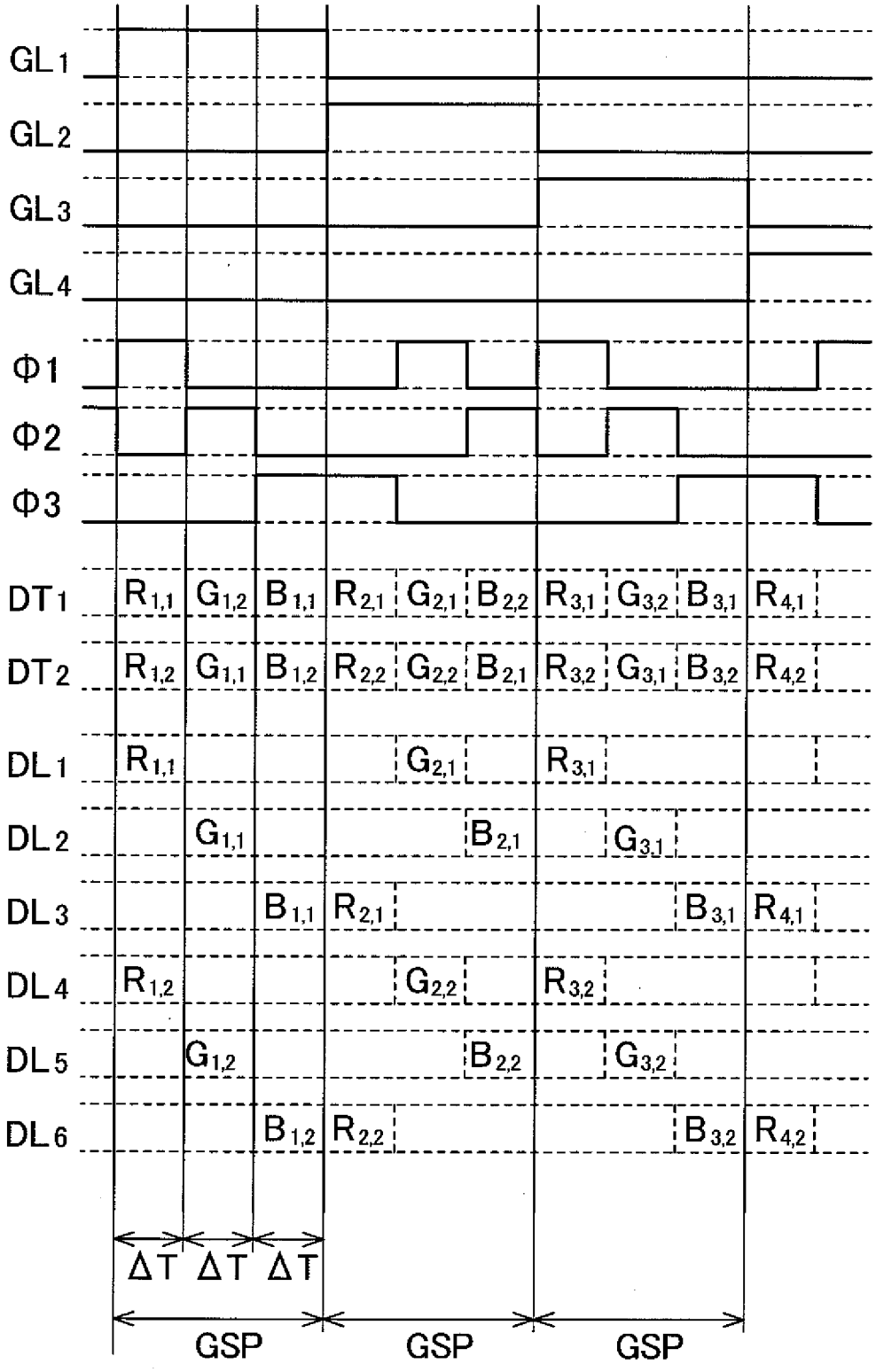
FIG. 28A is a schematic diagram showing one example of a method of driving the liquid crystal display panel of Embodiment 8.
Figure 28B:
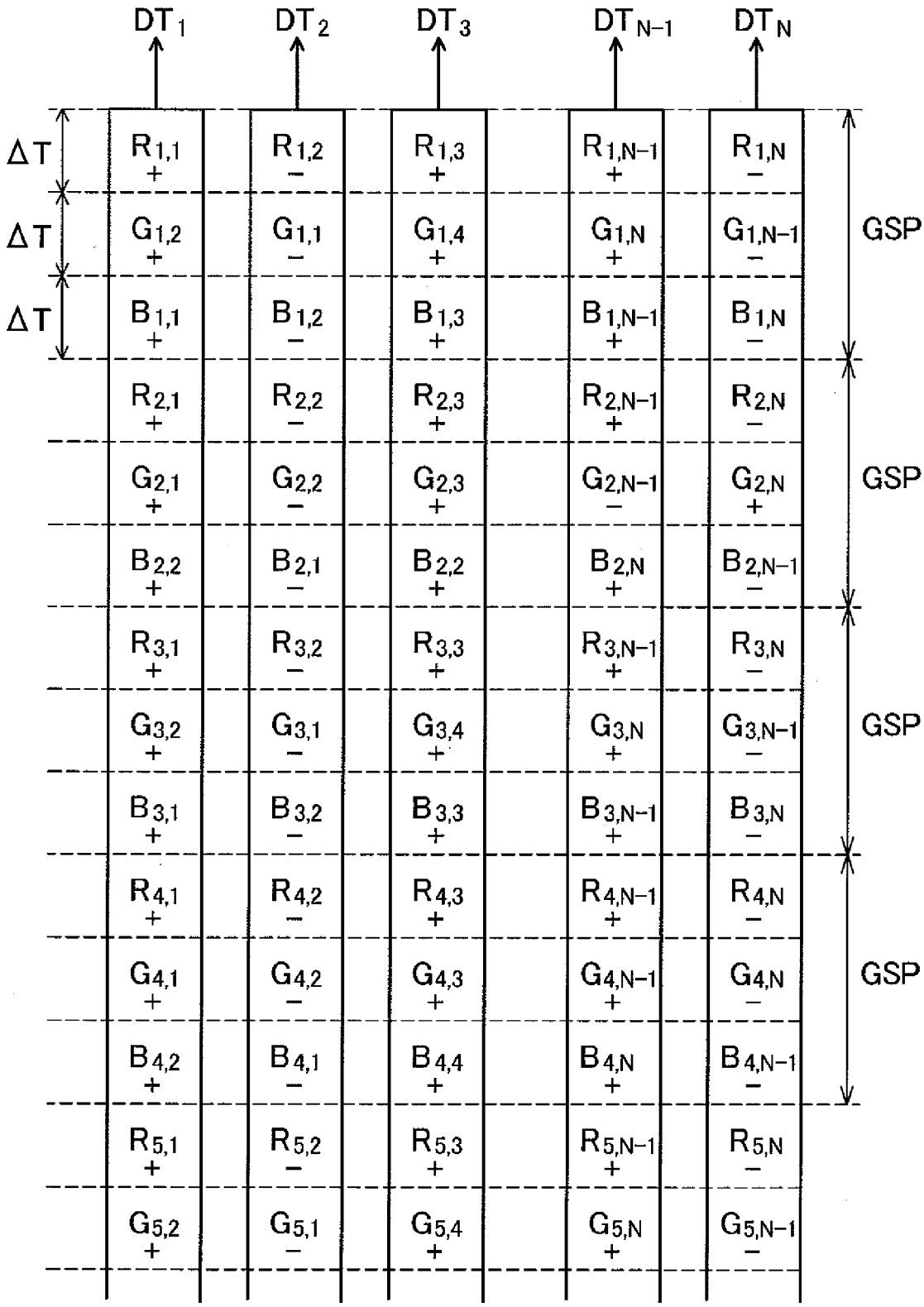
FIG. 28B is a schematic diagram showing one example of video signals applied to video signal input terminals and their polarities.
Figure 28C:
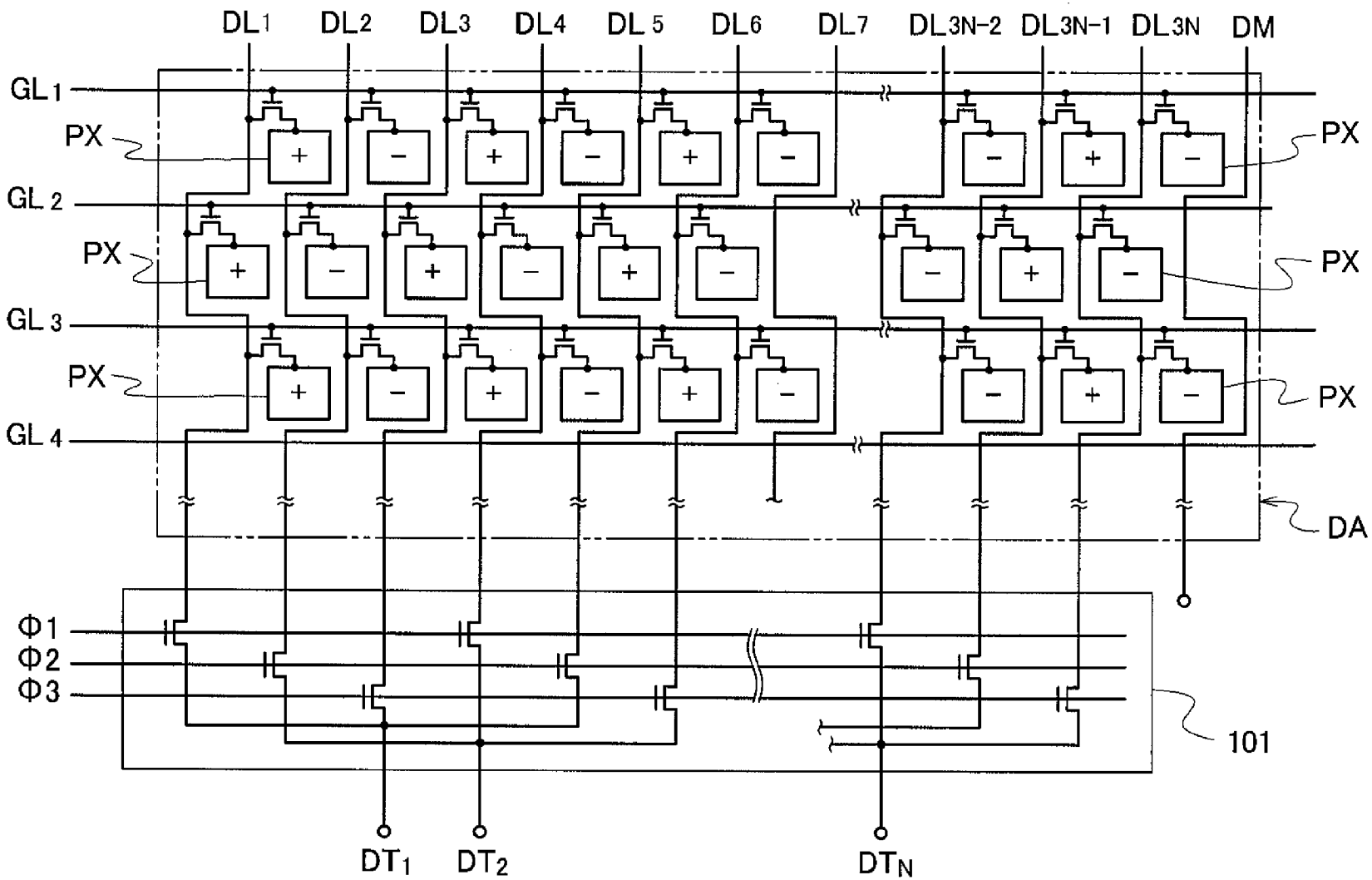
FIG. 28C is a schematic diagram showing one example of the polarities of individual pixel electrodes for one frame period.

FIG. 28A is a schematic diagram showing one example of a method of driving the liquid crystal display panel of Embodiment 8. FIG. 28B is a schematic diagram showing one example of video signals applied to video signal input terminals and their polarities. FIG. 28C is a schematic diagram showing one example of the polarities of individual pixel electrodes for one frame period.

When driving the liquid crystal display panel of Embodiment 8, signals applied to each scan signal line $GL_m$, each switching wire ϕ1, ϕ2, and ϕ3, and each video signal input terminal $DT_q$ are switched at the kind of timing shown in FIG. 28A. At this time, a configuration is such that switching signals applied to the individual switching wires ϕ1, ϕ2, and ϕ3, with two horizontal selection periods as one cycle, attain the H level in the order of ϕ1, ϕ2, ϕ3, ϕ3, ϕ1, and ϕ2 for the one cycle.

At this time, one video signal input terminal $DT_1$ and three video signal lines $DL_1$, $DL_3$, and $DL_5$ are connected in the order of $DL_1$, $DL_5$, $DL_3$, $DL_3$, $DL_1$, and $DL_5$ for one cycle (two horizontal selection periods). Also, at this time, another video signal input terminal $DT_2$ and three other video signal lines $DL_2$, $DL_4$, and $DL_6$ are connected in the order of $DL_4$, $DL_2$, $DL_6$, $DL_6$, $DL_4$, and $DL_2$ for one cycle (two horizontal selection periods). Consequently, gradation voltages are input into each of the video signal input terminals $DT_1$ and $DT_2$ in the kind of order shown in FIG. 28A.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are shown in FIG. 28B. Also, the polarities of individual pixel electrodes PX for one frame period are given as shown in FIG. 28C. At this time, the polarities of individual pixel electrodes PX for one frame period become the same as with the line inversion drive, but gradation voltages, when generated in the drive circuit 3 too, are generated by the same method as that in the case of the line inversion drive. For this reason, it being possible to reduce the frequency of polarity reversal of gradation voltages applied to one video signal input terminal $DT_q$ to a rate of once per frame period, it is possible to reduce the power consumption of the drive circuit 3. Consequently, with a liquid crystal display device having the liquid crystal display panel of Embodiment 8, it is possible to balance the enhancement in image quality and the reduction in power consumption.

Figure 29A:
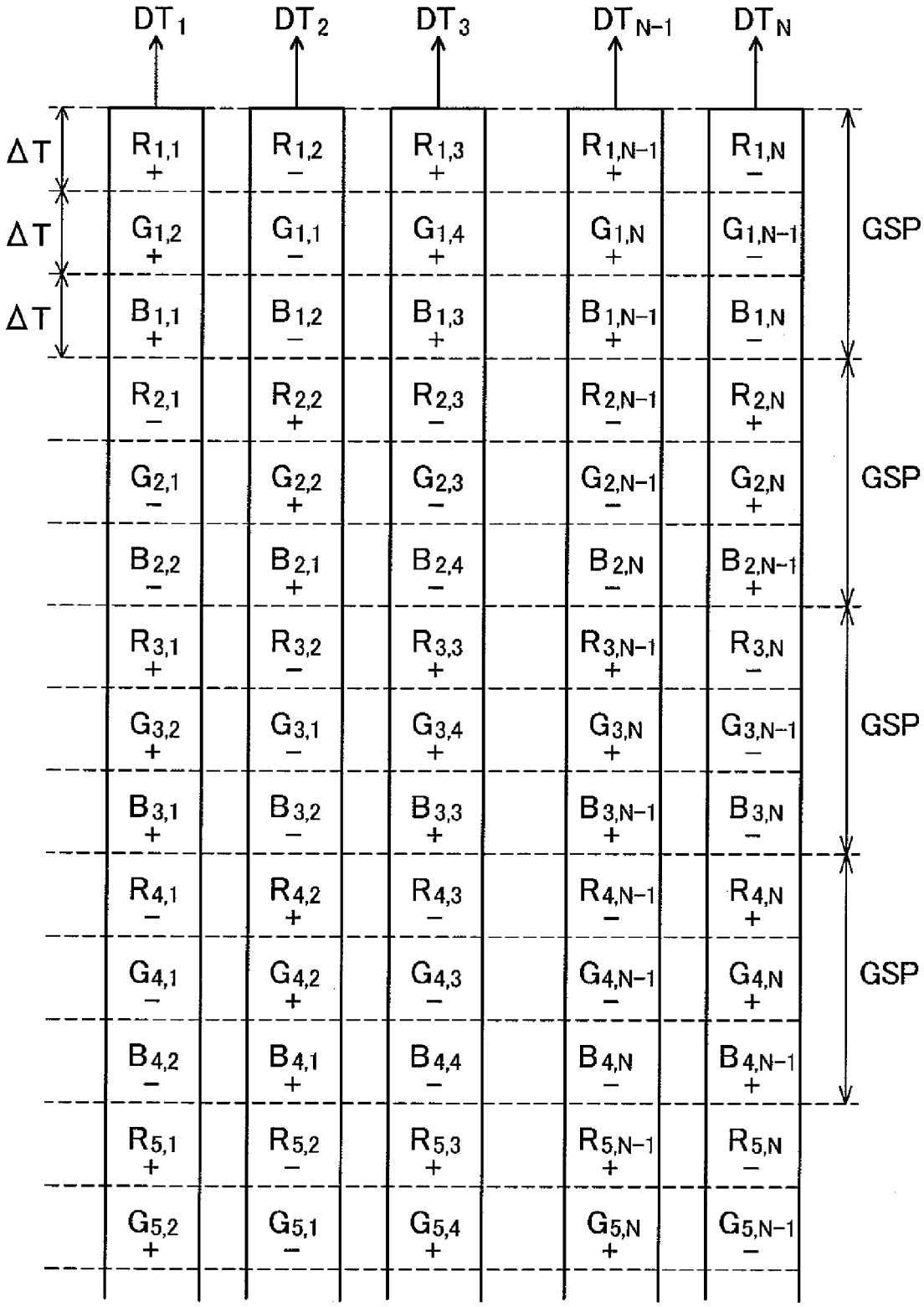
FIG. 29A is a schematic diagram showing a modification example of the method of driving the liquid crystal display panel of Embodiment 8.
Figure 29B:
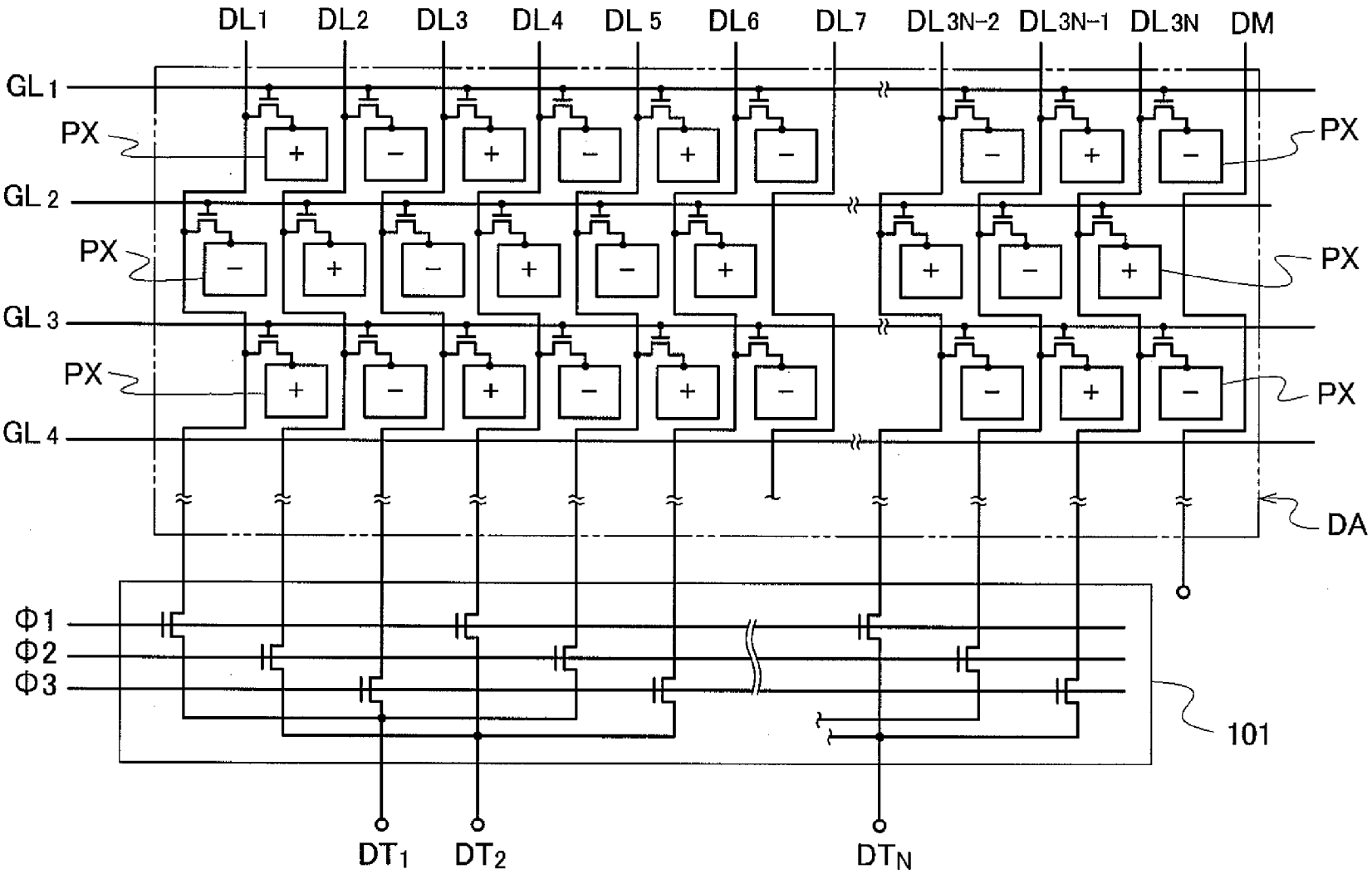
FIG. 29B is a schematic diagram showing one example of the polarities of individual pixel electrodes for one frame period.

FIGS. 29A and 29B are schematic diagrams showing a modification example of the method of driving the liquid crystal display panel of FIG. 27.

When the liquid crystal display panel of FIG. 27 is driven by the kind of method shown in FIG. 28A, it is also acceptable that the polarities of gradation voltages input into each video signal input terminal $DT_q$ are given as shown in FIG. 29A. In this case, the gradation voltage polarities are reversed for each horizontal selection period GSP, and the polarities of individual pixel electrodes PX for one frame period become the same as those in the case of the kind of dot inversion drive shown in FIG. 29B.

In the drive circuit 3, in the case of generating gradation voltages with the kinds of polarity shown in FIG. 29A, the polarity reversal frequency increases in comparison with in the case of generating gradation voltages with the kinds of polarity shown in FIG. 28B. For this reason, the power consumption of the drive circuit 3 increases. However, in comparison with the case of the heretofore known dot inversion drive, the polarity reversal frequency being reduced to one third, it is possible to reduce the power consumption of the drive circuit 3. Consequently, with a liquid crystal display device having the liquid crystal display panel of FIG. 27, even in the event of the kinds of drive method shown in FIGS. 28A and 29A, it is possible to balance the enhancement in image quality and the reduction in power consumption.

In Embodiment 8, the same case as with the example shown in Embodiment 2 is instanced as the switch circuit 101 but, this not being limiting, it is also acceptable that the switch circuit 101 is of the kind of configuration taken in Embodiment 3 or Embodiment 4. In the event that the configuration of the switch circuit 101 in the liquid crystal display panel of Embodiment 8 is replaced with the configuration taken in Embodiment 3 or Embodiment 4, by driving the liquid crystal display panel by means of the kind of method described in Embodiment 3 or Embodiment 4, it is possible to balance the enhancement in image quality and the reduction in power consumption.

Embodiment 9

Figure 30:
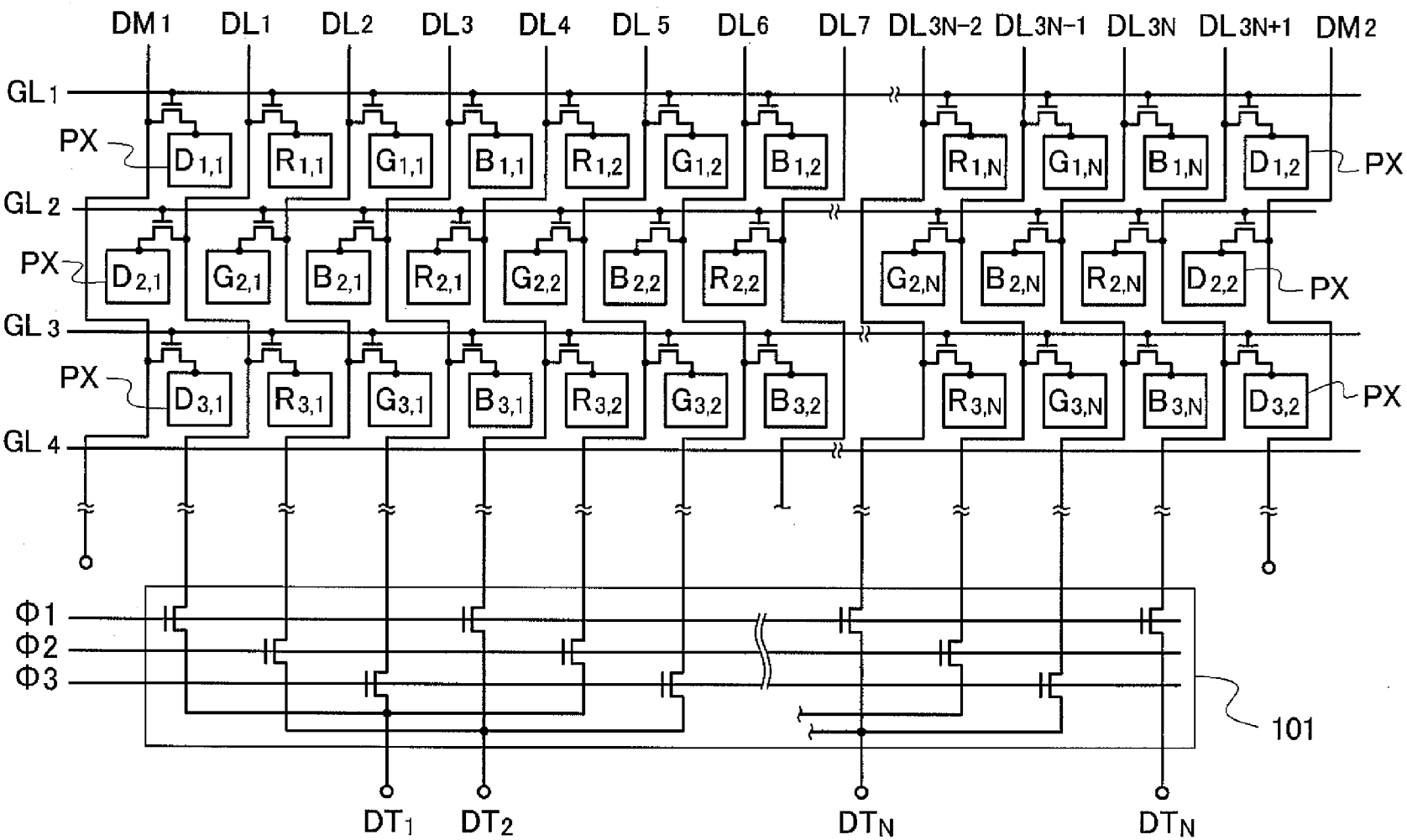
FIG. 30 is a schematic diagram showing one example of an outline configuration of a liquid crystal display panel of Embodiment 9 of the invention.

FIG. 30 is a schematic diagram showing one example of an outline configuration of a liquid crystal display panel of Embodiment 9 of the invention.

With the liquid crystal display panel of Embodiment 9, the basic configuration of a display area DA and the configuration of a switch circuit 101 are the same as those of the liquid crystal display panel of Embodiment 6. However, the liquid crystal display panel of Embodiment 9 having the delta disposition as its pixel disposition, as shown in FIG. 30, regarding pixel electrodes PX disposed between two adjacent video signal lines DL, the x direction positions of two pixel electrodes PX adjacent to each other in the direction of extension of video signal lines DL are displaced from one another, and the x direction positions of two pixel electrodes PX adjacent to each other across one pixel electrode PX are aligned with each other.

Figure 31A:
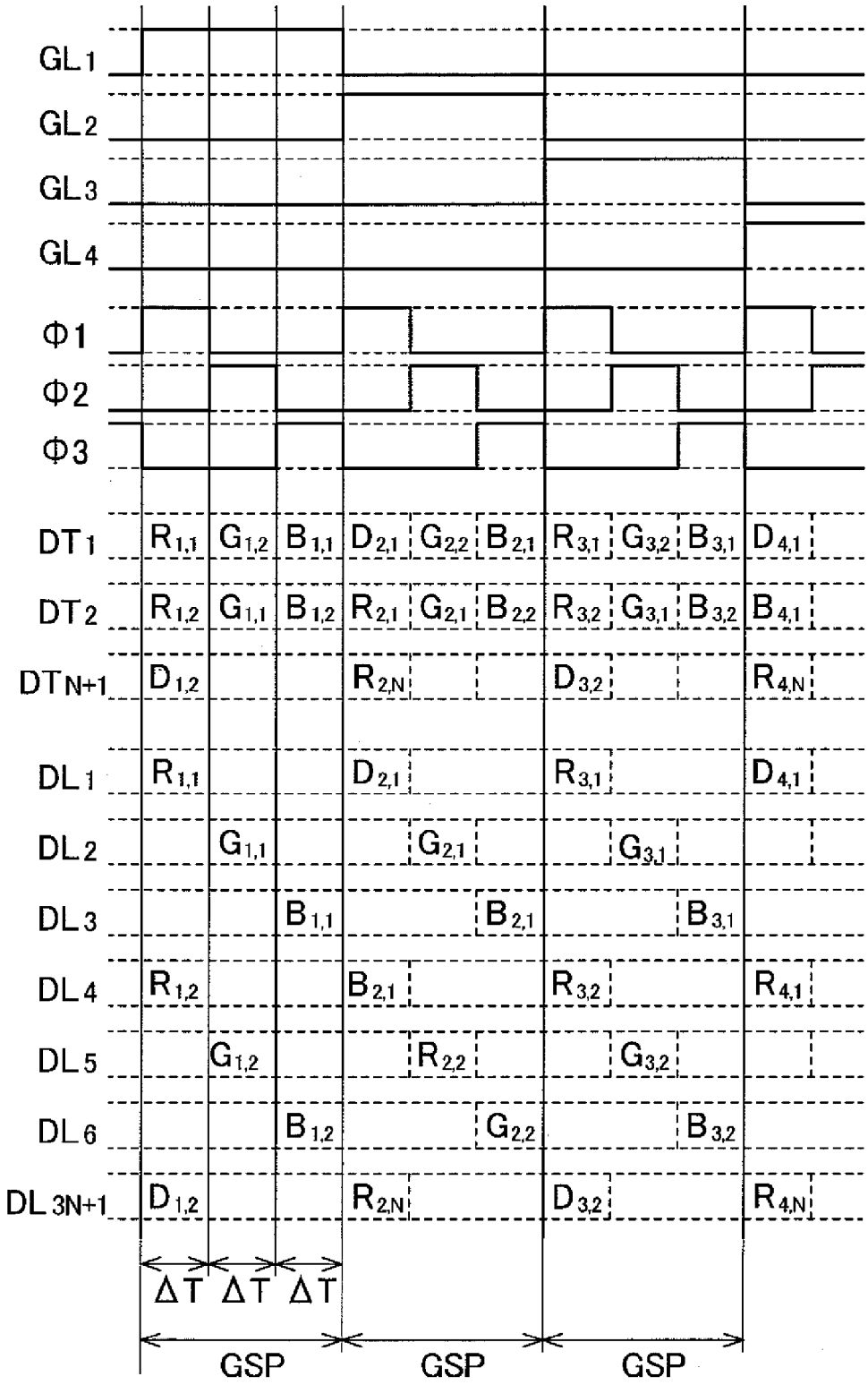
FIG. 31A is a schematic diagram showing one example of a method of driving the liquid crystal display panel of Embodiment 9.
Figure 31B:
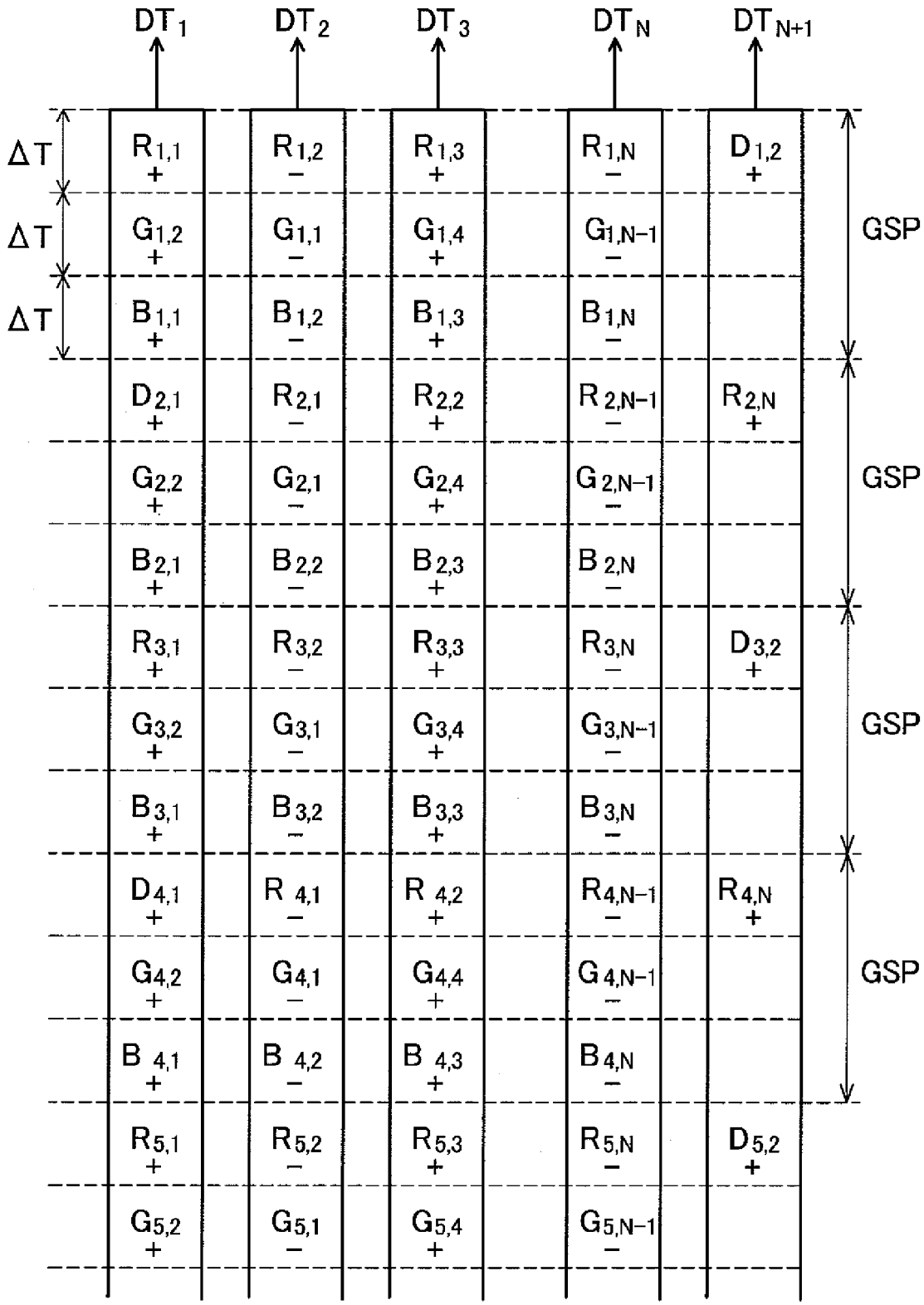
FIG. 31B is a schematic diagram showing one example of video signals applied to video signal input terminals and their polarities.
Figure 31C:
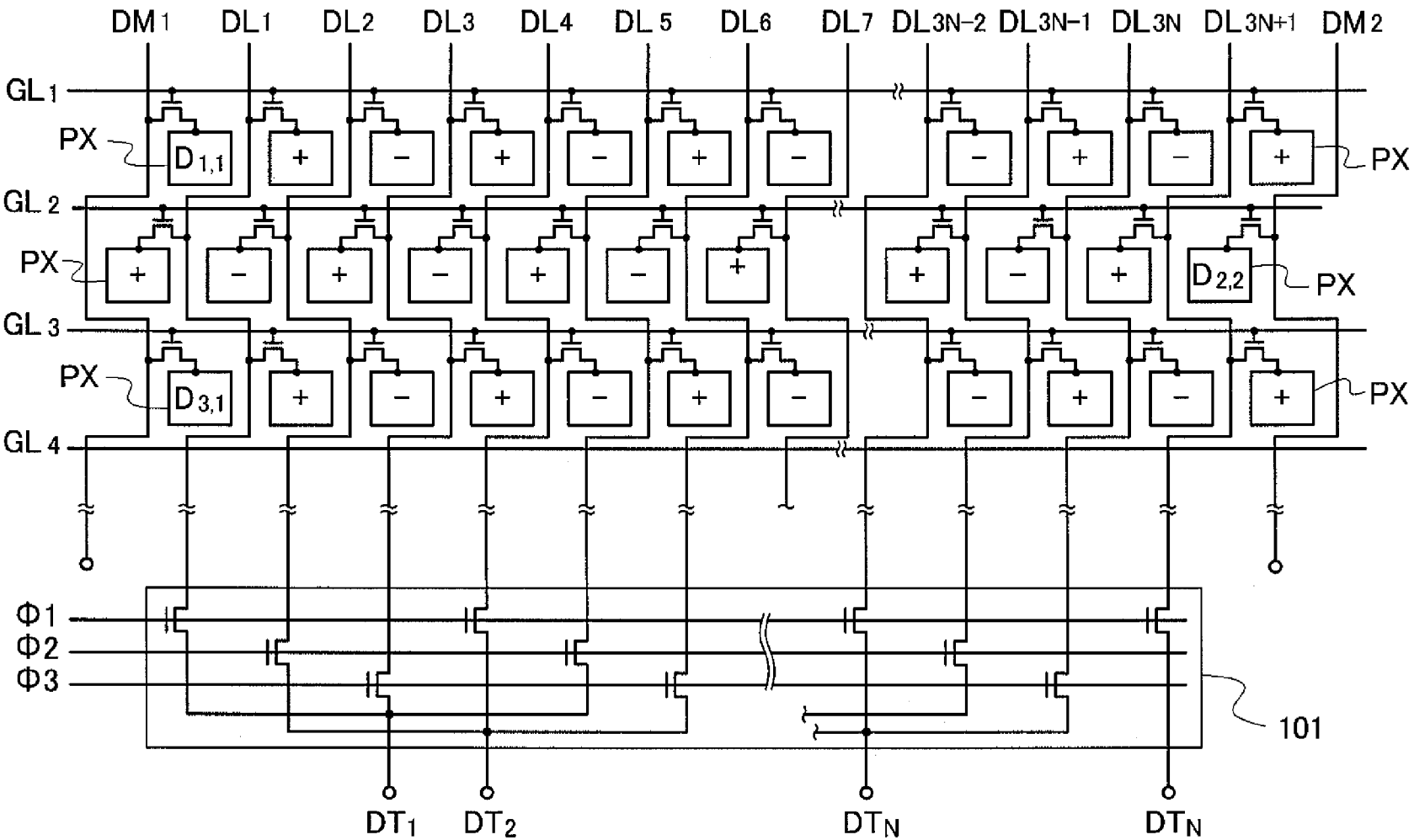
FIG. 31C is a schematic diagram showing one example of the polarities of individual electrodes for one frame period.

FIG. 31A is a schematic diagram showing one example of a method of driving the liquid crystal display panel of Embodiment 9. FIG. 31B is a schematic diagram showing one example of video signals applied to video signal input terminals and their polarities. FIG. 31C is a schematic diagram showing one example of the polarities of individual pixel electrodes for one frame period.

When driving the liquid crystal display panel of Embodiment 9, signals applied to each scan signal line $GL_m$, each switching wire ϕ1, ϕ2, and ϕ3, and each video signal input terminal $DT_q$ are switched at the kind of timing shown in FIG. 31A. At this time, a configuration is such that switching signals applied to the individual switching wires ϕ1, ϕ2, and ϕ3, with one horizontal selection period as one cycle, attain the H level in the order of ϕ1, ϕ2, and ϕ3 for the one cycle.

At this time, one video signal input terminal $DT_1$ and three video signal lines $DL_1$, $DL_3$, and $DL_5$ are connected in the order of $DL_1$, $DL_5$, and $DL_3$ for one cycle (one horizontal selection period). Also, at this time, another video signal input terminal $DT_2$ and three other video signal lines $DL_2$, $DL_4$, and $DL_6$ are connected in the order of $DL_4$, $DL_2$, and $DL_6$ for one cycle (one horizontal selection period). Consequently, gradation voltages are input into each of the video signal input terminals $DT_1$ and $DT_2$ in the kind of order shown in FIG. 31A.

Also, although not shown, gradation voltages are also input into each of the remaining video signal input terminals $DT_3$ to $DT_N$ in the same kind of order.

At this time, the polarities of gradation voltages input into each video signal input terminal $DT_q$ are shown in FIG. 31B. Also, the polarities of individual pixel electrodes PX for one frame period are shown in FIG. 31C. At this time, gradation voltages, when generated in the drive circuit 3, are generated by the same method as that in the case of the line inversion drive. For this reason, it being possible to reduce the frequency of polarity reversal of gradation voltages applied to one video signal input terminal $DT_q$ to a rate of once per frame period, it is possible to reduce the power consumption of the drive circuit 3. Consequently, with Embodiment 9, it is possible to balance the enhancement in image quality and the reduction in power consumption.

Also, with the liquid crystal display panel of Embodiment 9, for example, as with the liquid crystal display panel of Embodiment 7, it is also acceptable that two video signal lines $DL_1$ and $DL_{3N+1}$ disposed on the outermost sides of the display area DA are electrically connected by a wire JP passing outside the display area DA.

Although the invention has heretofore been described based on the heretofore described embodiments, the invention not being limited to the heretofore described embodiments, it is needless to say that various changes may be made without departing from the scope thereof.

For example, in Embodiment 1 to Embodiment 9, a description has been given, exemplifying with the case in which the invention is applied to the liquid crystal display panel but, the invention not being limited to this, it is needless to say that the invention can be applied to a liquid crystal display panel as long as it is of the same configuration, and driven by the same drive method, as those of the heretofore described liquid crystal display panel.

Also, in Embodiment 1 to Embodiment 9, the liquid crystal display panel with which one unit pixel of a video or image is expressed by three pixels has been taken as an example but, the invention not being limited to this, it is needless to say that the invention can also be applied to a liquid crystal display panel with which one unit pixel is expressed by four or more pixels.

What is claimed is:

1. A liquid crystal display device comprising: a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals, wherein the switch circuit has a plurality of switch elements and a plurality of switching wires which carry out an activation and deactivation of the switch elements, each of the plurality of switch elements is connected to one of the plurality of switching wires, each of the plurality of video signal lines is connected to one of the plurality of video signal input terminals via one of the plurality of switch elements, each of the plurality of video signal input terminals is connected to a plurality of the plurality of video signal lines, the switching wires, to which are connected the switch elements connected one to each of the plurality of the plurality of video signal lines, differ from one another, each of the plurality of switching wires is connected to a plurality of the plurality of switch elements, among the video signal lines connected one to each of the plurality of the plurality of switch elements, there exist two or more kinds of number of other video signal lines disposed between two adjacent video signal lines, the video signal input terminals include a first video signal input terminal and a second video signal input terminal adjacent to the first video signal input terminal, the video signal lines include a first video signal line, a second video signal line, a third video signal line, a fourth video signal line, a fifth video signal line, and a sixth video signal line which are formed aligned in the order named, the switching wires include a first switching wire, a second switching wire, and a third switching wire, the first video signal input terminal is connected to the first video signal line, second video signal line, and third video signal line, the second video signal input terminal is connected to the fourth video signal line, fifth video signal line, and sixth video signal line, the switch element connected to the first video signal line, and the switch element connected to the sixth video signal line, are connected to the first switching wire, the switch element connected to the second video signal line, and the switch element connected to the fifth video signal line, are connected to the second switching wire, and the switch element connected to the third video signal line, and the switch element connected to the fourth video signal line, are connected to the third switching wire.

2. The liquid crystal display device according to claim 1, wherein each of the pixel electrodes is connected to one of a source electrode and drain electrode of each of the TFT elements, and one of the video signal lines is connected to the other, a plurality of the TFT elements are connected to the one video signal line, and all of the plurality of the TFT elements connected to the one video signal line are formed on one of two sides adjacent to the one video signal line.

3. The liquid crystal display device according to claim 1, wherein each of the pixel electrodes is connected to one of a source electrode and drain electrode of each of the TFT elements, and one of the video signal lines is connected to the other, a plurality of the TFT elements are connected to the one video signal line, and adjacent ones of the plurality of the TFT elements connected to the one video signal line are formed on either of two sides adjacent to the one video signal line.

4. The liquid crystal display device according to claim 3, wherein two video signal lines, from among the plurality of video signal lines, disposed on the outermost side are electrically connected.

5. The liquid crystal display device according to claim 1, wherein the positions of two adjacent pixel electrodes, from among a plurality of pixel electrodes disposed between the two adjacent video signal lines, are displaced from one another in a direction in which the scan signal lines extend, and the positions of two pixel electrodes, from among the plurality of pixel electrodes, disposed across one pixel electrode, are the same as each other in the direction in which the scan signal lines extend.

6. The liquid crystal display device according to claim 1, wherein the switch elements being TFT elements, gate electrodes of the TFT elements and the switching wires are connected.

7. A liquid crystal display device comprising: a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals, wherein the switch circuit has a plurality of switch elements and a plurality of switching wires which carry out an activation and deactivation of the switch elements, each of the plurality of switch elements is connected to one of the plurality of switching wires, the video signal input terminals have a plurality of units, each of which is formed of a first video signal input terminal and a second video signal input terminal, the plurality of switch elements have a plurality of first switch elements and a plurality of second switch elements, each of the plurality of video signal lines is connected to the first video signal input terminal via one of the plurality of first switch elements, and connected to the second video signal input terminal of the same unit as that of the first video signal input terminal, via one of the plurality of second switch elements, the switching wires, to which are connected the first switch element and second switch element connected to one of the video signal lines, differ from one another, a plurality of the video signal lines are connected to each of the plurality of units, the first switch element and second switch element being connected to each of the plurality of the video signal lines, one combination of a switching wire to which the first switch element is connected, and a switching wire to which the second switch element is connected, differs from another combination, the video signal input terminals include a first video signal input terminal and a second video signal input terminal adjacent to the first video signal input terminal, the video signal lines include a first video signal line, a second video signal line, a third video signal line, a fourth video signal line, a fifth video signal line, and a sixth video signal line which are formed aligned in the order named, the switching wires include a first switching wire, a second switching wire, and a third switching wire, the first video signal input terminal is connected to the first video signal line, second video signal line, and third video signal line, the second video signal input terminal is connected to the fourth video signal line, fifth video signal line, and sixth video signal line, the switch element connected to the first video signal line, and the switch element connected to the sixth video signal line, are connected to the first switching wire, the switch element connected to the second video signal line, and the switch element connected to the fifth video signal line, are connected to the second switching wire, and the switch element connected to the third video signal line, and the switch element connected to the fourth video signal line, are connected to the third switching wire.

8. The liquid crystal display device according to claim 7, wherein each of the pixel electrodes is connected to one of a source electrode and drain electrode of each of the TFT elements, and one of the video signal lines is connected to the other, a plurality of the TFT elements are connected to the one video signal line, and all of the plurality of the TFT elements connected to the one video signal line are formed on one of two sides adjacent to the one video signal line.

9. The liquid crystal display device according to claim 7, wherein the positions of two adjacent pixel electrodes, from among a plurality of pixel electrodes disposed between the two adjacent video signal lines, are displaced from one another in a direction in which the scan signal lines extend, and the positions of two pixel electrodes, from among the plurality of pixel electrodes, disposed across one pixel electrode, are the same as each other in the direction in which the scan signal lines extend.

10. The liquid crystal display device according to claim 7, wherein the switch elements being TFT elements, gate electrodes of the TFT elements and the switching wires are connected.

11. A liquid crystal display device comprising: a plurality of scan signal lines; a plurality of video signal lines intersecting the scan signal lines via an insulating layer; a plurality of pixels; TFT elements formed one in each of the plurality of pixels; pixel electrodes connected one to each of the TFT elements; a plurality of video signal input terminals, the number of which is less than the number of video signal lines; a switch circuit interposed between the plurality of video signal input terminals and the plurality of video signal lines; and a drive circuit which inputs video signals into each of the plurality of video signal input terminals, wherein the switch circuit has a plurality of switch elements and a plurality of switching wires which carry out an activation and deactivation of the switch elements, each of the plurality of switch elements is connected to one of the plurality of switching wires, the video signal input terminals have a plurality of units, each of which is formed of a first video signal input terminal and a second video signal input terminal, the plurality of switch elements have a plurality of first switch elements, a plurality of second switch elements, and a plurality of third switch elements, each of the plurality of video signal lines is connected to the first video signal input terminal via one of the plurality of first switch elements and one of the plurality of second switch elements, and connected to the second video signal input terminal of the same unit as that of the first video signal input terminal, via one of the plurality of first switch elements and one of the plurality of third switch elements, a first video signal line group formed of a plurality of the video signal lines, and a second video signal line group formed of a plurality of the video signal lines, are connected to each of the plurality of units, the switching wires, to which are connected the first switch elements connected one to each of the video signal lines of the first video signal line group, differ from one another, the second switch elements connected one to each of the video signal lines of the first video signal line group are connected to a first switching wire, the third switch elements connected one to each of the video signal lines of the first video signal line group are connected to a second switching wire differing from the first switching wire, the second switch elements connected one to each of the video signal lines of the second video signal line group are connected to the second switching wire, the third switch elements connected one to each of the video signal lines of the second video signal line group are connected to the first switching wire, the video signal input terminals include a first video signal input terminal and a second video signal input terminal adiacent to the first video signal input terminal, the video signal lines include a first video signal line, a second video signal line, a third video signal line, a fourth video signal line, a fifth video signal line, and a sixth video signal line which are formed aligned in the order named, the switching wires include a first switching wire, a second switching wire, and a third switching wire, the first video signal input terminal is connected to the first video signal line, second video signal line, and third video signal line, the second video signal input terminal is connected to the fourth video signal line, fifth video signal line, and sixth video signal line, the switch element connected to the first video signal line, and the switch element connected to the sixth video signal line, are connected to the first switching wire, the switch element connected to the second video signal line, and the switch element connected to the fifth video signal line, are connected to the second switching wire, and the switch element connected to the third video signal line, and the switch element connected to the fourth video signal line, are connected to the third switching wire.

12. The liquid crystal display device according to claim 11, wherein each of the video signal lines of the first video signal line group is connected to one identical second switch element and one identical third switch element, and each of the video signal lines of the first video signal line group is connected to another identical second switch element and another identical third switch element.

* * * * *